US007155150B2

(12) United States Patent
Kurosu

(10) Patent No.: US 7,155,150 B2
(45) Date of Patent: Dec. 26, 2006

(54) METHOD AND APPARATUS FOR DEVELOPING A LATENT IMAGE USING TONER GRAINS CONSTITUTING A DEVELOPER

(75) Inventor: Hisao Kurosu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/334,537

(22) Filed: Jan. 19, 2006

(65) Prior Publication Data

US 2006/0120768 A1 Jun. 8, 2006

Related U.S. Application Data

(62) Division of application No. 10/666,244, filed on Sep. 22, 2003, now Pat. No. 7,035,576.

(30) Foreign Application Priority Data

Sep. 19, 2002 (JP) ..... 2002-274077
Nov. 25, 2002 (JP) ..... 2002-340910

(51) Int. Cl.
*G03G 15/08* (2006.01)

(52) U.S. Cl. ..... 399/270

(58) Field of Classification Search ..... 399/267, 399/270, 272; 430/122
See application file for complete search history.

(56) References Cited

U.S. PATENT DOCUMENTS 4,473,029 A * 9/1984 Fritz et al. ..... 399/236
5,202,730 A 4/1993 Fuji et al.
5,202,731 A 4/1993 Tanikawa et al.
5,239,342 A 8/1993 Kubo et al.
6,345,161 B1 * 2/2002 Mizuno ..... 399/55
6,696,213 B1 2/2004 Yamaguchi et al.
6,708,015 B1 3/2004 Kurosu et al.
6,728,503 B1 * 4/2004 Stelter et al. ..... 399/267
7,035,576 B1 * 4/2006 Kurosu ..... 399/270
2004/0126145 A1 7/2004 Kurosu

FOREIGN PATENT DOCUMENTS

JP 09269662 A * 10/1997

* cited by examiner

*Primary Examiner*—Robert Beatty
(74) *Attorney, Agent, or Firm*—Oblon, Spivak, McClelland, Maier & Neustadt, P.C.

(57) ABSTRACT

A method of developing a latent image formed on a surface of an image carrier with toner grains, which constitute a developer together with magnetic carrier grains for supporting the toner grains, by depositing the developer on a developer carrier, which faces the image carrier and accommodates magnetic field forming mechanism, causing the developer carrier to convey the developer to a developing zone formed between the image carrier and the developer carrier, and forming, in the developing zone, a magnet brush including the magnetic carrier grains, which hold the toner grains and gather in a form of brush chains, and free toner grains to be released from the carrier grains, the brush chains of the magnetic carrier grains flow in the developing zone while forming the magnet brush, and, assuming that a potential of the image carrier is $V_{pc}$ and that a DC component of a potential of the developer carrier is $V_{DC}$, the free toner grains, parted from the magnetic carrier grains flowing, fly at a means flight velocity of 1 m/s or below when $V_{pc}-V_{DC}=400$ V holds.

36 Claims, 32 Drawing Sheets

FIG. 15

| q/m (μC/g) | Tc (wt%) | d (μm) | D (μm) | R (mm) | $V_{SL}$ (mm/s) | RIGHT MEMBER OF (1) ($10^5$ v/m) | L (mm) | E ($10^5$ v/m) | TONER FLIGHT |
|---|---|---|---|---|---|---|---|---|---|
| −20 | 5 | 7 | 35 | 30 | 385 | 1.00 | 6.4 | 1.06 | ○ |
| −20 | 5 | 7 | 35 | 30 | 210 | 1.83 | 4.8 | 1.61 | × |
| −20 | 5 | 7 | 35 | 30 | 210 | 1.83 | 3.7 | 2.09 | ○ |
| −30 | 5 | 7 | 35 | 30 | 210 | 2.75 | 2.7 | 2.51 | × |
| −30 | 5 | 7 | 35 | 30 | 210 | 2.75 | 1.1 | 3.52 | ○ |
| −20 | 10 | 7 | 35 | 30 | 210 | 1.26 | 6.4 | 1.51 | ○ |
| −20 | 5 | 7 | 50 | 30 | 210 | 1.07 | 6.4 | 1.06 | ○× |
| −20 | 5 | 7 | 50 | 18 | 210 | 0.65 | 6.4 | 1.06 | ○ |

FIG. 30

| | DUTY RATIO (%) | VELOCITY FOR $V_{PC} - V_{DC} = 400V$ | | VELOCITY FOR $V_{PC} - V_{DC} = 200V$ | DENSITY UNIFORMITY | BACKGROUND CONTAMINATION | DOT UNIFORMITY |
|---|---|---|---|---|---|---|---|
| | | MEAN (m/s) | STANDARD DEVIATION | MEAN (m/s) | | | |
| EX. 1 | 50 | 0.87 | 0.51 | 0.50 | ○ | ◎ | ◎ |
| COM. EX. 1 | 40 | 0.80 | 0.42 | 0.45 | △ | ◎ | ◎ |
| EX. 2 | 20 | 0.95 | 0.57 | 0.58 | ◎ | ◎ | ◎ |
| EX. 3 | 60 | 1.0 | 0.66 | 0.65 | ◎ | ◎ | ○ |
| COM. EX. 2 | 65 | 1.1 | 0.75 | 0.68 | ◎ | △ | × |

METHOD AND APPARATUS FOR DEVELOPING A LATENT IMAGE USING TONER GRAINS CONSTITUTING A DEVELOPER

CROSS-REFERENCE TO RELATED APPLICATIONS

This application is a divisional of U.S. application Ser. No. 10/666,244, filed Sep. 22, 2003, now U.S. Pat. No. 7,035,576 and claims the benefit of priority from the Japanese Patent Application Nos. 2002-274077, filed Sep. 19, 2002, and 2002-340910, filed Nov. 25, 2002, the entire contents of each of which are incorporated herein by reference.

BACKGROUND OF THE INVENTION

1. Field of the Invention

The present invention relates to a copier, printer, facsimile apparatus or similar image forming apparatus and a developing device for the same.

2. Description of the Background Art

It is a common practice with an image forming apparatus to form a latent image on a photoconductive drum or similar image carrier, develop the latent image with a developing device, which stores a developer therein, and then transfer the resulting toner image to a sheet-like recording medium. The developer is, in many cases, implemented as a two-component type developer consisting of toner grains and magnetic carrier grains because this type of developer is feasible for color image formation.

The developer is agitated and mixed in the developing device to be charged by friction. The toner grains electrostatically deposit on the carrier grains thus charged. The carrier grains, holding the toner grains thereon, are deposited on a sleeve or tubular developer carrier by being attracted by a magnet disposed in the sleeve. The sleeve in rotation conveys the developer deposited thereon to a developing zone.

A main magnet for development is disposed in the sleeve at, in a facing zone where the drum and sleeve face each other, the closest position. As the developer on the sleeve approaches the main magnet, a number of carrier grains in the developer gather and rise in the form of brush chains along the magnetic lines of force issuing from the main magnet, forming a magnet brush.

As for development using the magnet brush mentioned above, the magnet brush contacts the drum in a developing zone. In this condition, the carrier grains, which are dielectric, are presumed to intensify an electric field between the drum and the sleeve for thereby causing the toner grains to fly from the carrier grains present on the tips of the brush chains directly to a latent image or drum surface. According to this presumption, however, the conventional magnet brush type development has a problem that development is effected only by the toner grains transferred from the brush chains to a latent image in a limited portion around the closest position. Stated another way, in a portion where the magnet brush is absent and a portion where it does not contact a latent image, development by the toner grains directly transferred from the tips of the magnet brush to the latent image does not occur at all. More specifically, the toner grains can develop a latent image only in a limited portion where the tips of the magnet brush contact the drum. It is therefore extremely difficult to increase the number of toner grains contributing to development by controlling conditions other than the above limited portion.

To implement a high-density image in such a limited portion, Japanese Patent No. 2668781, for example, discloses a developing method that uses both of toner grains deposited on the brush chains of carrier grains and toner grains deposited on the sleeve for development by using an alternating electric field. This developing method, however, has some problems left unsolved. First, a developing zone available is only the portion where the carrier grains contact the drum, so that sufficiently high image density is not easy to attain only with the toner grains held on the carrier grains and toner grains present on the sleeve in the above developing zone. Second, the number of brush chains is too small to realize a smooth, high quality solid image with an electrode effect. Third, the electric field causes the toner grains deposited on, e.g., the brush chains to move toward the sleeve, smearing the sleeve. This makes the electric field different from the surrounding and therefore causes a residual image to appear in a halftone image.

Japanese Patent Laid-Open Publication Nos. 6-208304 and 7-319174, for example, each propose to deposit toner on a photoconductive element and then remove excess part of the toner for thereby implementing high image density and reducing fog. For this purpose, magnetic toner deposited on the surface of an image carrier, accommodating a magnet therein, is brought into contact with an electrode roller, also accommodating a magnet therein, so that unnecessary toner is removed from portions other than an image portion. Further, Japanese Patent Laid-Open Publication No. 5-46014 proposes to effect development with a first developing roller and then remove excess toner with a second developing roller to which only a carrier is fed.

However, a problem with technologies taught in Laid-Open Publication Nos. 6-208304 and 7-319174 mentioned above is that a magnet must be disposed in the photoconductive element as well. This, coupled with the fact that such technologies are applicable only to a developing system using magnetic toner, increases cost and cannot meet the demand for color image formation. The scheme of Laid-Open Publication No. 5-46014 is not practicable without resorting to two developing rollers and without constantly feeding only fresh magnetic carrier, resulting an increase in cost.

On the other hand, Japanese Patent Laid-Open Publication No. 9-222799 pertains to the flight of toner grains and teaches a relation between the configuration effect of one-component toner having a grain size as small as 4 μm or less and air resistance specifically.

In anyone of the conventional schemes described above, only the region where the magnetic grains rub the photoconductive drum constitutes a developing zone. It is therefore difficult to achieve sufficiently high image density with only toner grains deposited on brush chains present in the developing zone and toner grains deposited on the drum. Further, because the number of brush chains is small, it is difficult to implement a smooth solid image with an electrode effect. Moreover, it is difficult to obviate background contamination by controlling the deposition of toner grains in portions other than an image portion.

Japanese Patent Laid-Open Publication No. 5-303284, for example, discloses a non-contact type developing system in which two magnetic poles are positioned at both sides of a developing zone close to an image carrier while the distance between image carrier and a developing sleeve is selected to be greater than the thickness of a developer layer formed on the developing sleeve. In this condition, the developer is caused to jump for effecting development. Although this developing system is capable of desirably reproducing a highlight portion and implementing a faithful halftone portion, it sometimes renders a black solid image short in density or blurred due to short developing efficiency, as determined by experiments. It is therefore necessary to further improve image quality as to developing efficiency and the density of a black solid image.

Another developing method, which is new but not laid open to public inspection yet, uses free toner grains for development. More specifically, a developer carrier, accommodating a magnet therein, faces an image carrier and conveys a toner and carrier mixture forming a layer thereon. A difference in speed is established between the developer carrier and the magnet in order to cause the developer layer to flow while forming a magnet brush at least in a zone where the developer carrier and image carrier face each other. While the developer carrier is flowing, free toner grains part from magnetic carrier grains and deposit on a latent image formed on the image carrier. Because the free toner grains contribute to development, the developing zone available with this developing method is broader than the developing zone of the conventional magnet brush type developing method that causes magnetic carrier grains to directly contact the image carrier, as will be described more specifically later. This successfully increases the amount of development and therefore enhances developing efficiency for thereby realizing a high-density solid image, as determined by experiments.

SUMMARY OF THE INVENTION

It is an object of the present invention to provide a developing method allowing the entire region where an image carrier and a developer carrier face each other to join in development to thereby broaden a zone where toner effects development and increase image density in a solid portion as well as in a black solid image, a developing method for practicing it, and an image forming apparatus including the same.

It is another object of the present invention to provide a developing method capable of enhancing a developing ability in an image portion and reducing the contamination of a non-image portion, a developing method using it, and an image forming apparatus including the same.

A developing method of the present invention develops a latent image formed on the surface of an image carrier with toner grains, which constitute a developer together with magnetic carrier grains, by depositing the developer on a developer carrier, which faces the image carrier and accommodates magnetic field forming means therein, causing the developer carrier to convey the developer to a developing zone formed between the image carrier and the developer carrier, and forming, in the developing zone, a magnet brush consisting of the magnetic carrier grains, which hold the toner grains thereon and gather in a form of brush chains, and free toner grains to be released from the carrier grains. The brush chains of the magnetic carrier grains flow in the developing zone while forming the magnetic brush, and, assuming that a potential of the image carrier is $V_{PC}$ and that a DC component of a potential of the developer carrier is $V_{DC}$, the free toner grains, parted from the magnetic carrier grains flowing, fly at a mean flight velocity of 1 m/s or below when $V_{PC}-V_{DC}=400$ V -holds.

BRIEF DESCRIPTION OF THE DRAWINGS

The above and other objects, features and advantages of the present invention will become more apparent from the following detailed description taken with the accompanying drawings in which:

FIG. 15 is a table listing the results of experiments relating to the flight of toner in the upstream portion of a developing zone;

FIG. 30 is a table listing the results of estimation of developing ability conducted by varying a duty ratio.

DESCRIPTION OF THE PREFERRED EMBODIMENTS

Figure 1:
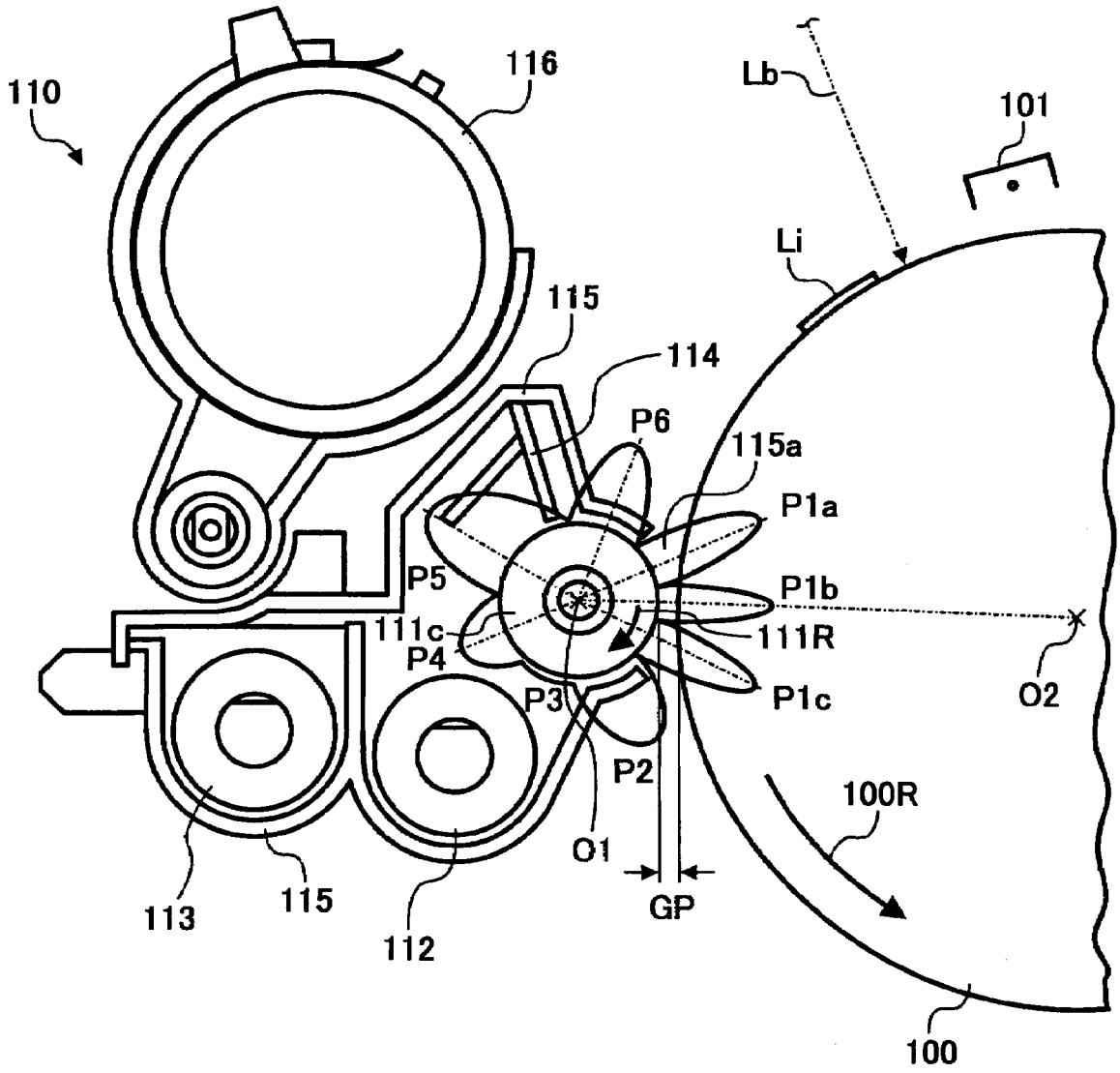
FIG. 1 is a front view showing the basic construction of a developing device embodying the present invention.

Referring to FIG. 1 of the drawings, an image forming apparatus embodying the present invention is shown and directed mainly toward the first object stated earlier. As shown, the image forming apparatus includes a tubular drum or image carrier 100 formed with a photoconductive layer thereon and rotatable clockwise, as indicated by an arrow 100R in FIG. 1. A charger 101 adjoins the drum 100 for uniformly charging the surface of the drum 100.

A developing device 110 includes a casing 115 and a sleeve 111*c* accommodating a stationary magnet roller therein. The sleeve 111*c* faces the drum 100 through an opening formed in the casing 115 and is spaced from the drum 100 by a preselected gap GP. Screws 112 and 113 are disposed in the casing 115 and convey a developer stored in the casing 115 toward the sleeve 111*c*. In the illustrative embodiment, the developer comprises a two-component type developer made up of toner grains and magnetic carrier grains. A toner storing section or toner feeding means 116 is positioned above the casing 115 and replenishes fresh toner to the casing 115, as needed.

A laser beam Lb scans the surface of the drum 100 charged by the charger 101 imagewise at a position downstream of the charger 101 in the direction 100R, thereby forming a latent image Li on the drum 100. When the latent image Li is conveyed by the drum 100 to a facing zone where the drum 100 and sleeve 111*c* face each other, the toner grains are transferred from the sleeve 111*c* to the latent image Li in the facing zone to thereby produce a corresponding toner image.

A doctor blade 114 is positioned in the upstream portion in a direction (clockwise) 111R in which the sleeve 111*c* conveys the developer deposited thereon. The doctor blade or metering member 114 regulates the height of brush chains formed by the toner grains, which hold the toner grains, on the sleeve 111, i.e., the thickness of the developer layer. While a conventional doctor blade is implemented as a plate formed only of a nonmagnetic material, the doctor blade 114 of the illustrative embodiment is made up of the conventional nonmagnetic plate and a magnetic plate adhered thereto. The magnetic plate serves to easily regulate the height of the brush chains.

FIG. 1 does not show an image transferring device for transferring the toner image from the drum 100 to a sheet or recording medium, a cleaning device for removing residual toner grains left on the drum 100 after image transfer, and a quenching device for quenching the surface of the drum 100.

Figure 2:
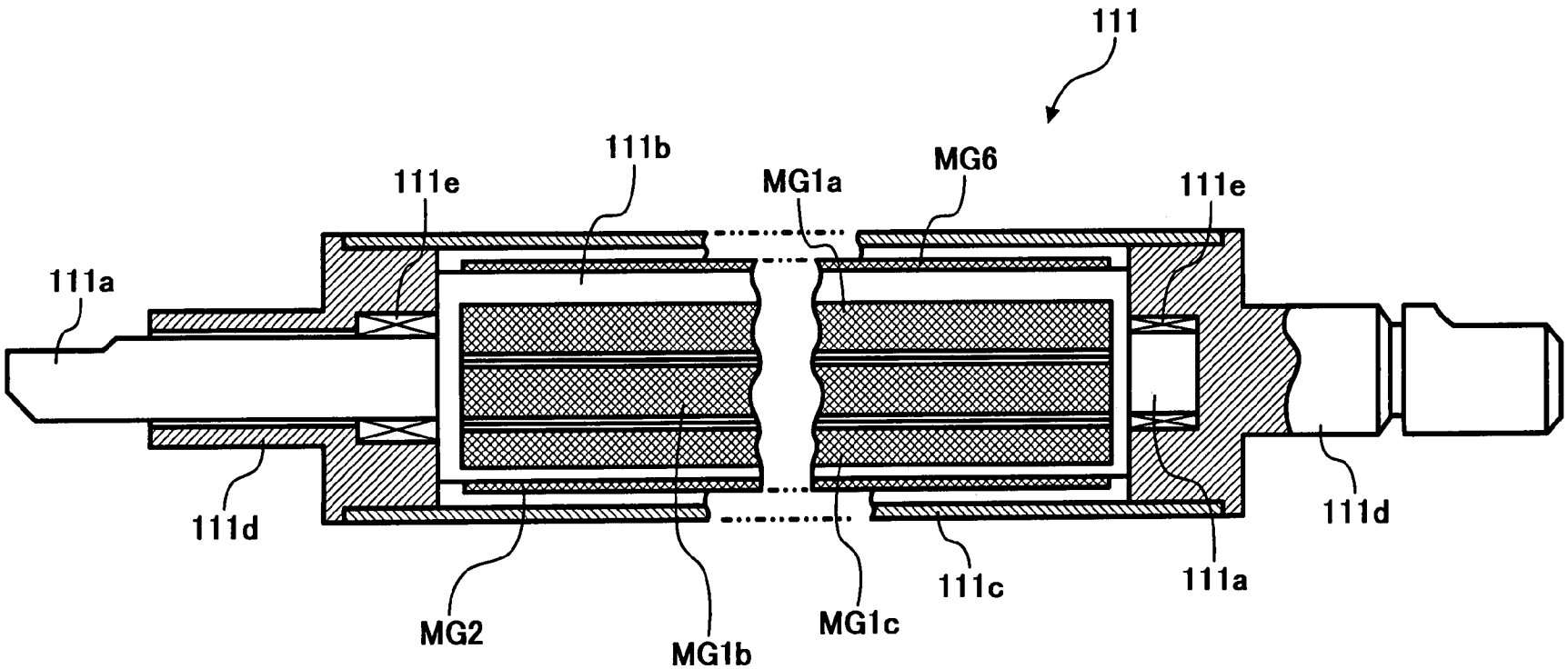
FIG. 2 is a section showing a specific configuration of a sleeve included in the illustrative embodiment.

The sleeve 111*c*, forming part of a developing roller 111, is rotatable about the stationary magnet roller. More specifically, as shown in FIG. 2, the developing roller 111 includes a stationary shaft 11*a* affixed to the casing or stationary member 115. A cylindrical magnet support 111*b* is constructed integrally with the stationary shaft 111*a*. The sleeve 111*c* surrounds the magnet support 111*b* while being spaced therefrom by a gap. A rotatable shaft or member 11*d* is constructed integrally with the sleeve 111*c* and rotatable about the stationary shaft 111*a* via bearings 111*e*. Drive means, not shown, causes the rotatable shaft 111*d* to rotate.

Figure 3:
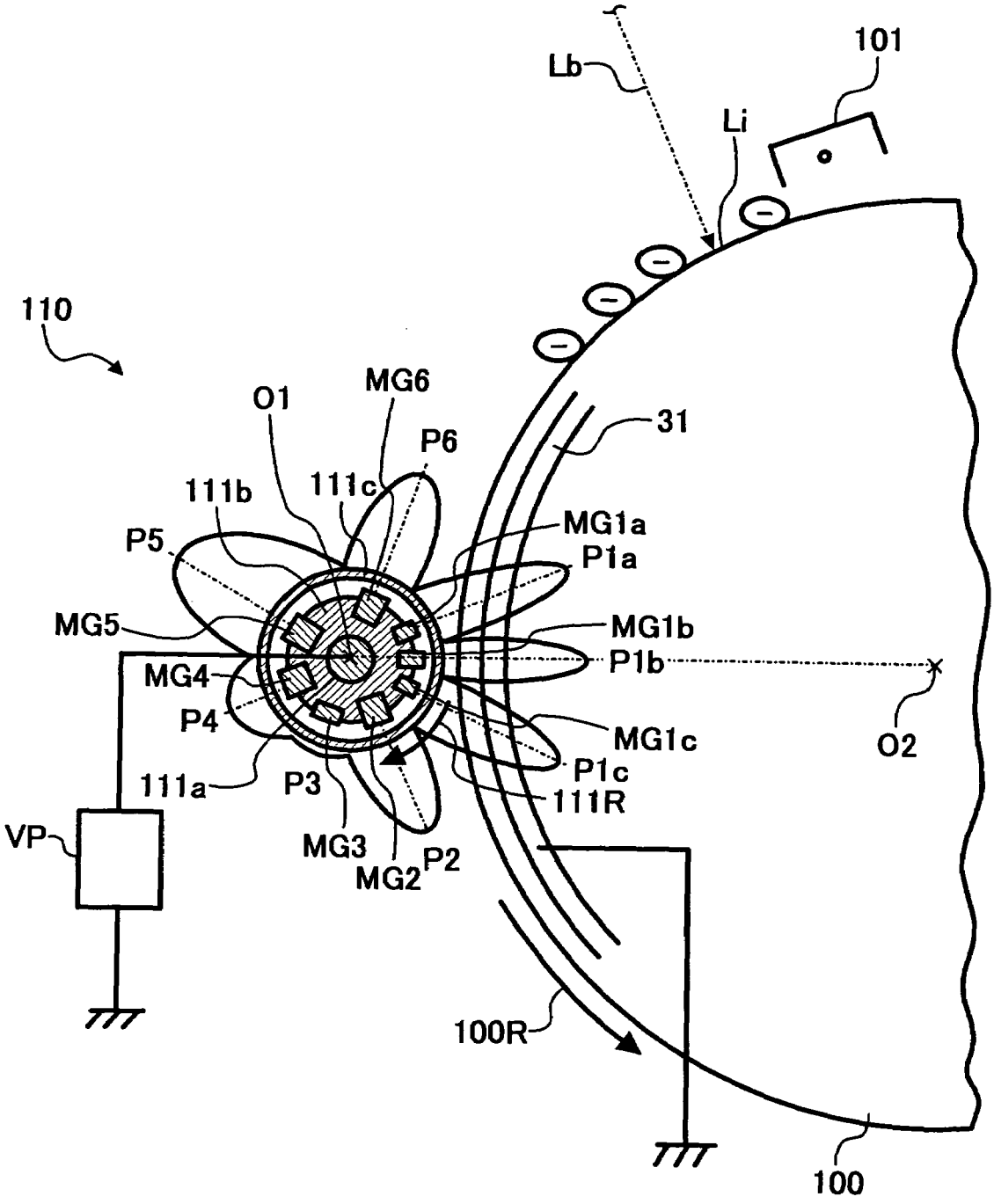
FIG. 3 is a view for describing the illustrative embodiment.

As shown in FIG. 3, a plurality of magnets MG1*a*, MG1*b*, MG1*c*, MG2, MG3, MG4, MG5 and MG6 (collectively labeled MG hereinafter) are affixed to the periphery of the magnet support 111*b*. The sleeve 111*c* is formed of aluminum, brass, stainless steel, conductive resin or similar nonmagnetic material and is caused to rotate clockwise, as viewed in FIG. 3, around the magnets MG by a drive mechanism not shown. The magnets MG each form a particular magnetic field such that the developer rises on the sleeve 111*c* in the form of a magnet brush while being conveyed by the sleeve 111*c*. More specifically, the carrier grains gather in the form of brush chains along the magnetic lines of force issuing from the magnets MG in the normal direction. Such brush chains, holding the toner grains, gather to form a magnet brush.

In the illustrative embodiment, the drum 100 and sleeve 111*c*, spaced from each other by the gap GP, both are tubular, so that the distance between them increases little by little at both sides of the closest position. It is to be noted that the closest position exists even when the drum 100 is implemented as a belt by way of example. In FIGS. 1 and 2, the closest position exists on a virtual line connecting the axis O1 of the sleeve 111*c* and the axis O2 of the drum 100.

As shown in FIG. 3, the second magnet MG1*a*, first or main magnet MG1*b*, magnet MG1*c* and magnets MG2 through MG6 form magnetic force distributions P1*a*, P1*b*, P1*c*, P2, P3, P4, P5 and P6, respectively, around the sleeve 111*c*. The first magnet MG1*b*, forming the magnetic force distribution P1*b*, is located at the closest position. The second magnet MG1*a* and magnet MG1*c*, respectively forming the magnetic force distributions P1*a* and P1*c*, are respectively positioned at the upstream side and downstream side of the first magnet MG1*b* in the direction 111R. The magnets MG2 through MG6 are sequentially arranged downstream of the magnet MG1*c* in the direction 111R in this order. The second magnet MG1*a*, first magnet MG1*b* and magnet MG1*c* lie in the facing zone where the sleeve 111*c* and drum 100 face ach other.

In the illustrative embodiment, development is effected by using the magnet brush formed by at least the magnets MG1*a* and MG1*b* and rising and then falling on the sleeve 111*c*. The magnets MG1*c* and MG6 respectively limit the half widths of magnetic forces of the magnets MG1*b* and MG1*a*, which adjoin the magnets MG1*c* and MG6, respectively, so that the magnet brush effectively behaves during development. This enhances the developing ability.

Figure 4A:
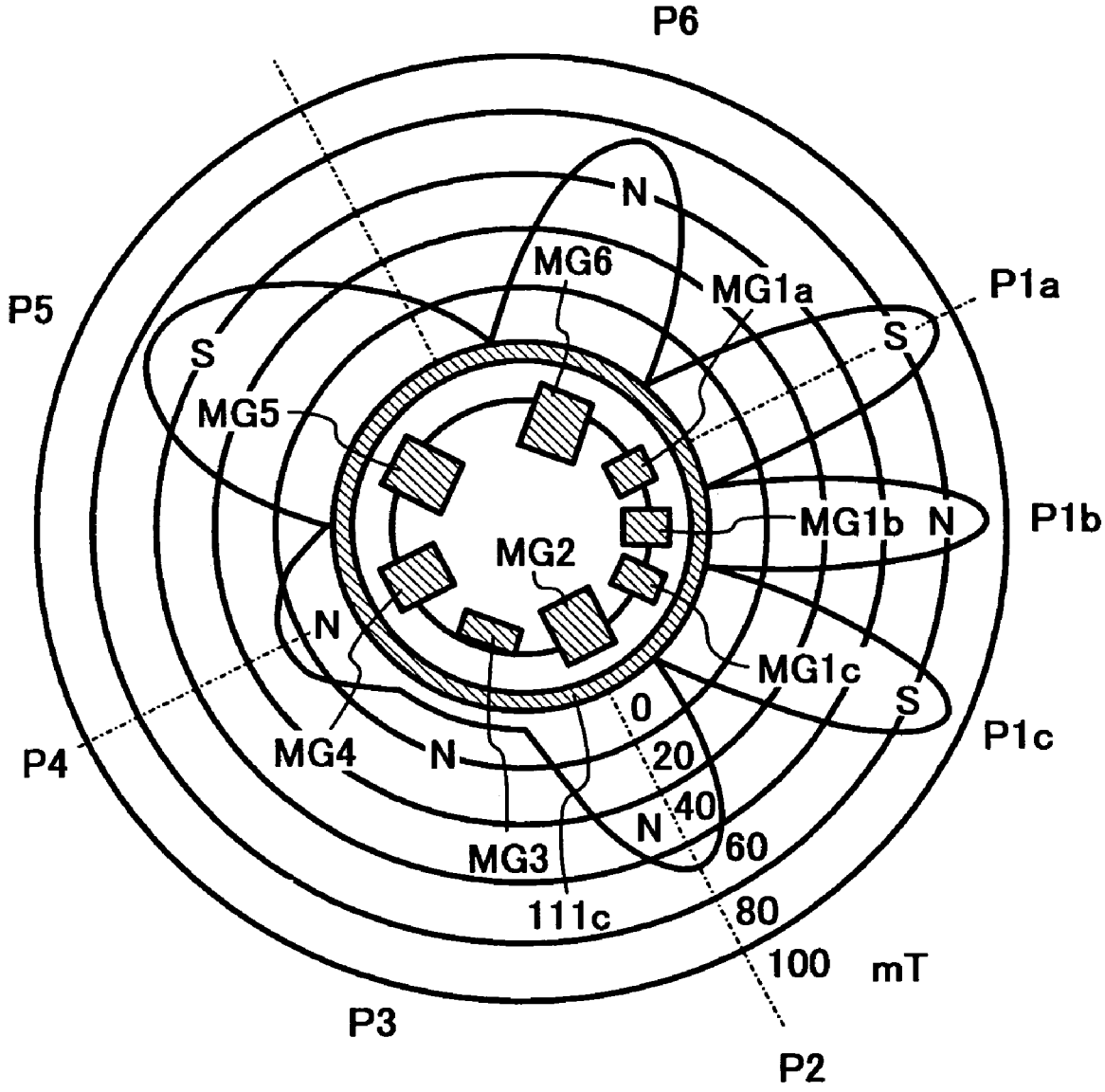
FIG. 4A is a chart showing magnetic force distributions and sizes thereof.

As shown inn FIG. 4A, the magnets MG, adjoining each other, limit each other's half widths such that the magnets or magnetic force distributions can effectively function. Small half widths of the magnets cause the brush chains of the magnet brush to sharply or rapidly rise and then fall down. This presumably disturbs the configuration of the brush chains for thereby allowing the toner grains to easily part from the carrier grains and fly. Further, the duration of contact of the developer with the drum decreases, so that counter charge to the carrier grains is presumably induced little.

The magnet MG4 functions to scoop up the developer onto the sleeve 111*c* while the magnet MG 3 serves to cause the magnet brush to fall down. The magnets MG2, MG5 and MG6 serve to convey the developer deposited on the sleeve 111*c* to the facing zone. The axes of the magnets MG1*a* through MG6 all are positioned in the radial direction of the sleeve 111*c*.

While the illustrative embodiment arranges the three magnets MG1*a*, MG1*b* and MG1*c* in the facing zone, four or more magnets may be arranged in the facing zone in order to produce more free toner grains. Also, the eight poles may be replaced with, e.g., ten or twelve poles by increasing the number of magnets between the magnet MG3 and the doctor blade 114.

The magnets MG1*a*, MG1*b* and MG1*c*, sequentially arranged in this order in the direction 111R, each are provided with a small cross-sectional area and formed of a rare earth metal alloy although it may be formed of a samarium alloy or a samarium-cobalt alloy. A magnet formed of an iron-neodium-boron alloy, which is a typical rare earth metal alloy, has the maximum energy product of 358 kJ/$m^3$ while a magnet formed of an iron-neodium-boron ally bond has the maximum energy product of 80 kJ/$m^3$ or so. Such a magnet can implement a necessary magnetic force on the sleeve 111*c* even when noticeably reduced in size. If the diameter of the sleeve 111*c* is allowed to have a relatively large diameter, then the conventional ferrite magnet or ferrite bond magnet may be used, in which case the end of the magnet, facing the sleeve 111*c*, will be tapered in order to reduce the half width of the magnetic force.

As shown in FIG. 4A, in the illustrative embodiment, the first magnet MG1*b* and magnets MG2, MG3, MG4 and MG6 form N poles while the magnets MG1*a*, MG1*c* and MG5 form S poles. The first magnet MG1*b* comprises a magnet exerting a magnetic force of 85 mT or above on the sleeve 111*c* in the normal direction by way of example. If the magnetic force is, e.g., 60 mT or above, the deposition of carrier grains or similar image defect does not occur, as determined by experiments. Carrier deposition occurred when the magnetic force is below 60 mT.

The second magnet MG1*a*, first magnet MG1*b* and magnet MG1*c* each were 2 mm wide. In this condition, the magnetic force distribution P1*b* had a half width of 16°. By further reducing the width of the magnet, it was possible to further reduce the half width, as determined by experiments. More specifically, when the first magnet MG1*b* was 1.6 mm wide, the magnetic force of the magnetic force distribution P1*b* was measured to be 12°.

Figure 4B:
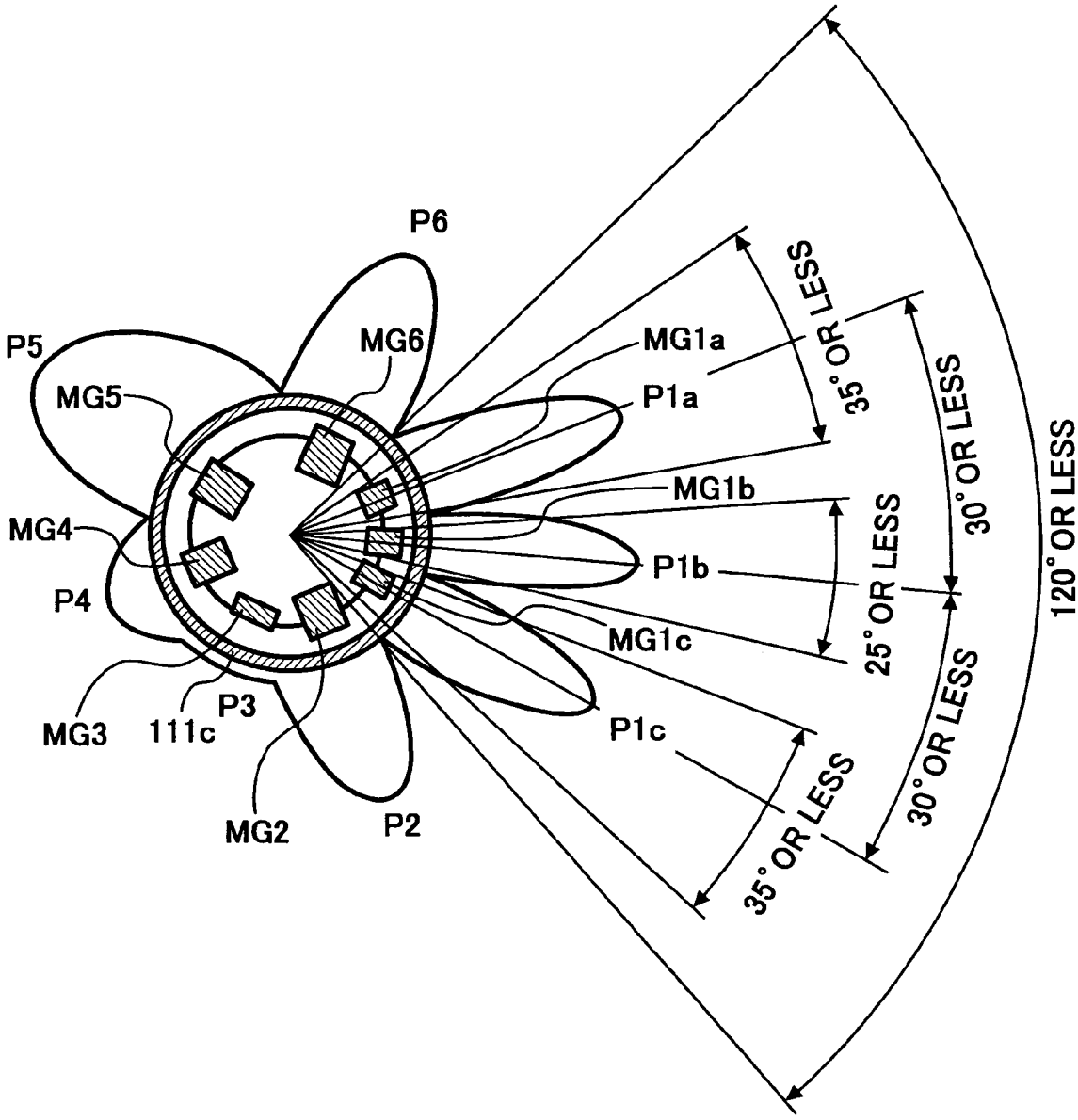
FIG. 4B shows a positional relation between magnets.

FIG. 4B shows a positional relation between the first magnet MG1*b*, the second magnet MG1*a* and the magnet MG1*c*. As shown, the magnetic force distributions P1*a* and P1*c* are provided with half widths of 35°. These half widths cannot be made as small as the half width of the magnetic force distribution P1*b* because distributions P2 and P6 outside of the distributions P1*a* and P1*c* each have a large half width.

The angle between the first magnet MG1*b* and the second magnet MG1*a* and the angle between the first magnet MG1*b* and the magnet MG1*c* each are selected to be 30° C. or below. In the illustrative embodiment, because the half width at the magnetic field distribution P1*b*, the above angle is selected to be 22°. The angle between the polarity transition points formed by the magnets MG1*a* and MG1*c* and magnets MG2 and MG6 are selected to be 120°. A polarity transition points refers to a point where transition from the S pole to the N pole, or vice versa, occurs and where the magnetic force is 0 mT.

As shown in FIG. 3, a power supply VP, connected to ground, is connected to the stationary shaft 111*a*, so that the voltage of the power supply VP is applied to the sleeve 111*c* via the conductive bearings 111*e* and conductive rotary member 111*d*, FIG. 2. On the other hand, in FIG. 3, a conductive support 31, forming the innermost layer of the drum 100, is grounded.

In the above configuration, a magnetic field that causes the toner grains parted from the carrier grains to move toward the drum 100 is formed in the facing zone.

In the illustrative embodiment, the developing device is combined with an image forming apparatus of the type writing a latent image with a laser beam Lb. More specifically, after the charger 101 has uniformly charged the drum 100 to negative polarity, the laser beam Lb scans the drum 100 to form the latent image Li by lowering the potential for the purpose of reducing the amount of writing. Such negative-to-positive development is only illustrative, i.e., the polarity of charge to deposit on the drum 100 is not questionable in the illustrative embodiment.

While the sleeve 11*c* has been shown and described as rotating relative to the magnets MG, the magnets MG may be rotated relative to the sleeve 111*c* or the sleeve 111*c* and magnets MG may be rotated in opposite directions to each other. The crux is that a speed difference be established between the sleeve 111*c* and the magnets MG.

The gap GP between the drum 100 and the sleeve 111*c* is selected in accordance with various conditions, e.g., whether or not the tips of the brush chains contact the drum 100 and whether or not the brush chains start rising at the closest position.

The developer applicable to the illustrative embodiment will be described hereinafter. The screw 112, positioned at the opposite side to the drum 100 with respect to the sleeve 111*c*, scoops up the developer onto the sleeve 111*c* while agitating it. The developer, made up of toner grains T and magnetic carrier grains CC, are mixed and agitated by the screws 112 and 113, which are rotated by drive means not shown. As a result, the toner grains T are frictionally charge by an amount Q/M of −5 μC/g to −60 μC/g, preferably −10 μC/g to −30 μC/g.

The carrier grains CC may be implemented as ferromagnetic grains of iron, nickel, cobalt or similar metal or an alloy thereof with another metal, magnetite, γ-hematite, chromium dioxide, copper-zinc ferrite, manganese-zinc ferrite or similar oxide or manganese-copper-aluminum or similar Heusler's alloy. If desired, the ferromagnetic grains may be coated with styrene-acrylic resin, silicone resin, fluorocarbon resin or similar resin in accordance with the chageability of the toner grains T. A charge control agent, a conductive substance and so forth may be added to the above resin, if desired.

The magnetic grains stated above may be dispersed in, e.g., styrene-acryl resin or polyester resin. The saturation magnetization of the ferromagnetic grains should preferably be between 45 emu/g and 85 emu/g. Saturation magnetization below 45 emu/g degrades conveyance and aggravates carrier deposition on the drum 100. Saturation magnetization above 85 emu/g tightens the magnet brush and therefore intensifies the scavenging effect, resulting in scavenging marks in a halftone image portion.

The toner grains T consist of at least thermoplastic resin and carbon black or copper phthalocyanine-based, quinacrydone-based, bisazo-based or similar pigment. As for resin, use should preferably be made of styrene-acryl resin or polyester resin. Polypropylene or similar wax, which promotes fixation, and an alloy-containing dye, which controls the amount of charge to deposit on the toner grains T may be added, if desired. Further, an oxide, a nitride or carbonate, e.g., silica, alumina or titanium oxide, as well as a fatty acid metal salt or a fine resin grains, may be added.

The brush chains, magnet brush and position where the brush chains rise will be described more specifically hereinafter. As shown in FIGS. 1, 3 and 4, the magnetic force distributions P1*a* through P6 formed by the magnets MG extend from the outer periphery of the sleeve 111*c* in the radial direction. When the developer, which is conveyed by the sleeve 111*c*, passes each magnetic force distribution, the carrier grains rise in the form of brush chains on the sleeve 111*c* along the magnetic lines of force in the normal direction and then fall down. This will be described with reference to FIGS. 5A through 5G that pay attention to the magnetic force distribution P1*a* by way of example.

As shown in FIGS. 5A through 5G, magnetic lines of force (1) through (7) issue from the sleeve 111*c* in the normal direction in the magnetic force distribution P1*a*. The magnetic line of force (1) extends substantially tangentially to the sleeve 111*c*. The magnetic lines of force (2) and (3) sequentially increase in rising angle in this order. The magnetic line of force (4) is substantially perpendicular to the surface of the sleeve 111*c* and is therefore highest. The magnetic lines of force (5), (6) and (7), symmetrical to the magnetic lines of force (3), (2) and (1), sequentially decrease in rising angle in this order. The magnetic line of force (7) falls down in a position close to the tangential line. The magnetic line of force (4) is coincident with the virtual line connecting the axes O1 and O2, FIG. 1.

Figure 5A:
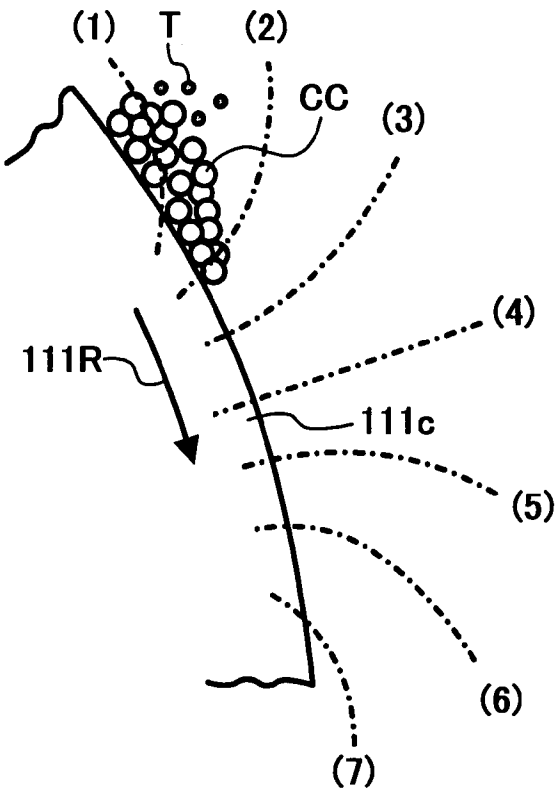
FIGS. 5A through 5G demonstrate the displacement of a brush chain and the production of free toner grains in consecutive stages.

More specifically, as shown in FIG. 5A, when the developer layer on the sleeve 111*c* approaches the magnetic force distribution P1*a*, the carrier grains CC start rising above the developer layer in the form of a brush chain, or magnet brush, along the magnetic line of force (1). At this instant, the toner grains T held by the carrier grains CC are released from the carrier grains CC into a space and become free toner grains that contribute to development. Such free toner grains appear and effect development only if the carrier grains form a brush chain at at least one position.

Further, when the brush chain rises, the developer in the developer layer is also displaced with the result that the toner grains are released from the carrier grains in the developer layer also and become free toner grains T. This will be described with reference to FIGS. 7 through 9 more specifically later. In addition, the toner grains are released from the carrier grains CC at a positions between nearby brush chains. It was experimentally found that the free toner grains T appeared and flew toward the drum 100 when the latent image or image portion Li was present in the facing zone, but did not appear when a non-image portion was present in the facing zone.

Figure 5B:
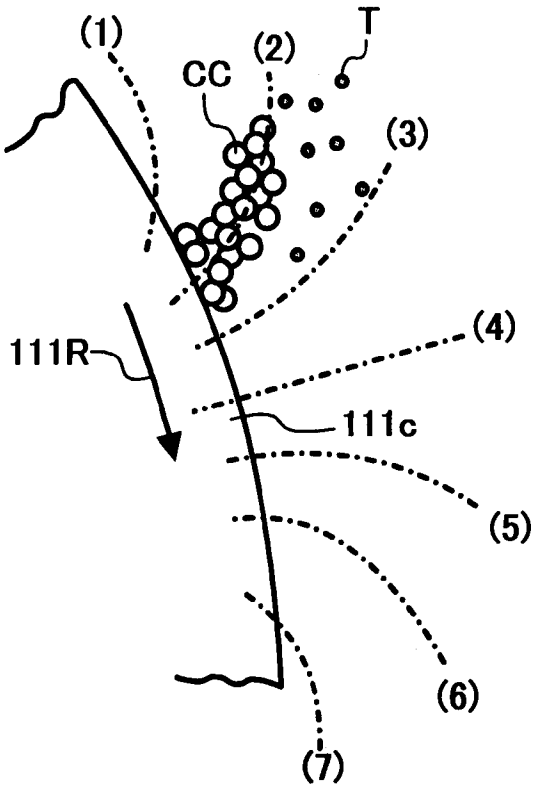

When the sleeve 111*c* rotates from the position shown in FIG. 5A to the position shown in FIG. 5B, the brush chain changes in position and configuration along the magnetic line of force (2). At this instant, other toner grains T are released from the carrier grains into the space at the upstream side in the direction 111R and become free toner grains T.

Figure 5C:
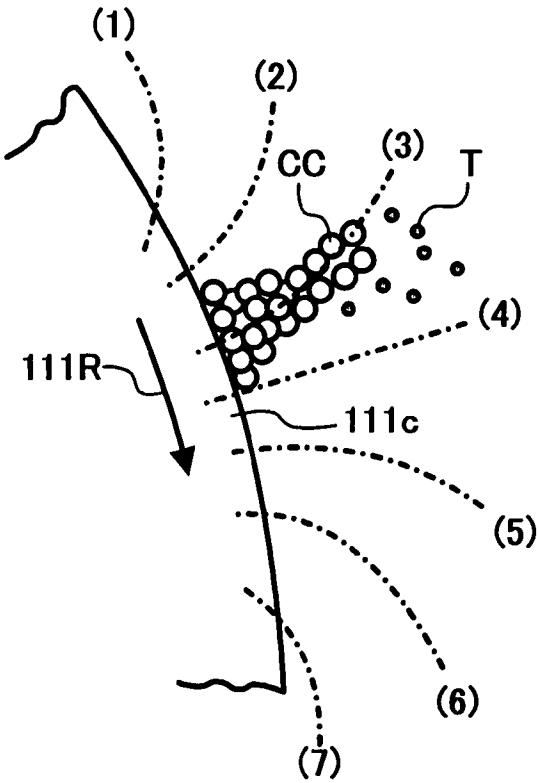

When the sleeve 111*c* further rotates from the position shown in FIG. 5B to the position shown in FIG. 5C, the brush chain changes in position and configuration along the magnetic line of force (3). At this time, too, other toner grains T are released from the carrier grains into the space at the downstream side in the direction 111R and become free toner grains T.

Figure 5D:
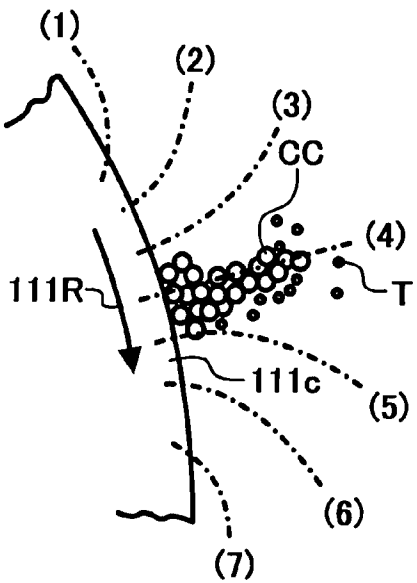

When the sleeve 111*c* further rotates from the position shown in FIG. 5C to the position shown in FIG. 5D, the brush chain changes in position and configuration along the magnetic line of force (4) and stand substantially upright on the surface of the sleeve 111*c*. At this time, too, other toner grains T are released from the carrier grains into the space around the tip of the brush chain and become free toner grains T.

Figure 5E:
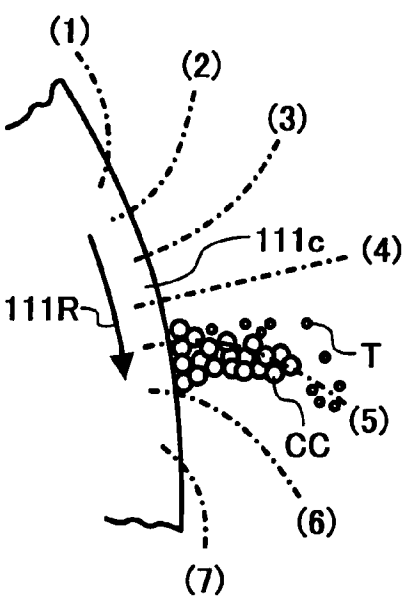

When the sleeve 111*c* further rotates from the position shown in FIG. 5D to the position shown in FIG. 5E, the brush chain changes in configuration and position along the magnetic line of force (5), which adjoins the magnetic line of force (4) at the downstream side in the direction 111R and falls toward the downstream side. At this time, too, other toner grains T are released from the carrier grains into the space at the upstream side in the direction 111R and around the tip of the brush chain and become free toner grains T.

Figure 5F:
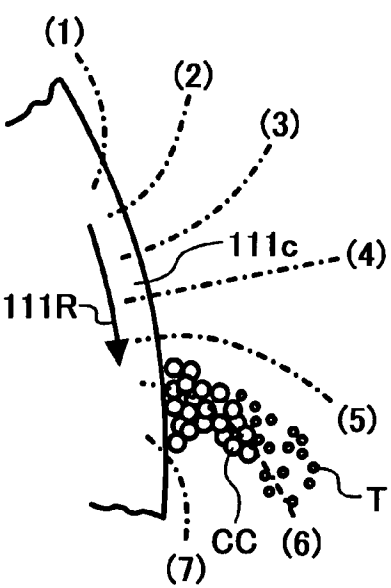

When the sleeve 111*c* further rotates from the position shown in FIG. 5E to the position shown in FIG. 5F, the brush chain changes in position and configuration along the magnetic line of force (6), which falls down more than the magnetic line of force (5). At this time, too, other toner grains T are released from the carrier grains into the space at the upstream side in the direction 111R and around the tip of the brush chain and become free toner grains T.

Figure 5G:
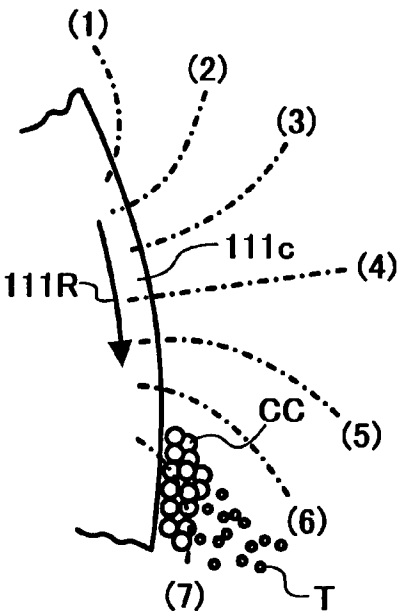

When the sleeve 111*c* further rotates from the position shown in FIG. 5F to the position shown in FIG. 5G, the brush chain changes in position and configuration along the magnetic line of force (7), which falls down more than the magnetic line of force (6). At this time, too, other toner grains T are released from the carrier grains into the space at the side to which the brush chain falls down.

When the sleeve 111*c* further rotates from the position shown in FIG. 5G, the brush chain falls down and joins the developer layer present on the sleeve 111*c*, although not shown specifically. At this instant, toner grains are released from the carrier grains present in the developer layer and become free toner grains. More specifically, when the brush chain formed by the carrier grains CC falls down on the sleeve 111*c*, the tip of the brush chain is are caused to join the developer layer on the sleeve 111*c* by the magnet lying in a developing zone.

It should be noted that, in practice, brush chains are formed along the magnetic lines of force (1) through (7) at the same time and move toward the following magnetic lines of force in accordance with the rotation of the sleeve 111*c*.

In the specific conditions shown in FIGS. 5A through 5G, the brush chains, rising along the magnetic lines of force (1) through (7), form a magnet brush. In this case, the portion around the sleeve 111*c* in which a brush chain rises in the facing zone and then falls constitutes a rising zone.

The portion in which the developer, being conveyed on the sleeve 111*c*, rises above the developer layer in the form of a brush chain because of the force of the magnet MG and again joins the developer layer on the sleeve 111*c* will be referred to as a continuous zone hereinafter. The toner grains, held by the carrier grains, part from the carrier grains mainly in the continuous zone due to the change in position and configuration. If at least one continuous zone is available, then the free toner grains parted from the carrier grains can contribute to development.

Stated another way, the assembly of brush chains, rising along a number of magnetic lines of force in a single magnetic field distribution, is referred to as a magnet brush. The zone where the brush chains, constituting the magnet brush, are present around the sleeve 111*c* is the rising zone.

The above description relating to the magnetic force distribution P1*a* similarly applies to the other magnetic force distributions P1*b* and P1*c*.

As stated above, a large amount of free toner grains appear around the magnet brush or brush chains in accordance with the change in the configuration of the brush chains and can contribute to development. This enhances developing efficiency, compared to the conventional development that directly transfers toner grains from magnetic carriers to a latent image.

The change in the configuration of the brush chain described above is presumably such that the rising and falling motion of the brush chain is sharp or rapid due to the small half width of the magnetic force, causing the magnet brush to sharply rise and sharply fall down.

A developing method unique to the illustrative embodiment will be described more specifically hereinafter. The developing method to be described establishes a developing zone broader than conventional one and can therefore increase the amount of toner grains that contribute to development without increasing the ratio of the linear velocity Vs of the sleeve 111*c* to the linear velocity Vp of the drum 100, i.e., Vs/Vp.

In the illustrative embodiment, at least one rising portion is formed in the facing zone where the drum sleeve 111*c* and drum 100 face each other. Because the sleeve 111*c* is smaller in diameter than the drum 100, the maximum facing zone is expressed as [diameter×axial length], which corresponds to the projection area of the sleeve 111*c*. However, in the illustrative embodiment, the casing 115, surrounding the sleeve 111*c*, is formed with an opening 115*a* only in a necessary portion that does not obstruct the flight of the toner grains toward the latent image, as shown in FIG. 1. The sleeve 111*c* and drum 100 directly face each other only through the above opening 115*a*. More specifically, in the illustrative embodiment, the opening 115*a* of the casing 115 is sized smaller than the maximum facing zone in the direction 11R in order to obviate, e.g., toner scattering.

In the illustrative embodiment, the developing zone refers to a zone in which the toner grains fly from the developer toward the drum 100 without regard to whether the brush chains, formed by the carrier grains, form a magnet brush or whether they form a thin developer layer on the sleeve 111*c*. Hereinafter will be described development effected in the limited facing zone corresponding to the size of the opening 115*a*.

When the sleeve 111*c* rotates in the direction 111R, the developer deposited on the sleeve 111*c* is metered by the doctor blade 114 and then conveyed by the magnetic force distribution P6 to the facing zone, because the doctor blade 114 is present at a position where the magnetic force distribution P5 falls. The magnetic force distributions P1*a*, P1*b* and P1*c*, lying in the facing zone, cause the developer to form a magnet brush. The developer therefore flows while forming a magnet brush in accordance with the rotation of the sleeve 111*c*. In the developing zone belonging to the facing zone, the toner grains are transferred to the latent image. Subsequently, the developer left on the sleeve 111*c* is substantially fully removed from the sleeve 111*c* by the magnetic force distribution P3 and dropped onto the screw 112.

Figure 6:
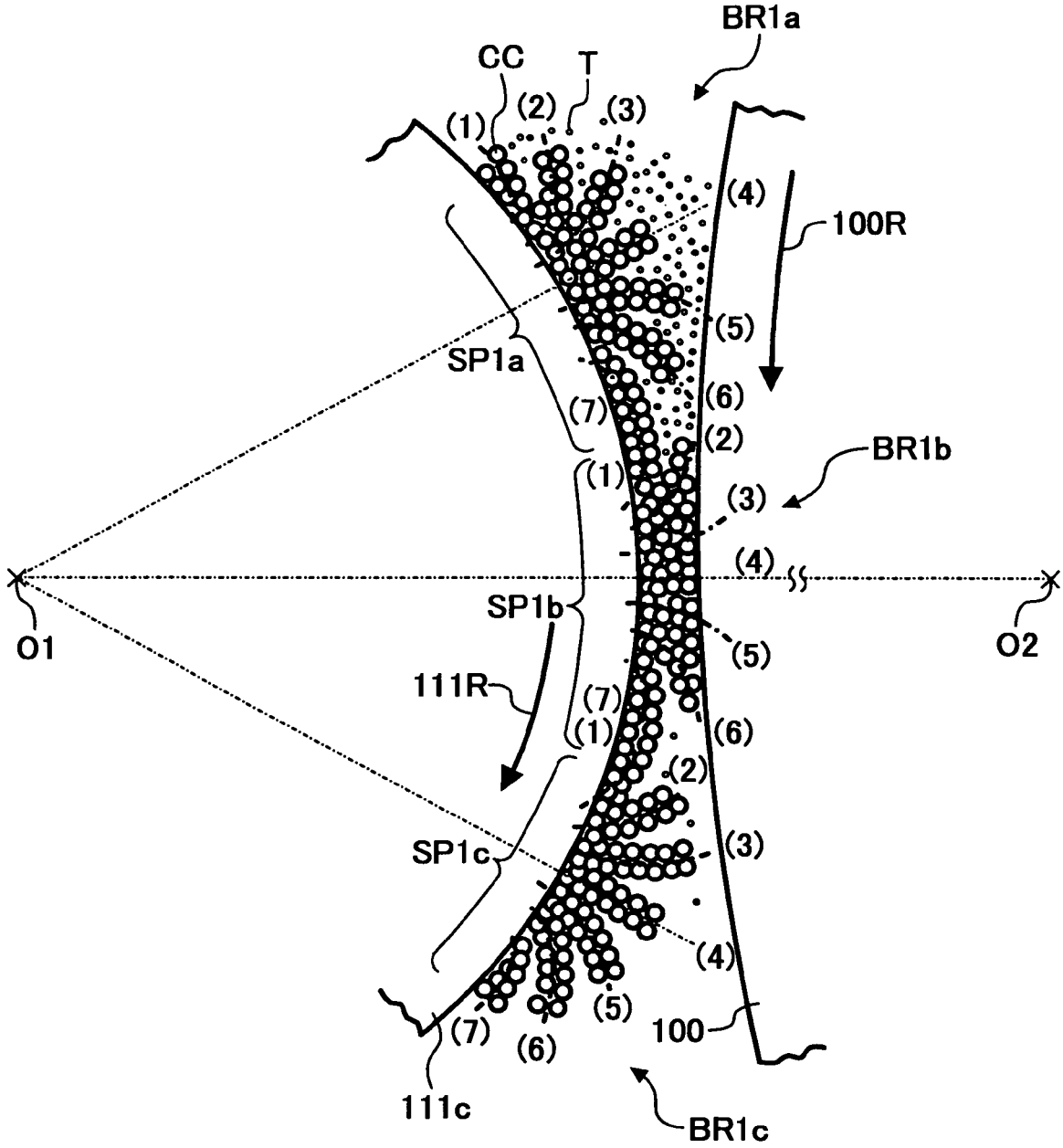
FIG. 6 shows a specific condition wherein a plurality of brush chains rise in a facing zone.

FIG. 6 shows magnet brushes BR1*a*, BR1*b* and BR1*c* formed by the magnetic force distributions P1*a*, P1*b* and P1*c* in the rising zone in the conditions shown in FIGS. 1 through 4. While the magnet brushes BR1*a* through BR1*c*, formed by brush chains rising along the magnetic lines of force (1) through (7) shown in FIGS. 5A through 5G, resemble in appearance, the carrier grains of the individual brush chains flow while holding the toner grains thereon. The toner grains are released from the carrier grains so flowing and become free toner grains.

The brush chains BR1 through BR3 rise in the rising zones or spaces SP1*a* through SP1*c*, respectively, which form part of the facing zone. In the condition shown in FIG. 6, the magnet brush BR1*b* contacts the drum 100, but the magnet brush BR1*a* does not contact it. The rising zone SP1*b* is formed by the first magnet MG1*b*, or magnetic force distribution P1*b*, corresponding to the closest position where the sleeve 111*c* is closest to the drum 100. The rising zone SP1*a* is formed by the second magnet MG1*a*, or magnetic field distribution P1*a*, positioned upstream of the rising zone SP1*b* in the direction 111R in which the developer is conveyed.

In the specific condition shown in FIG. 6, toner grains are sufficiently deposited on the latent image in the rising zones SP1*a* and SP1*b* in a saturated state. Therefore, development occurs little in the rising zone SP1*c* downstream of the rising zone SP1*b* in the direction 111R. When an alternating electric field is formed between the sleeve 111*c* and the drum 100, the toner grains are caused to oscillate at the downstream side of the rising zone SP1*b* and regulated to the latent image potential thereby little by little.

In the illustrative embodiment, the magnet P1*c* must be located in the vicinity of the magnet MG1*b* in order to provide the magnet MG1*b* with a small half width at the closest position. As a result, the rising zone SPc is automatically formed by the magnet MG1*b*. The object of the illustrative embodiment is achievable only if the rising zones SP1*a* and SP1*b* exist in the configuration shown in FIG. 6 or if at least one rising zone exists in the facing zone in the vicinity of, but upstream of, the closest position.

Experiments were conducted with two different developing devices, i.e., (1) the developing device shown in FIG. 6 and having eight magnets MG1*a* through MG6 (MG1*a* through MG1*c* lying in the facing zone and (2) a developing device having a single magnet at the closest position in place of the three magnets MG1*a* through MG1*c* and the magnets MG2 through MG6. The developing device (1) was found to be superior to the developing device (2) as to the quality of a black solid image and granularity, the omission of a trailing edge and so forth. In the developing device (2), the magnetic force of the magnet, lying in the facing zone alone, had a half width of 21°. As for the other developing conditions, the developing devices (1) and (2) were identical with each other.

In the illustrative embodiment, at least one magnet brush is caused to contact the drum 100 for thereby forming the latent image, as stated earlier with reference to FIG. 6. In this condition, the free toner grains deposit on the latent image while the toner grains on the tips of the brush chains directly deposit on the latent image when rubbing or adjoining the drum 100 (contact type of development). The carrier grains on the tips of the brush chains cause the toner grains deposited on the drum 100 to part from the drum 100. This insures a smooth solid image, reduces fog in a non-image portion, and renders horizontal thin lines and characters clear-cut.

In the condition shown in FIG. 6, the rising zone SP1*b* assigned to the magnet brush BR1*b* is located at the closest position; the magnet brush BR1*b* contacts the drum 100. The rising zone SP1*a* assigned to the other magnet brush BR1*a* is located upstream of the closest position; the magnet brush BR1*a* is spaced from the drum 100. Free toner grains are produced and deposited on the drum 100 on the path along which the distance between the sleeve 111*c* and the drum 100 decreases little by little up to the closest position. This, coupled with the toner grains caused to part from the drum 100 by the magnet brush BR1*b*, insures a smooth solid image and renders horizontal lines and characters clear-cut.

Figure 7:
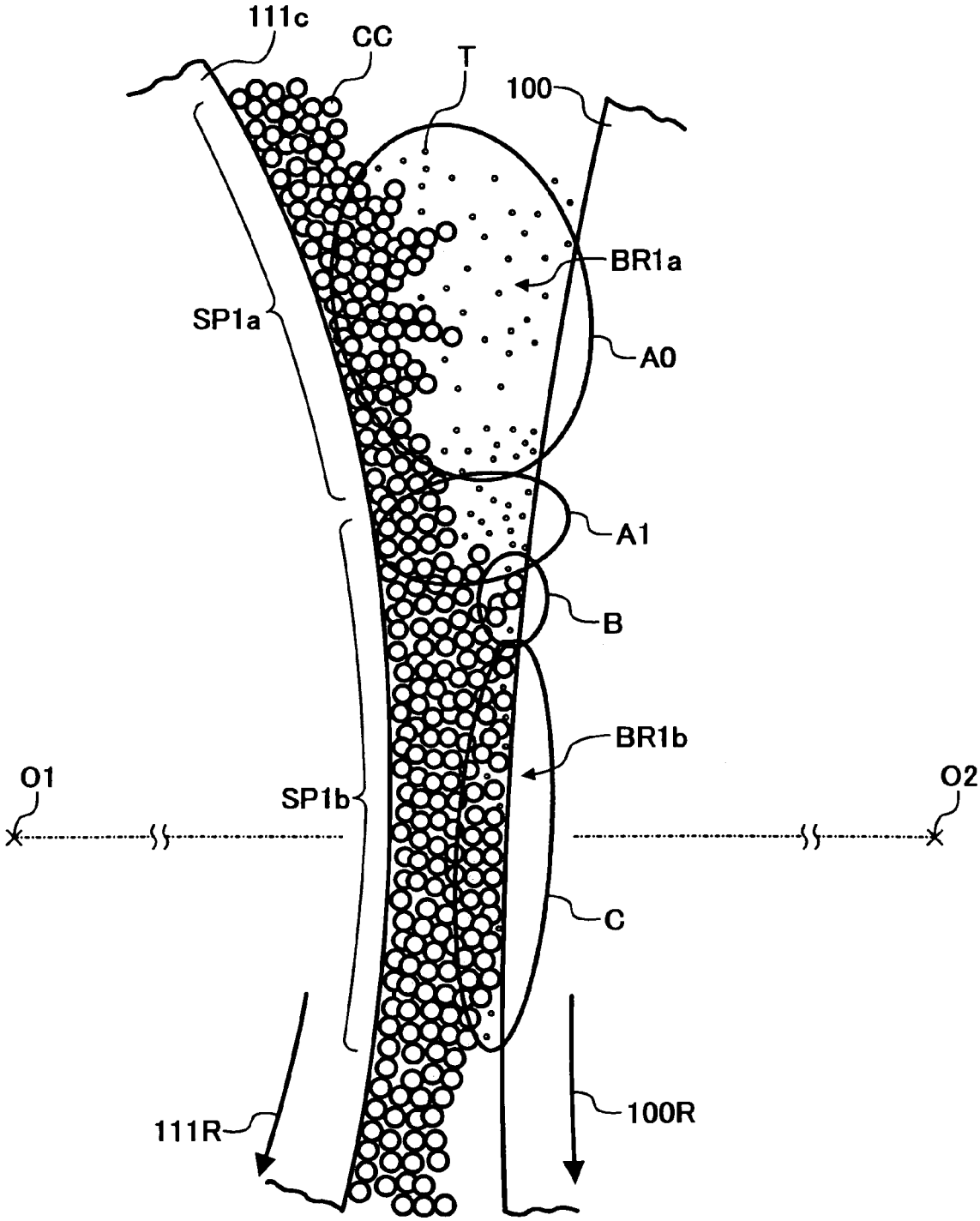
FIGS. 7 through 9 are schematic enlarged views showing portions where brush chains rise.

FIG. 7 shows the magnet brushes BR1*a* and BR1*b* formed in the developing zone and observed by eye in an enlarged view. As shown, a portion A0 in which brush chains rise and then fall exists at the most upstream position of the developing zone. In this portion A0, the magnetic force distribution P1*a* causes the carrier grains CC in the developer to start rising in the form of brush chains while holding the toner grains T thereon. Subsequently, the brush chains further rise along the magnetic lines of force and then fall down. In a portion A1 downstream of the portion A0, brush chains, expected to form the magnet brush BR1*b*, start rising in the same manner as the above brush chains. In a portion B downstream of the portion A1, the brush chains contact the drum 100. Further, in a portion C downstream of the portion B, the brush chains rub the surface of the drum 100.

In the condition shown in FIG. 7, the portion C corresponds to the closest position. In other conditions, when the gap GP increases to a certain degree, it may occur that the portions B and C are absent or that the positional relation between the portions A0 through C and the closest position varies. Further, the position or region where the brush chains contact the drum 100 are not constant because the length of the brush chains is not uniform, because the environment of the magnetic field is not constant and probably because the number of carrier grains differ from one brush chain to another.

Figure 8:
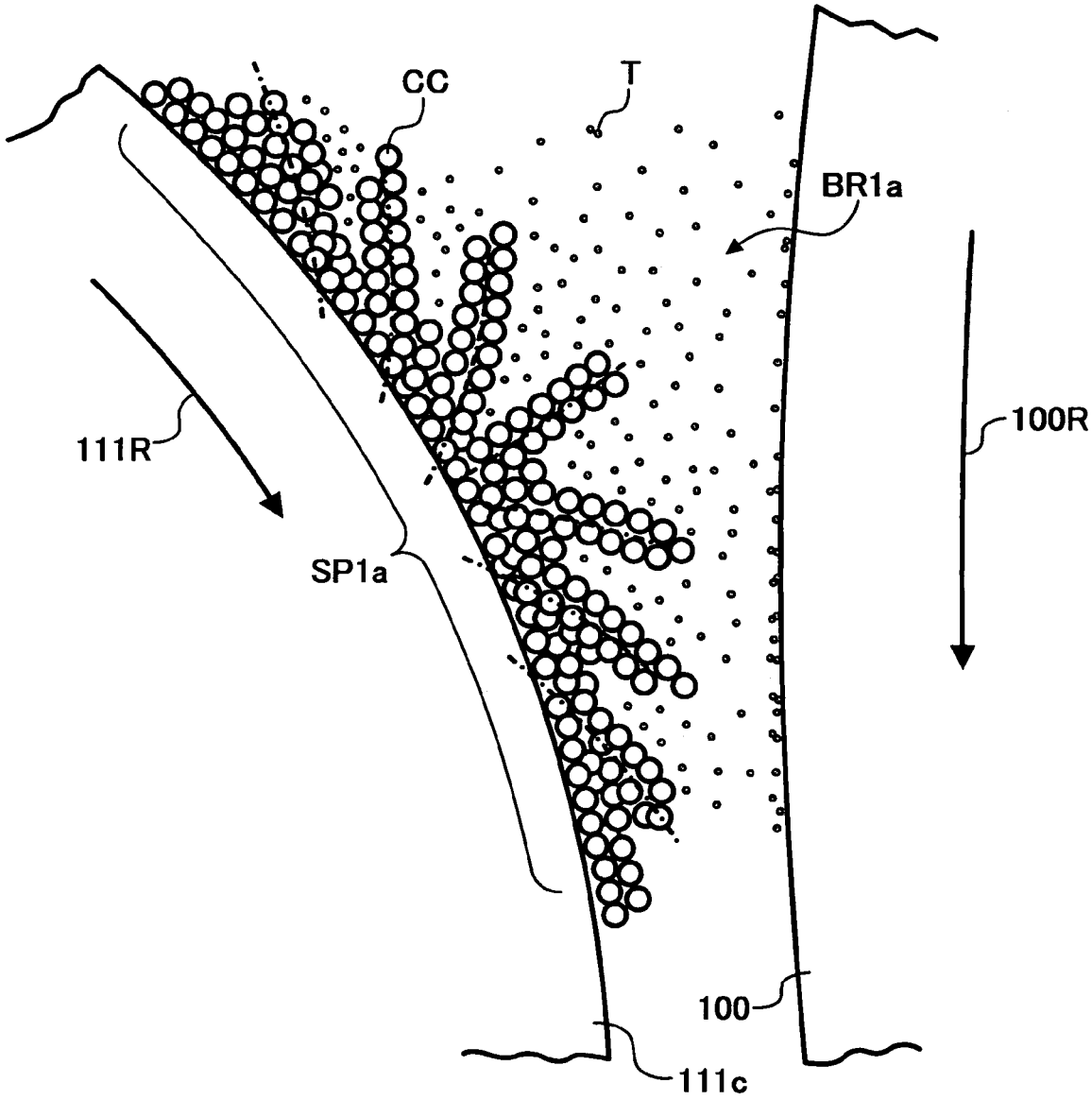

FIG. 8 shows the behavior of the carrier grains CC in the portion A0 more specifically. As shown, on the sleeve 111*c*, the carrier grains CC form the magnet brush BR1*a* at the position corresponding to the second magnet MG1*a* without regard to the polarity of the magnet MG1*a*. At the position between, e.g., the magnet MG6 and the magnet MG1*a* or between the magnet MG1*a* and the first magnet MB1*b* where the brush chains start rising, the developer layer is forced against the sleeve 111*c* because the tangential magnetic force is strong.

The carrier grains CC confined in the developer layer remain in the developer layer because the magnetic line of force between the magnets in the direction normal to the sleeve is weak, but the magnetic force tangential to the sleeve is strong because the magnets adjacent to each other are opposite in polarity to each other.

When the above developer layer arrives at the position corresponding to the magnet P1*a*, some carrier grains CC gather and rise in the form of a magnet brush. While the number of carrier grains CC so gather in the form of a brush chain is generally determined by the amount of developer to pass by the doctor blade 114, it is also determined by the magnetic property of the carrier grains CC as well as the size and inclination of the magnetic line of force, which are dependent on the magnetic force, shape and position of the magnet.

Although the magnet P1*a* is fixed in place, the angle and size of the magnetic line of force, as measured at the position where the brush chains start rising, varies because the sleeve 111*c* is in rotation. At this instant, the brush chain does not immediately rise along the magnetic line of force due to a delay in the magnetic response of the carrier grains CC. Further, although the brush chain, constituted by a number of carrier grains CC, rises by overcoming the restraint of the assembly, the polarities of all of the carrier grains CC are directed in the same direction under the action of the intense magnetic field of the magnet and therefore repulse each other. For these reasons, the developer layer suddenly splits with the result that the carrier grains CC rise in the form of a brush chain. Consequently, the toner grains T, confined in the assembly of the carrier grains, are made free. This, coupled with the strong centrifugal force acting on the toner grains T deposited on the carrier grains CC, releases the toner grains T from the carrier grains CC as free toner grains T.

Moreover, the brush chains do not rise or fall at constant speed, but have acceleration, because the magnetic field varies. At the continuous portion where the brush chains rise and then fall, the toner grains T part from the carrier grains CC due to inertia acting thereon and become free toner grains T. Such free toner grains T can easily move because they are free from electrostatic and physical adhesion forces between them and the carrier grains CC.

Figure 9:
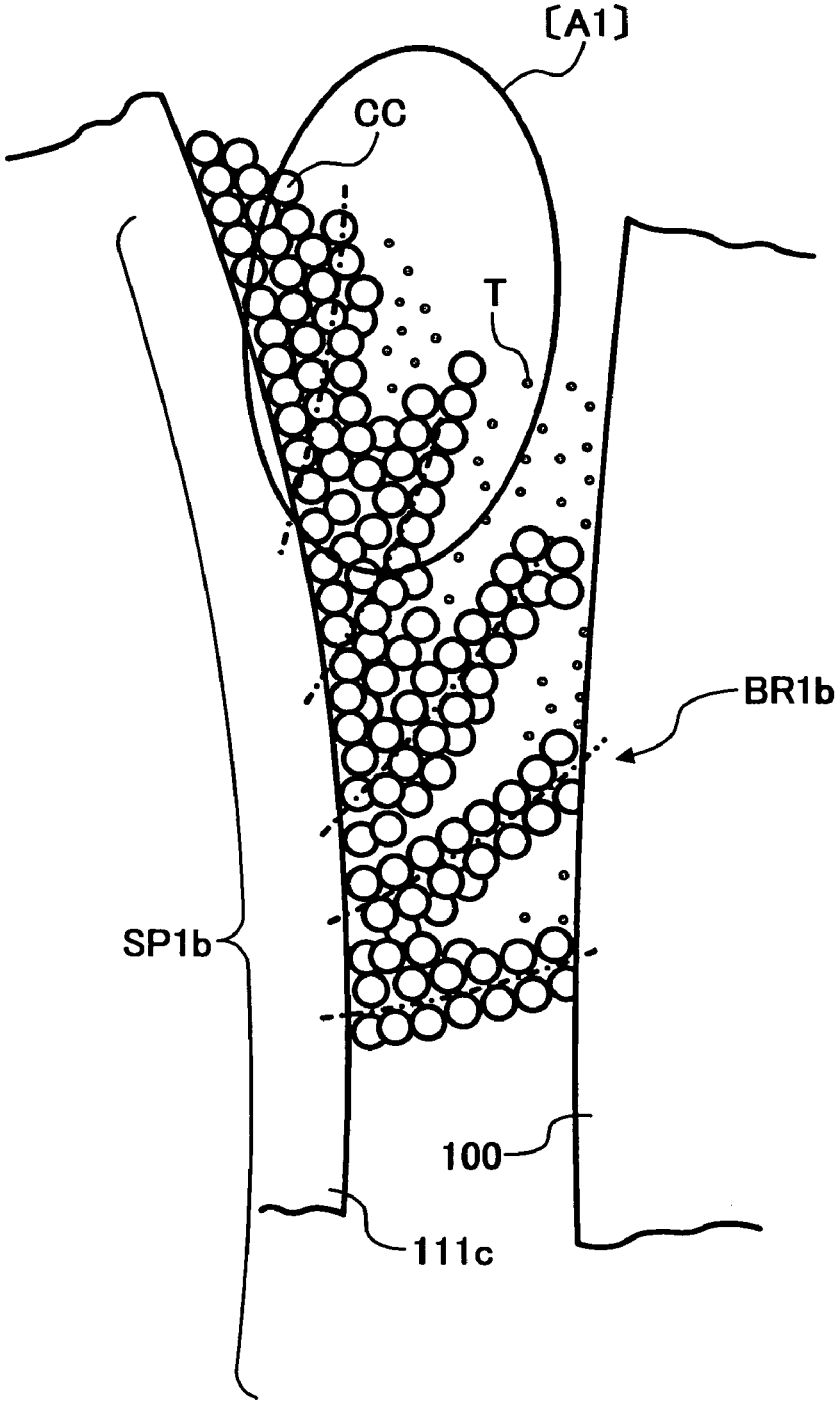

FIG. 9 demonstrates the behavior of the carrier grains CC in the portion A1. The free toner grains T can be produced if the force to act on the toner grains T deposited on the carrier grains CC is controlled on the basis of the grain size and other powder characteristics and the intensity of saturation magnetization and other magnetic characteristics of the carrier grains CC and the intensity of saturation magnetization and other magnetic characteristics and width, shape and other configuration characteristics of the magnet.

The free toner grains T appear when the brush chains start rising at the upstream side of the rising zone SP1B shown in FIG. 9. This increases the amount of toner grains T to deposit on the latent image Li for thereby implementing high image density. More specifically, in the portion A1, the free toner grains T, capable of depositing on the latent image Li even in a weak electric field, are achievable. I confirmed the behavior of the carrier grains CC and that of the toner grains T in the portions A0 and A1 described above with a microscope SZH10 (trade name) available from OLYMPUS OPTICAL CO., LTD. and a high-speed camera FASTCAM-Ultima-$I^2$ (trade name) available from Photron and a shooting speed of 9,000 frames to 40,500 frames per second. This is also true with the portions B and C to be described hereinafter.

In the portion B, the brush chains, constituting the magnet brush, strongly contact the drum 100. At this instant, the toner grains are released from the carrier grains as if they were splashed, and become free toner grains for development. As shown in FIG. 1, in the illustrative embodiment, the free toner grains are splashed from the carrier grains CC toward the drum 100.

The free toner grains are splashed at and around the closest position. The distance between the sleeve 111*c* and the drum is smallest at the closest position. On the other hand, because the center of the rising zone SP1*b* coincides with the closest position, the brush chains contact the drum 100 at the upstream side of the closest position for the first time, splashing the toner grains or free toner grains. The position where the brush chains so splash the toner grains may be slightly shifted from the closest position in relation to the gap for development, the height of the magnet brush and so forth. Further, the position where the brush chains rise is not constant because of the grain size distribution and magnetic characteristic distribution of the carrier grains. This is why the position where the free toner grains are splashed from the carrier grains is referred to as "at and around the closest position".

Figure 10:
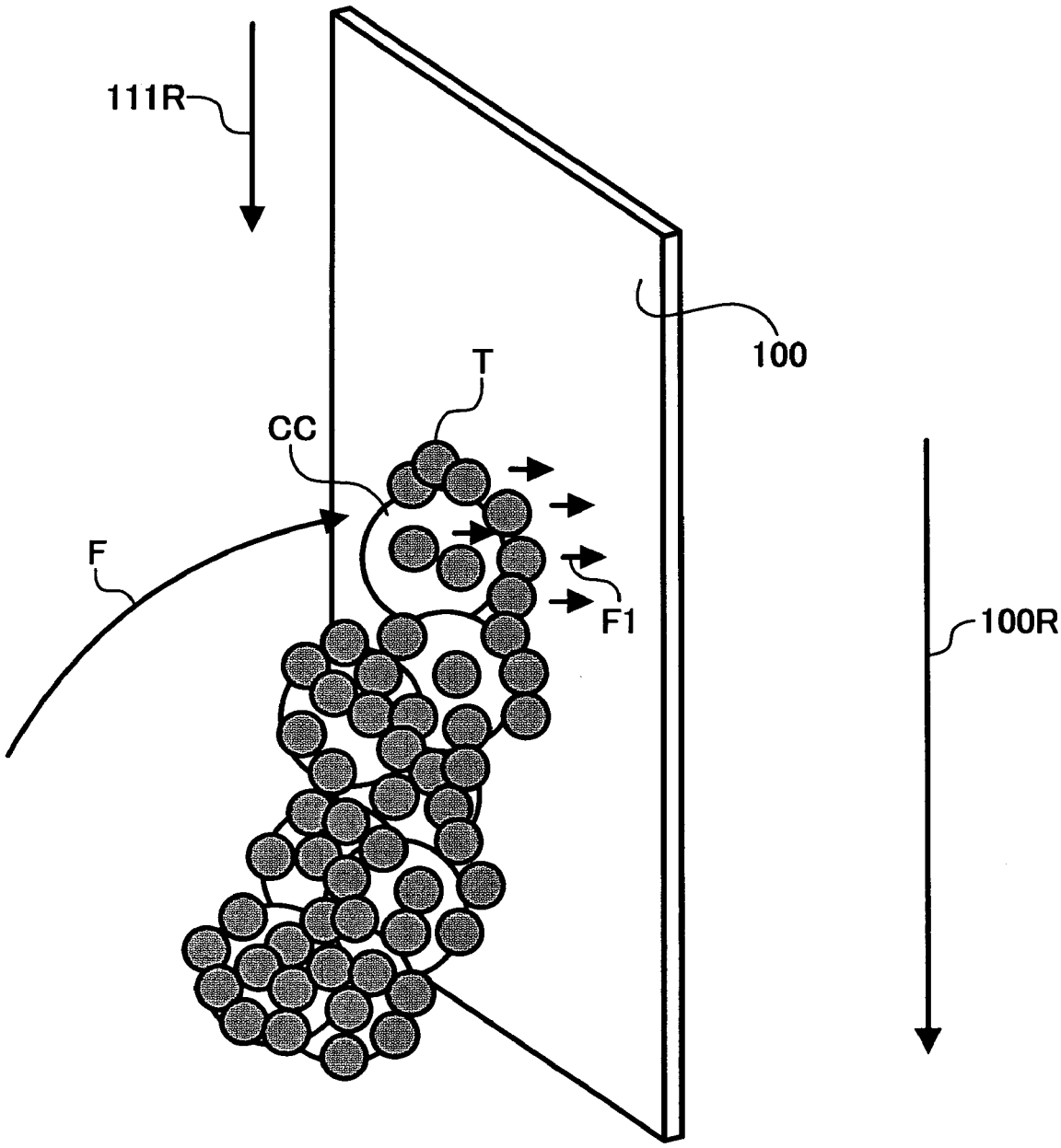
FIG. 10 is an isometric view showing how brush chains splash free toner grains on contacting a photoconductive drum.

The size and height of the brush chains, constituted by the carrier grains, are dependent on the powder characteristics and magnetic characteristics of the carrier grains and the magnetic characteristics and configuration characteristics of the magnet, as stated earlier. Therefore, as shown in FIG. 10, the brush chains on the sleeve 111*c* move at the same velocity as the sleeve 111*c* in the portion B except when they slip on the sleeve 111*c*. As a result, when the height of the brush chains is greater than the distance between the sleeve 111*c* and the drum 100, the tips of the brush chains strongly contact the drum 100 at velocity which is the combination of the velocity at which the tips of the brush chains rise along the magnetic lines of force of the magnet MG1*b* and the peripheral speed of the sleeve 111*c*.

Even if the brush chains fully rise before strongly contacting the drum 100, the brush chains strongly contact the drum 100 if their height is greater than the distance between the sleeve 111*c* and the drum 100 at the closest position. More specifically, such brush chains move toward the closest position in accordance with the distance with the above distance that decreases little by little and therefore strongly contact the drum 100 in a direction F at velocity produced by subtracting the peripheral speed of the drum 100 from that of the sleeve 111*c*. At this instant, the toner grains T part from the carrier grains CC due to an impact resulting from the contact as if they were splashed from the carrier grains.

The free toner grains produced by the mechanism stated above fly toward the drum 100 on the basis of inertia derived from a centrifugal force, the electric field of the latent image L1 and the electric field applied to the drum 100, as indicated by an arrow F1. In this manner, a large amount of free toner grains, released from the carrier grains as if splashed in the space extremely close to the drum 100, deposit on the latent image Li on the drum 100, insuring desirable development.

Further, in the portion B, the brush chains contacted the drum 100 cause toner grains present on the drum 100 to part from the drum 100 and again deposit on the carrier grains. Consequently, in the developing region upstream of the portion C, FIG. 7, the toner grains T deposited on a non-image portion or a low-potential image portion are removed from the drum 100, so that high image quality is achievable.

Figure 11:
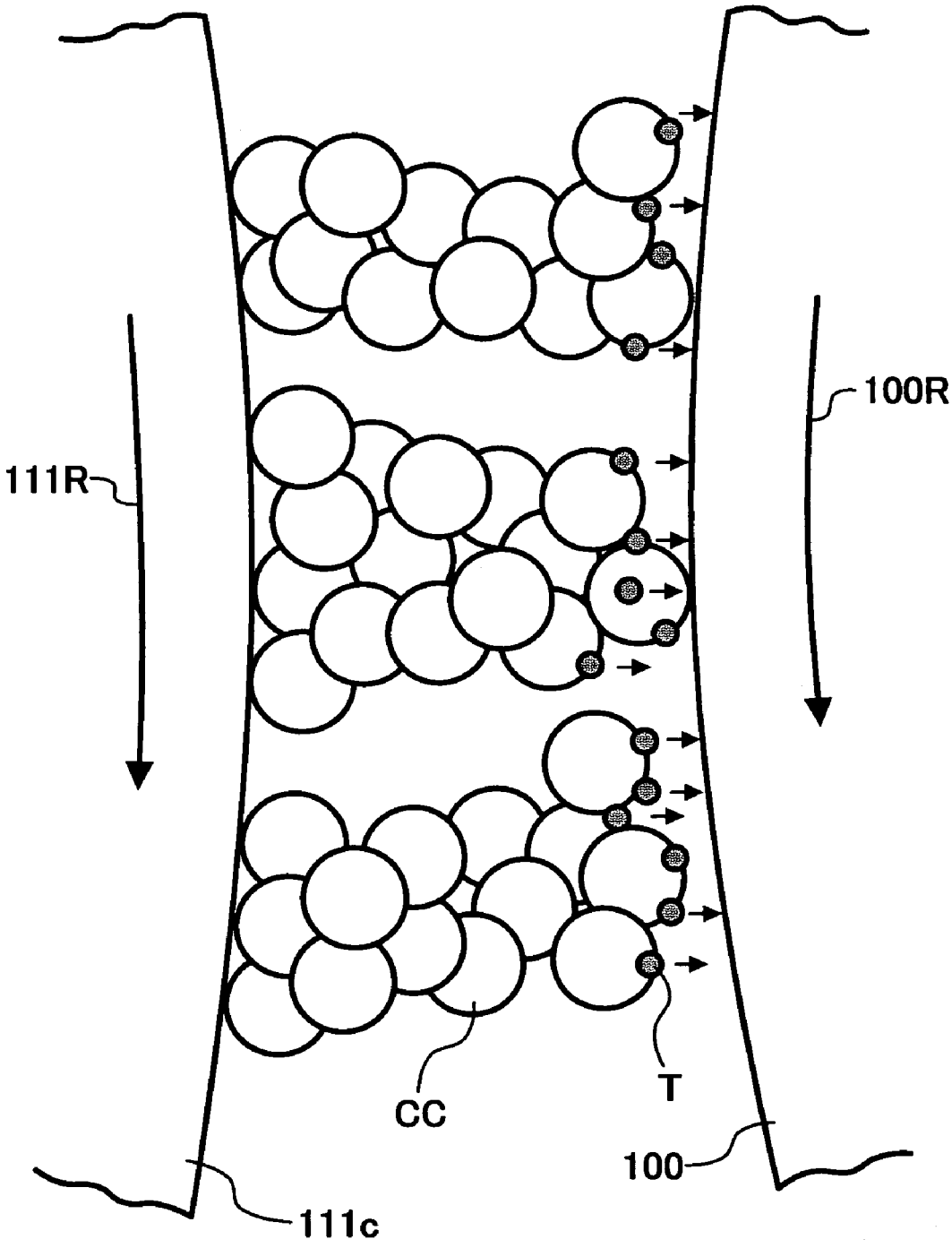
FIG. 11 is a schematic enlarged view showing how a brush chain rubs or adjoins the drum.

FIG. 11 shows development to occur in the portion C specifically. The power supply VP, FIG. 3, forms an electric field between the sleeve 111*c* and the drum 100 for depositing the toner grains T. In the illustrative embodiment the above electric field is strongest in the portion C coinciding with the closest position.

In the portion C, a brush chain risen in the rising zone SP1*b* is conveyed by the sleeve 111 while rubbing the drum 100. In this condition, the toner grains T part from the carrier grains CC under the action of the electric field between the sleeve 111*c* and the drum 100 and deposit on the latent image Li. At this instant, free toner grains, parted from but close to, the carrier grains presumably contain both of the toner grains that move toward the latent image Li due to the above electric field and toner grains that directly deposit on the latent image Li.

In the portion C, too, the brush chain, contacting the drum 100 at and around the closest position, causes toner grains present on the drum 100 to part from the drum 100 and a gain deposit on the carrier grains CC. This removes the toner grains undesirably deposited on the non-image portion or the low-potential image portion, insuring high image quality.

More specifically, in the portion C, the toner grains T on the carrier grains CC, having spaces open toward the drum 100, deposit on the latent image Li under the action of the electric field between the drum 100 and the sleeve 111 and the electric field between the drum 100 and the carrier grains CC. On the other hand, the carrier grains CC, released much toner grains T in the developing zone upstream of the portion C in the direction 111R and therefore excessively charged, move while rubbing the drum 100 and therefore overtake and strongly contact the toner grains T present on the drum 100. The resulting impact, coupled with an electrostatic Coulomb's force derived from opposite polarities, causes the above toner grains T to deposit on the carrier grains CC. Particularly, in the non-image portion of the drum 100 where the charge deposited by the charger 101 is low, much toners T can be removed.

It is to be noted that if the gap for development is adequately selected, then the brush chains, splashed the toner grains in the portion C, may not contact the drum 100, but may adjoin the drum 100.

Non-contact type development also available with the illustrative embodiment will be described hereinafter. Briefly, non-contact type development is available with free toners with the brush chains not contacting the drum 100 in the facing zone. This can be done by adequately balancing the gap GP for development, doctor gap, magnetic force of the magnet present in the facing zone, grain size and saturation magnetic moment of the carrier grains and so forth. Non-contact type development frees a halftone portion from granularity and renders horizontal thin lines and characters clear-cut.

Figure 12:
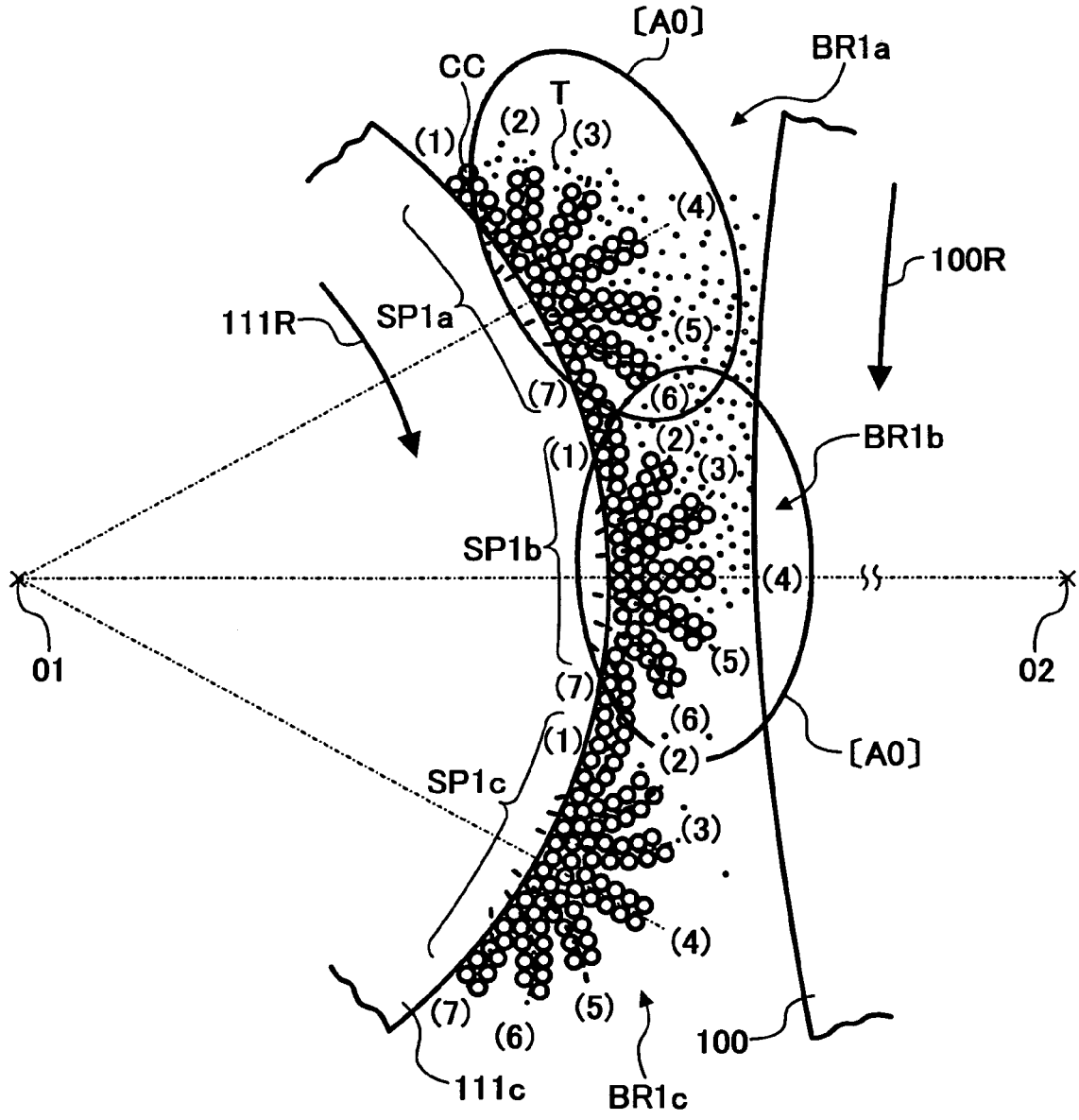
FIG. 12 shows a specific condition wherein brush chains move in the vicinity of the drum.

More specifically, as shown in FIG. 12, the sleeve 111*c* causes the developer to form a magnet brush in the developing zone while flowing. At this instant, the magnetic carriers CC, holding the toner grains T thereon, rise in the form of brush chains. Subsequently, before the brush chains fall down, the toner grains T are released from the carrier grains CC and deposit on the latent image Li. Also, the carrier grains CC, forming the brush chains, adjoin the drum 100 in the facing zone where the sleeve 111*c* and drum 100 face each other.

More specifically, the magnet brushes BR1*a* and BR1*b* each arrive at a portion [A0] corresponding to the portion A0, but do not contact the drum 100. In the portion [A0], the carrier grains CC rise in the form of brush chains. Before the brush chains fall down, the toner grains T are released from the carrier grains CC and become free toner grains T, as described with reference to FIGS. 5, 8 and 9 previously.

Further, while the magnet brush is being conveyed on the sleeve 111*c*, the tips of the magnet brush approach the drum 100 with the result that the toner grains T on the carrier grains CC part from the carrier grains CC and fly toward the latent image Li. While the magnet brush is being conveyed together with the sleeve 111*c*, the tips of the magnet brush do not remove the toner grains T deposited on the latent image Li even when approaching the drum 100. This prevents the amount of toner deposited on the latent image Li from decreasing and therefore preserves desirable image quality.

The linear velocity ratio Vs/Vp of the sleeve 111*c* to the drum 100 will be described more specifically hereinafter. In the illustrative embodiment, the linear velocity ratio Vs/Vp is selected to be greater than 0.9, but smaller than 4. Even if the linear velocity of the sleeve 111*c* is lower than the linear velocity of the drum 100, i.e., even if the ratio Vs/Vp is smaller than 1, much toner grains can deposit on the latent image Li because the toner grains T part from the carrier grains CC in a sufficient amount. By causing the sleeve 111 to rotate with the ratio Vs/Vp greater than 0.9, it is possible to increase the amount of toner grains T to deposit on the latent image Li for thereby increasing image density. The ratio Vs/Vp may be further reduced, depending on the amount of free toner grains T available.

Further, in the portion C shown in FIG. 7, when the magnet brush rubs or approaches the drum 100, the frequency of contact of the carrier grains with the drum 100 and therefore the amount of toner to part from the drum 100 increases. Particularly, when the ratio Vs/Vp is greater than 4, it is likely that the trailing edge of a halftone portion is lost or that a horizontal, thin line image is blurred.

Figure 13:
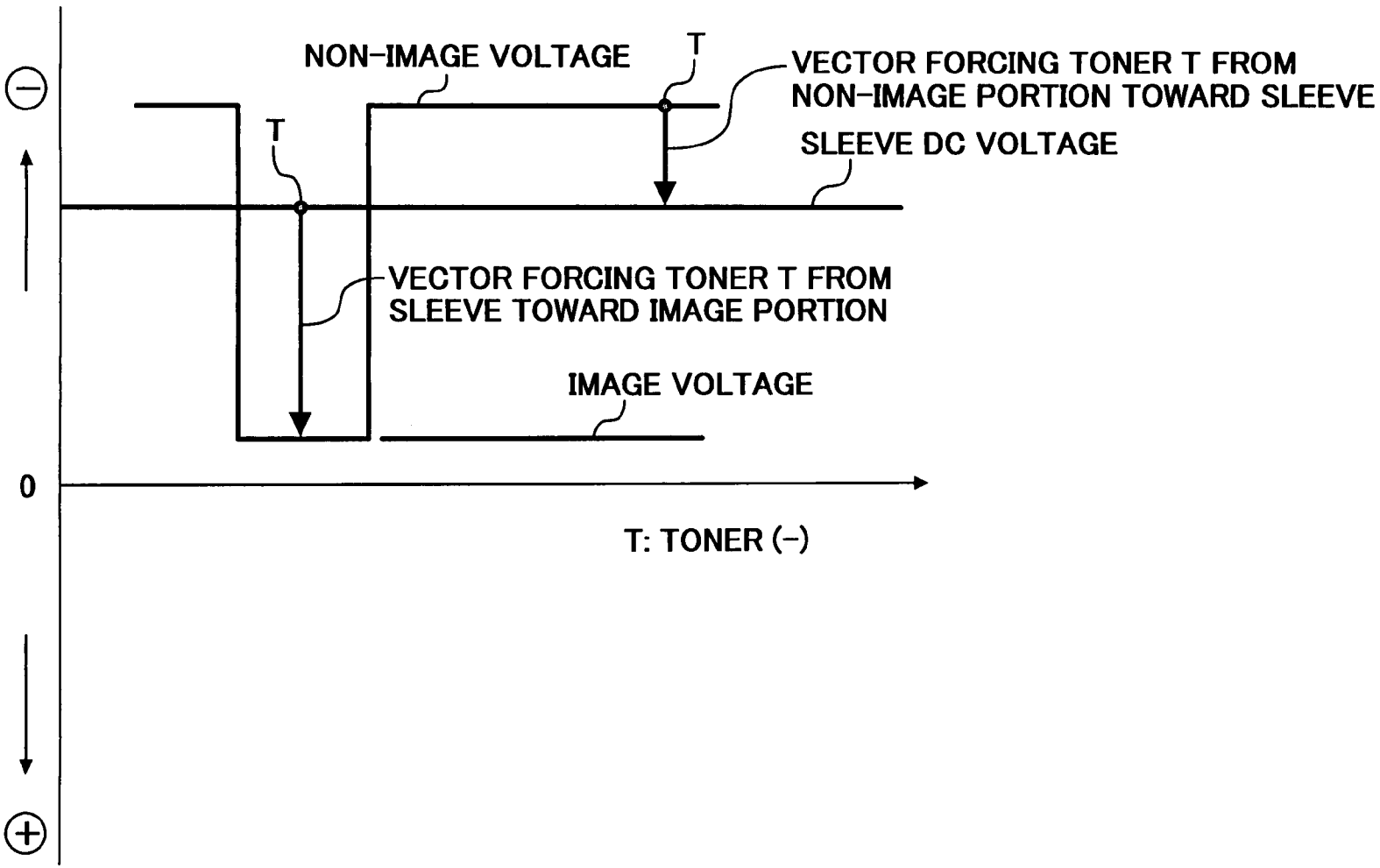
FIGS. 13 and 14 each show a particular electrostatic force to act on toner on the drum.

The bias for development will be described more specifically hereinafter. The free toner grains are caused to deposit on the latent image by the electric field formed between the sleeve 111*c* and the drum 100, as stated previously. FIG. 13 shows a specific developing condition wherein the power supply VP, FIG. 3, is implemented as a DC power supply that forms a DC electric field in the negative-to-positive developing system. The drum 100, using an organic pigment as a carrier generating material, is generally charged to negative polarity and has a latent image formed thereon by toner of negative polarity. This also applies to the illustrative embodiment although the polarity of charge to deposit on the drum 100 is not questionable.

When the laser beam Lb is used for writing an image, it exposes character portions in order to reduce the amount of writing. In this case, the charge in the exposed portions are neutralized by holes generated by the carrier generating material, so that the potential of the image portions or character portions is lowered, as shown in FIG. 13. The power supply VP, connected to the sleeve 111*c*, applies a DC voltage biased to the negative size to the above image portions. As a result, a vector, extending toward the sleeve 111*c* or the image portions, acts on the free toner grains of negative polarity and the toner grains deposited on the carrier grains CC both of which are labeled T in FIGS. 13 and 14.

In FIG. 13, even if toner grains are present in the non-image portions of the drum 100, the vector, directed from the non-image portions toward the sleeve 111*c*, causes such toner grains to surely part from the non-image portions, thereby obviating background contamination.

Figure 14:
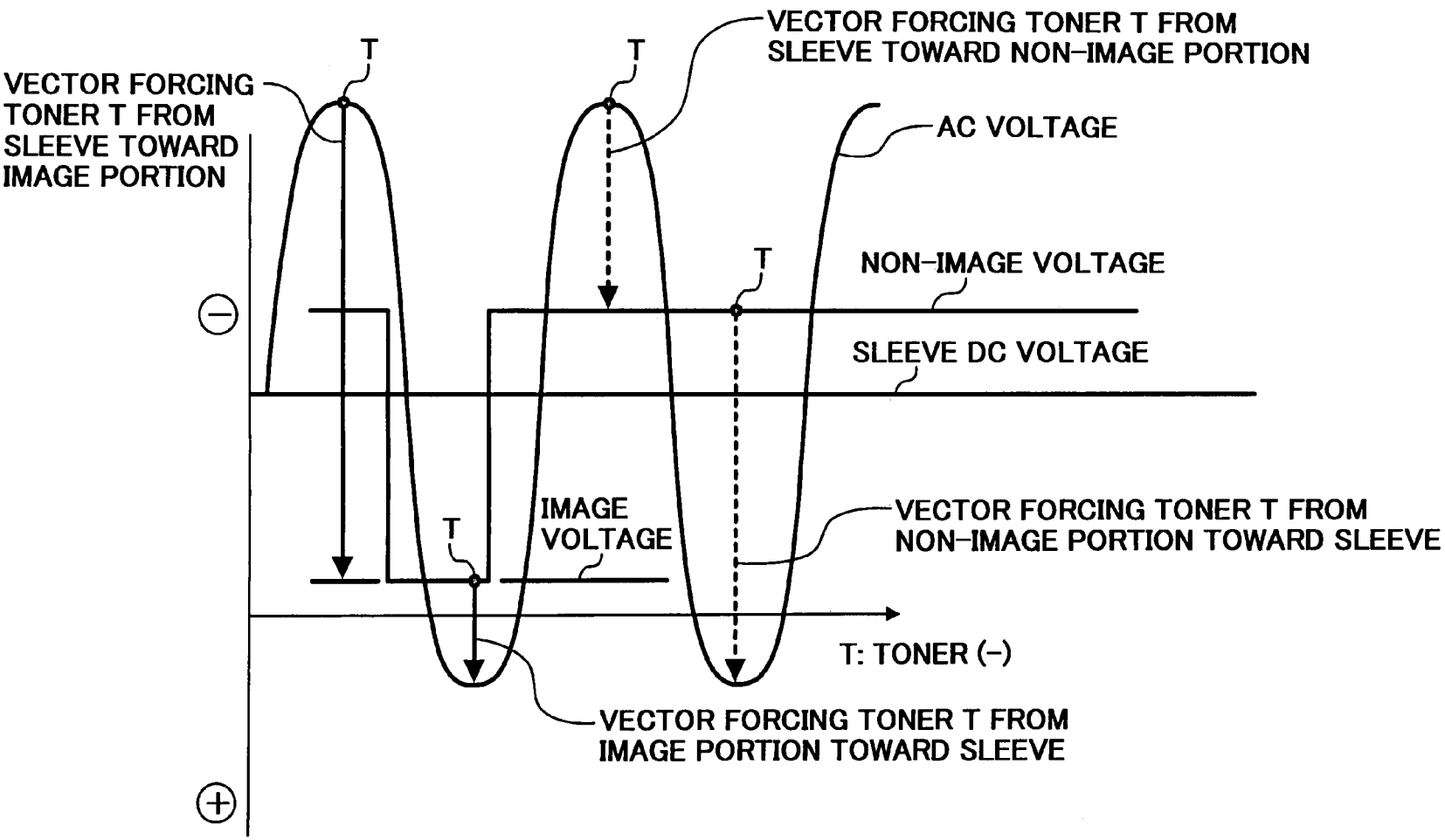

FIG. 14 shows another specific developing condition in which the power supply VP is implemented as an AC power supply, more specifically a power supply outputting a DC voltage and an AC voltage superposed on each other, that forms an alternating electric field in the negative-to-positive developing system. The alternating electric field, formed between the drum 100 and the sleeve 111*c*, is desirable for the development of the illustrative embodiment.

In FIG. 14, the electric field, formed between the sleeve 111*c* and the drum 100, causes the toner grains T of, e.g., negative polarity, to deposit on the latent image like the DC electric field stated previously. Again, because the carrier grains CC on the sleeve 111*c* are dielectric, the electric field is further intensified on the drum 100 and brush chains and causes the toner grains T to part from the carrier grains CC and deposit on the latent image Li. Further, the alternating electric field causes the toner grains T on the drum 100 to oscillate and faithfully develop the latent image Li. Also, when the tips of the brush chains adjoin the drum 100, the electric field is intensified by the carrier grains CC and causes the toner grains T to oscillated more actively, thereby further enhancing faithful development.

More specifically, in the image portion, the alternating electric field biased to negative polarity allows the free toner grains T to surely deposit on the image portion under the action of the great and small vectors directed toward the image portion. Also, toner grains, if present on the non-image portion, are surely removed from the non-image portion under the action of vectors directed toward the sleeve 111*c*, so that background contamination is surely obviated.

The strength of the electric field formed in the facing zone will be described more specifically hereinafter. By using the microscope and high-speed camera mentioned earlier, I observed the flight of toner grains in the portion A0 by using a mean amount of charge A (μC/kg) deposited on toner, a toner content $T_c$ (wt %), a mean toner grain size d (μm), a mean carrier grain size D (μm), a developer carrier diameter R (mm) and a developer carrier linear velocity $V_{SL}$ (mm/sec) as parameters. As FIG. 15 indicates, for toner grains to fly from carrier grains for development, the electric field strength E must satisfy the following relation:

$$E \geqq (A \cdot \rho T \cdot d \cdot R)/(3B^{1/2} \cdot \epsilon 0 \cdot V_{SL}) \quad (1)$$

where B is equal to $T_c \cdot D^3 \cdot \rho_c/(100-T_c) \cdot d^3 \cdot \rho_T$, $\rho_T$ denotes the specific gravity of toner grains (kg/cm$^3$), $\rho_c$ denotes the specific gravity of carrier grains (kg/m$^3$), and $\epsilon_o$ is equal to $8.854 \times 10^{-12}$ (F/m).

Experimental results listed in FIG. 15 were obtained under the following conditions. $\rho_T$ and $\rho_c$ were selected to be 1,250 and 5,000 respectively. The shortest distance between the flight position P and the developer carrier, corresponding to the sleeve 111*c*, was L (mm). An alternating electric field, having a DC component of −500 V on which a rectangular wave with a peak-to-peak AC component Vp-p of 800 V and frequency of 4.5 kH was superposed as an AC component, was applied to the developer carrier, which corresponds to the sleeve 111*c*. The potential deposited on the image portion of the image carrier, corresponding to the drum 100, was −100 V. The flight of toner grains was shot at the velocity of 18,000 frames per second.

In FIG. 15, a circle, a cross and a combined circle and cross respectively indicate that toner grains flew, that toner grains did not flew at all, and that toner grains flew although in a small amount. Such differences are presumably ascribable to the distribution of the amount of charge deposited on toner grains. Sets of conditions with circles shown in FIG. 15 satisfy the relation (1).

The relation (1) is derived from the result of the following analysis. Because the relation (1) is the condition necessary for toner grains to fly, it is necessary to satisfy, when consideration is given to motion, the following equation defining an electric field representative of a threshold causing flight from carrier grains to occur:

$$E = \frac{A \cdot \rho_r \cdot d \cdot R}{3 \times \sqrt{\frac{T_c \cdot D^3 \cdot \rho_c}{(100 - T_c) \cdot d^3 \cdot \rho_T} \cdot \varepsilon_0 \cdot v_{SL}}} \quad (2)$$

When the van der waals force is neglected, toner grains deposited on carrier grains are subject to an adhesion force $F_t$ between the toner grains and the carrier grains:

$$F_t = \alpha \frac{q^2}{4\pi\varepsilon_0 d^2} \quad (3)$$

where α denotes a constant, $\epsilon_o$ is equal to $8.854 \times 10^{-12}$ F/m, and q denotes the amount of toner deposited on toner grains.

When the force of the electric field overcomes the adhesion force $F_t$, toner grains part from the carrier grains. The electric field E of that instant is expressed as:

$$E = \frac{F_t}{q} = \alpha \frac{q}{4\pi\varepsilon_0 d^2} \tag{4}$$

The factor q included in the equation (4) is produced by:

$$q = A\frac{4}{3}\pi\left(\frac{d}{2}\right)^3 \rho_\tau \tag{5}$$

where A denotes the mean amount of charge deposited on toner grains.

Therefore, the electric field E is expressed as:

$$E = \frac{F_t}{q} = \alpha \frac{q}{4\pi\varepsilon_0 d^2} = \alpha \frac{Ad\rho\tau}{24\varepsilon_0} \tag{6}$$

It was experimentally found that the constant α could be expressed as:

$$\alpha = \frac{8R}{\sqrt{n \cdot v_{SL}}} \tag{7}$$

where n denotes the number of toner grains deposited on a single carrier grain. Assuming that toner grains are evenly deposited on carrier grains, then the number of toner grains n in the toner content $T_c$ is derived from the weight ratio as:

$$n = \frac{T_c}{100 - T_c} \cdot \frac{M}{m} = \frac{T_c}{100 - T_c} \cdot \frac{\frac{4}{3}\pi\left(\frac{D}{2}\right)^3 \rho_c}{\frac{4}{3}\pi\left(\frac{d}{2}\right)^3 \rho_c} = \frac{T_c}{100 - T_c} \cdot \frac{D^3 \rho_c}{d^3 \rho_\tau} \tag{8}$$

where m denotes the mass of toner grains, d denotes a toner grain size, $\rho_T$ denotes the specific gravity of toner grains, M denotes the mass of the carrier grains, D denotes a carrier grain size, $\rho_c$ denotes the specific gravity of carrier grains, R denotes the diameter of the developer carrier, and $V_{SL}$ denotes the linear velocity of the developer carrier.

By substituting α, n and so forth of the equations (7) and (8) for the equation (6), there is obtained the equation (2). Because the equation (2) indicates the threshold of the electric field that causes toner grains to fly from carrier grains, the equation (2) derives the relation (1).

Although the equations (7) and (8) are not physically accounted for, they presumably suggest the following:

R: An increase in the diameter of the developer carrier translates into an increase in the radius of curvature and therefore makes the rise of brush chains smooth while weakening a mechanical force. As a result, a stronger electric field is required;

$V_{SL}$: The electric field that causes toner grains to fly from carrier grains is lowered; and n: Generally, the amount of charge q decreases with an increase in $T_c$ with the result that the influence of a mechanical force increases, causing toner grains to fly from carrier grains in a weaker electric field. Also, even when q does not vary despite the variation of $T_c$, the influence of counter charge to remain on carrier grains on the flight of a single carrier grain decreases with an increase in n, so that a weaker electric field allows toner grains to fly.

Figure 16:
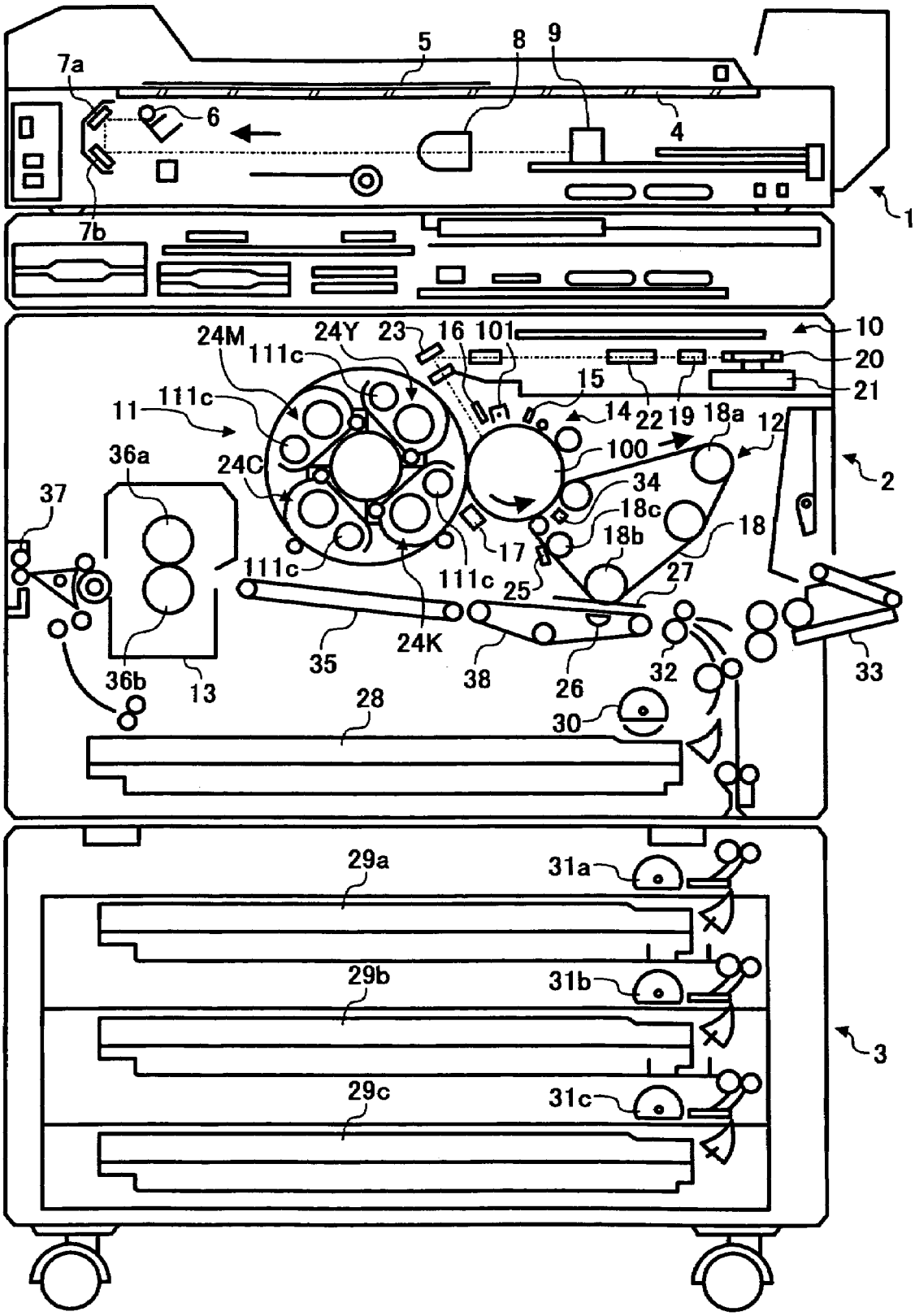
FIG. 16 is a view showing the general construction of an image forming apparatus to which the illustrative embodiment is applied.

Reference will be made to FIG. 16 for describing an image forming apparatus effecting any one of the various developing methods described above and implemented as a color copier by way of example. The color copier includes a developing device also provided with the basic configuration described with reference to FIGS. 1 through 4. As shown, the color copier is generally made up of a color scanner or image reading device 1, a color printer or image recording device 2, and a sheet bank 3. The color copier additionally includes a controller not shown.

The color scanner 1 illuminates a document 5 laid on a glass platen 4 with a lamp 6 and focuses the resulting imagewise reflection on a color sensor 9 via mirrors 7*a* and 7*b* and a lens 8. The color sensor 9 converts the incident light to, e.g., R (red), G (green) and B (blue) image signals. In the illustrative embodiment, the color sensor 9 includes R, G and G color separating means and CCDs or similar photoelectric transducers. A signal processor, not shown, transforms the R, G and B image signals to Bk (black), C (cyan), M (magenta) and Bk (black) image data in accordance with the signal level.

More specifically, in response to a scanner start signal synchronous to the operation of the color printer 2, optics, including the lamp 6 and mirrors 7*a* and 7*b*, scans the document 5 to the left, as viewed in FIG. 16, so that color image data of a single color are generated. As the optics repeats such scanning four consecutive times, color image data of four different colors are sequentially generated. The color printer 2 forms a toner image in accordance with each color image data and overlaps the resulting four toner images for thereby completing a four-color or full-color image.

The color printer 2 includes a tubular photoconductive drum 100, a writing unit 10, a revolver type developing unit (simply developer hereinafter) 11, an intermediate image transferring unit 12, and a fixing unit 13. The drum 100 is rotated clockwise, as indicated by an arrow in FIG. 16. Arranged around the drum 100 are a drum cleaner 14, a quenching lamp 15, a charger 101, a potential sensor or charge potential sensing means 16, one of developing sections 24 constituting the revolver 11, a density pattern sensor 17, and a belt 18 included in the intermediate image transferring unit 12. The developing section mentioned above corresponds to the developing device 110 described with reference to FIGS. 1 through 4.

The writing unit 10 transforms each color image data received from the color scanner 1 to an optical signal and forms latent image on the drum 100 with the optical signal. The writing unit 10 includes a semiconductor laser or light source 19, a laser driver, not shown, a polygonal mirror 20, a motor 21 for driving the polygonal mirror 20, an fθ lens 22, and a mirror 23.

The revolver 11 includes a Bk, a C, an M and a Y developing section 24K, 24C, 24M and 24Y, respectively, and a driveline for causing the developing sections 24K through 24Y to rotate counterclockwise, as indicated by an arrow in FIG. 16. In each developing section, the sleeve 111*c* conveys the developer deposited thereto to the facing zone where the sleeve 111*c* and drum 100 face each other, as stated earlier. In the facing region, toner grains are transferred from the sleeve 111 to the latent image formed on the drum 100 under the action of an electric field formed between the sleeve 111*c* and the drum 200.

Toner grains in each developing section 24 are charged to negative polarity by friction acting between them and carrier grains formed of ferrite. The power supply, FIG. 3 applies a bias for development in which an AC voltage is superposed on a negative DC voltage by way of example to the sleeve 111*c*. As a result the sleeve 111*c* is biased to a preselected potential relative to the conductive core 31, FIG. 3, of the drum 100. The electric field that satisfies the relation (1) may be implemented by the power supply VP.

When the copier body is in a stand-by state, the Bk developing unit 24K of the revolver 11 is located at a developing position where it faces the drum 100. On the start of a copying operation, the color scanner 1 starts reading Bk color image data at preselected timing. Optical writing and the formation of a latent image also start in accordance with the Bk color image data. Let the latent image based on the Bk image data be referred to as a Bk latent image. This is also true with C, M and Y.

Before the leading edge of the Bk latent image arrives at the developing position, the Bk sleeve 111*c* starts rotating so as to develop the Bk latent image with Bk toner. After the trailing edge of the Bk latent image has moved away from the developing position, the revolver 11 is rotated to bring the next developing section to the developing position. This rotation is completed at least before the leading edge of a latent image based on the next image data arrives at the developing position. The revolver 11 will be described more specifically later.

The intermediate image transferring unit 12 includes a belt cleaner 25, a belt conveyor 38 and a corona discharger (sheet discharger hereinafter) 26 in addition to the belt 18 mentioned earlier. The belt 18 is passed over a drive roller 18*a*, a backup roller 18*b* for image transfer, a backup roller 18*c* for cleaning and a group of driven rollers and is caused to turn by a drive motor not shown.

The belt 18 is formed of PTFE (polytetrafluoroethylene) and provided with electric resistance of $10^8$ $\Omega\cdot cm^2$ to $10^{10}$ $\Omega\cdot cm^2$ in terms of surface resistance. The belt cleaner 25 includes an inlet seal, a rubber blade, a coil, an inlet seal and a mechanism for moving the rubber blade although not shown specifically. During the transfer of the toner images of the second, third and fourth colors following the transfer of the toner image of the first color or Bk, the moving means continuously releases the inlet seal and blade from the belt 18. The sheet discharger 26 applies an AC-biased DC voltage or a DC voltage to a sheet by corona discharge, thereby transferring the full-color toner image from the belt 18 to the sheet.

A sheet cassette 28, accommodated in the color printer 2, and sheet cassettes 300*a*, 300*b* and 300*c*, accommodated in the sheet back 3, each are loaded with a stack of sheets of particular size. A sheet is fed from designated one of such sheet cassettes toward a registration roller pair 30 by one of pickup rollers 30, 31*a*, 31*b* and 31*c* associated with the sheet cassette designated. A manual sheet feed tray 33 is mounted on the right side of the printer 2, as viewed in FIG. 16, so that OHP (OverHead Projector) films, thick sheets or similar special sheets can be fed, as desired.

In operation, the drum 100 is rotated counterclockwise while the belt 18 is caused to turn clockwise. A Bk, a C, an M and a Y toner image are formed and sequentially transferred to the belt 18 one above the other.

More specifically, to form the Bk toner image, the charger 101 uniformly charges the surface of the drum 100 to negative polarity. The semiconductor laser 19 scans the charged surface of the drum 100 by raster scanning in accordance with Bk color image data, thereby forming a Bk latent image. The Bk sleeve deposits Bk toner on the Bk latent image to thereby form a corresponding Bk toner image. The Bk toner image is then transferred from the drum 100 to the belt 18, which is moving at the same speed as the drum 100, by an image transferring device 34. The transfer of a toner image from the drum 100 to the belt 18 will be referred to as belt transfer hereinafter.

Some toner left on the drum 100 after the belt transfer is removed by the drum cleaner 14 and then delivered to a waste toner tank, not shown, via a piping.

Subsequently, to form a C toner image, the color scanner 1 starts reading C image data at preselected timing. A C latent image is formed on the drum 100 in accordance with the C image data. After the trailing edge of the Bk latent image has moved away from the developing position, but before the leading edge of the C latent image arrives at the developing position, the revolver 11 is rotated to bring the C developing section 24C to the developing position. In this condition, the C developing section 24C develops the C latent image with C toner.

After the trailing edge of the C latent image has moved away from the developing position, the revolver 11 is again rotated to locate the M developing section 24M at the developing position. This is also completed before the leading edge of an M latent image arrives at the developing position. As for an M and a Y toner image, the procedure described in relation to the BK and C toner images is also repeated.

The Bk, C, M and Y toner images sequentially formed on the drum 100 are sequentially transferred to the belt 18 in register, completing a full-color toner image. The full-color toner image is then transferred to a sheet 27, as stated earlier.

More specifically, the sheet 27 fed from any one of the sheet cassettes and manual sheet feed tray is stopped by the nip of the registration roller pair 32. The registration roller pair 32 starts conveying the sheet 27 at such timing that the leading edge of the sheet 27 meets the leading edge of the toner image carried on the belt 18 at an image transferring device 26.

When the sheet 27 and the toner image of the belt 18 superposed on each other pass the image transferring device charged to positive polarity, the image transferring device 26 transfers substantially the entire toner image from the belt 18 to the sheet 27 by applying a positive charge. Subsequently, a discharge, positioned at the left-hand side of the image transferring device 26, discharges the sheet 27 by AC-biased DC corona discharge for thereby separating the sheet 27 from the belt 18. The sheet 27 is then handed over to the belt conveyor 35.

The belt conveyor 35 conveys the sheet 27 to a fixing unit 36 including a heat roller 36*a* and a press roller 36*b* pressed against the heat roller 36*a*. The heat roller 36*a* and heat roller 36*b* fix the toner image on the sheet 27 while conveying the sheet. The sheet or print 27 is then driven out to the copier body by an outlet roller pair 37 and stacked face up on a copy tray, not shown.

After the belt transfer, the drum cleaner 14, including a brush roller and a rubber blade, cleans the surface of the drum 100. Subsequently, the quenching lamp 15 discharges the surface of the drum 100. On the other hand, after the transfer of the toner image from the belt 18 to the sheet 27, the moving means again presses the blade of the belt cleaner 25 against the belt 18 for thereby cleaning the belt 18.

In a repeat copy mode, the second Bk toner image is formed after the first Y toner image. The repeat copy mode will not be described specifically in order to avoid redundancy. In a tricolor or a bicolor copy mode, the procedure described above will be repeated a number of times corresponding to the desired number of colors and the desired number of prints. Further, in a black-and-white or monochromatic mode, only one developing section of the revolver 11 is held operative until a desired number of prints have been produced. In this case, the blade of the belt cleaner 25 is continuously held in contact with the belt 18.

As stated above, in the illustrative embodiment, the developing device develops a latent image with free toner grains in an electric field whose strength satisfies the relation (1), thereby setting a developing zone in a broad range and increasing the amount of toner grains to contribute to development. This broadens, e.g., the allowable range of the gap for development and that of sleeve rotation speed and provides a solid portion and horizontal line lines with high quality. Particularly, a halftone portion included in a color image can be faithfully reproduced.

Figure 17:
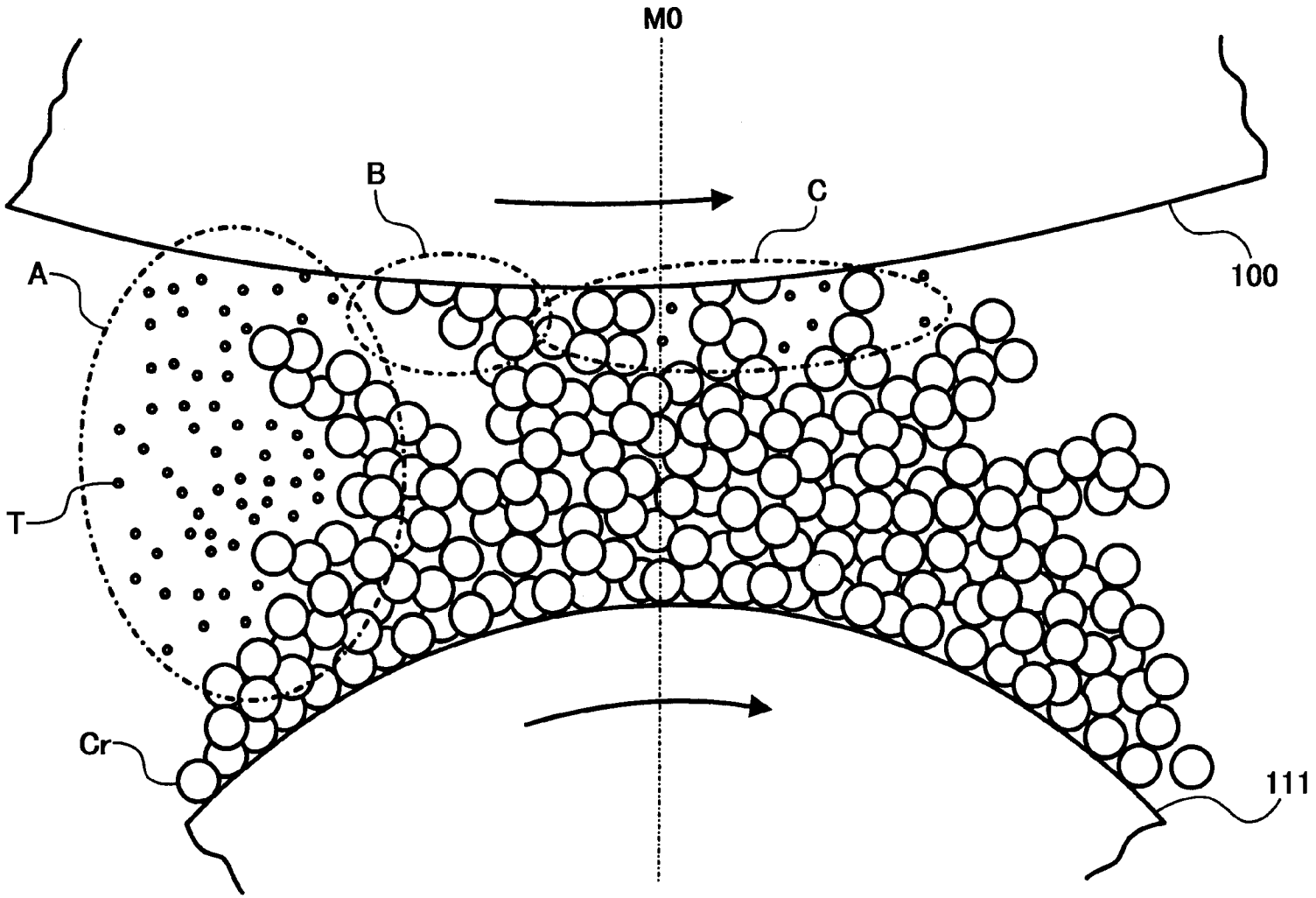
FIG. 17 is a schematic view showing the condition of a developer in a developing zone in accordance with an alternative embodiment of the present invention.

An alternative embodiment of the present invention, mainly directed toward the second object stated earlier, will be described hereinafter. The illustrative embodiment forms in the developing zone a magnet brush containing the brush chains of carrier grains Cr, which hold toner grains T thereon, and free toner grains T parted from the carrier grains Cr. FIG. 17 shows the condition of the developer in the developing zone particular to the illustrative embodiment.

It is to be noted that the developing zone refers to a zone where the toner grains T in the developer move toward the drum 100 having curvature without regard to whether the carrier grains Cr are forming brush chains or forming a thin developer layer on a sleeve 111. As shown in FIG. 17, the developing zone may be subdivided into an upstream portion A, an intermediate portion B and a downstream portion C.

Figure 18:
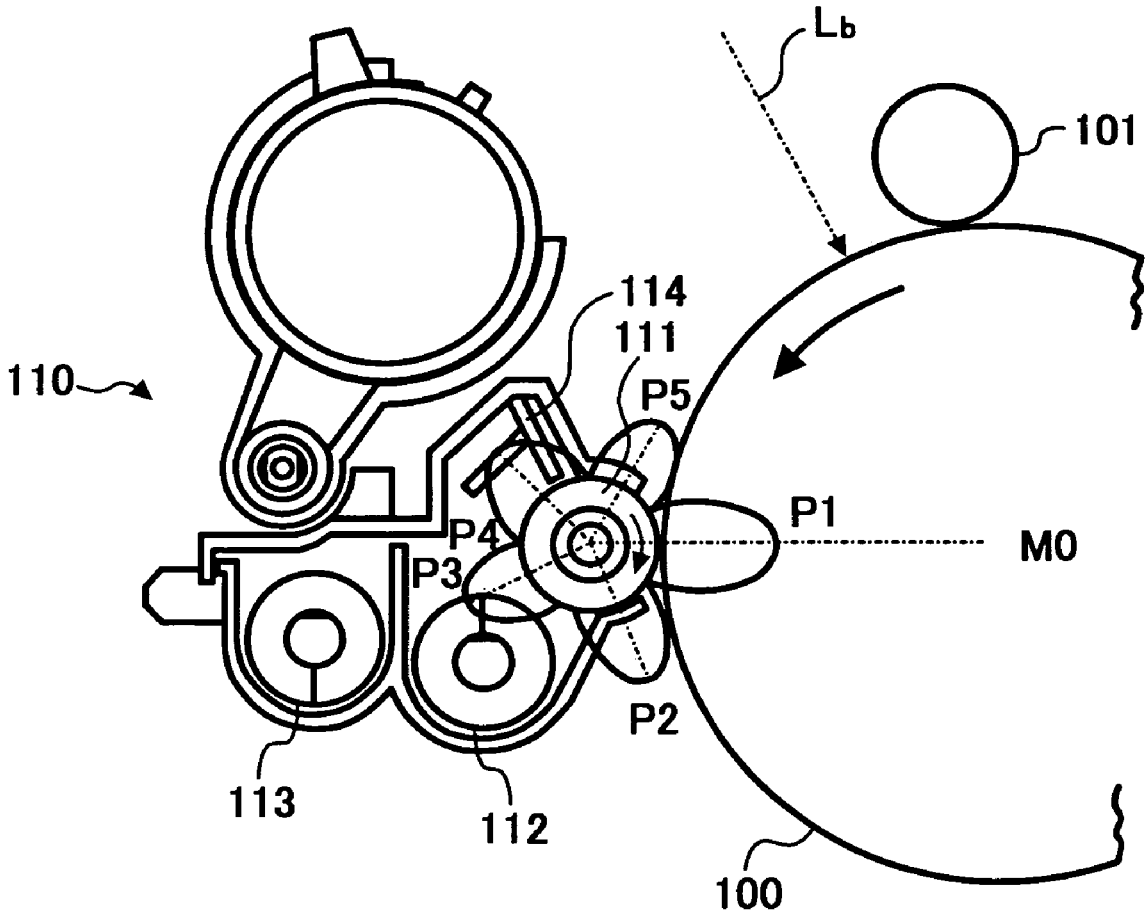
FIG. 18 shows a specific configuration of a developing device representative of the alternative embodiment.
Figure 19:
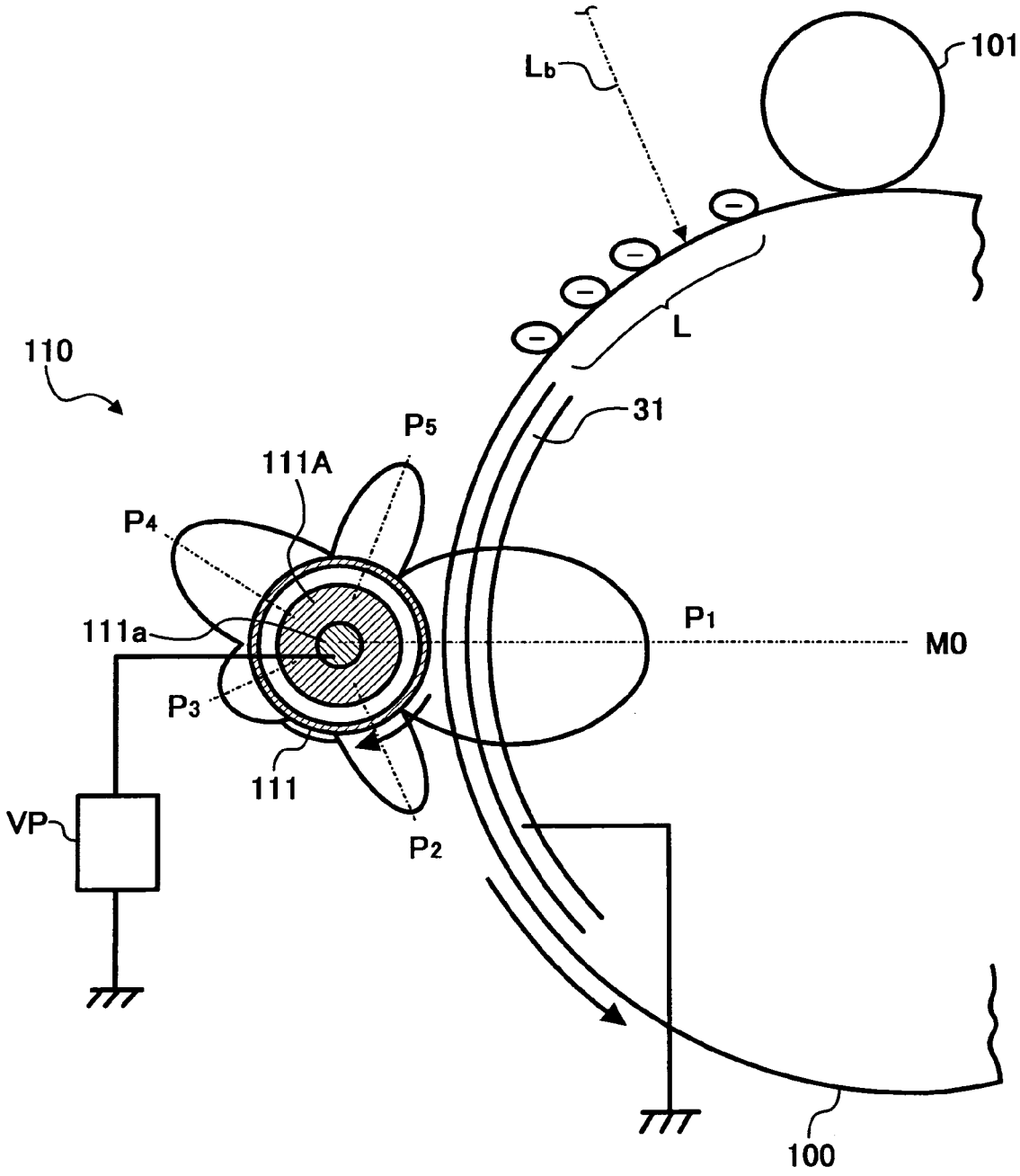
FIG. 19 shows a bias applying system included in the alternative embodiment.

In the upstream portion A, the carrier grains Cr, holding toner grains T thereon, approach a main magnetic force distribution P1, see FIGS. 18 and 19, gather, and then start rising in the form of brush chains along the magnetic lines of force.

As shown in FIGS. 18 and 19, the main magnetic force distribution P1 is located at a position where the sleeve 111 is closest to the drum 100, i.e., the closest position M0 on a line passing through the axis of the sleeve 111 and that of the drum 100. A magnet for forming the main magnetic force distribution P1 is disposed in the sleeve 111.

More specifically, the sleeve 111 accommodates thereinside, a magnet for forming a magnetic force distribution that scoops up the developer onto the sleeve 111, a magnet for forming a magnetic force distribution that conveys the developer thus deposited on the sleeve 111 and a magnet for forming a magnetic field distribution that collects the developer in the developing device 110 as well as a magnet for forming the main magnetic force distribution P1 and other magnets, although not shown specifically. These magnets are mounted on the tubular magnet roller 111A and spaced from each other in the circumferential direction of the roller 111A. The magnetic field distributions mentioned above are labeled P1 through P5 in FIGS. 18 and 19.

By using the microscope and high-speed camera mentioned earlier, I observed the behavior of the carrier grains Cr and toner grains in the consecutive portions A through C by shooting them at a speed of 9,000 frames to 40,500 frames per second. The behavior is characterized in that the brush chains of the carrier grains Cr flow while forming a magnet brush, while the toner grains T, contained in the brush chains, fly from the surfaces of the carrier grains Cr and become free toner grains T. The illustrative embodiment uses this phenomenon for developing a latent image.

Figure 20:
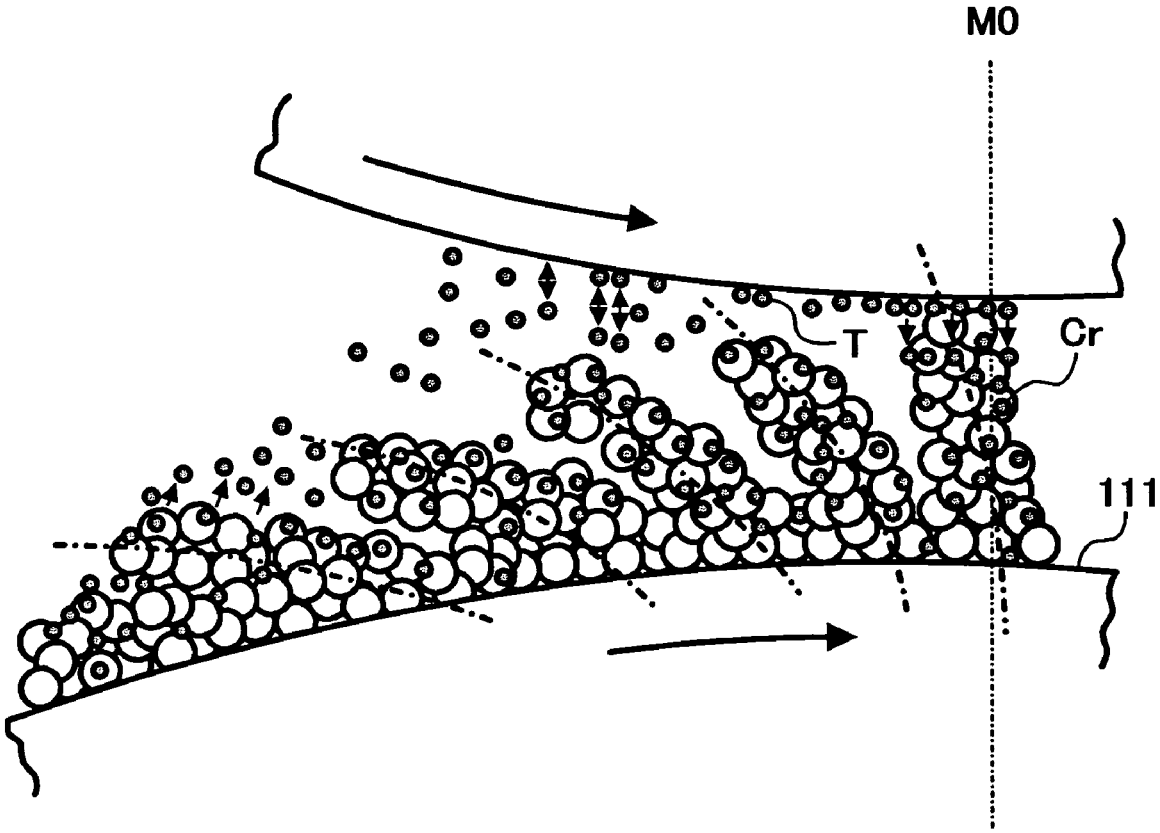
FIG. 20 demonstrates splashing to occur in the upstream portion where magnetic carrier grains rise in the form of brush chains.

FIG. 20 demonstrates how the carrier grains Cr rise in the form of brush chains in the upstream portion A. At the positions of the magnetic force distributions P1 through P5, FIGS. 18 and 19, the carrier grains Cr form a magnet brush without regard to the polarity of the magnet, but remain in a thin layer between nearby magnetic force distributions.

As shown in FIG. 20, the carrier grains CC confined in the developer layer remain in the developer layer because the magnetic line of force between the magnets in the direction normal to the sleeve is weak, but the magnetic force tangential to the sleeve is strong because the magnets adjacent to each other are opposite in polarity to each other. At the same time, the toner grains T on the carrier grains Cr are buried in the developer layer, so that only a small amount of toner grains T face the drum 100.

When the above developer layer arrives at the position corresponding to the main magnetic force distribution P1, some carrier grains Cr gather and rise in the form of a brush chain. While the number of carrier grains Cr so gather in the form of a brush chain is generally determined by the amount of developer to pass by a doctor blade or metering member 114, FIG. 18, it is also determined by the magnetic property of the carrier grains Cr as well as the size of the main magnetic force distribution P1, the configuration of the magnet forming the distribution P1, the size and inclination of the magnetic line of force dependent on the arrangement of the above magnet, and the diameter of the sleeve 111.

Although the magnet, forming the main magnetic force distribution P1, is fixed in place on the magnet roller 111*a*, the angle and size of the magnetic line of force, as measured at the position where the brush chain starts rising, vary because the sleeve 111 is in rotation. At this instant, the brush chain does not immediately rise along the magnetic line of force due to a delay in the magnetic response of the carrier grains Cr. Further, although the brush chain, constituted by a number of carrier grains Cr, rises by overcoming the restraint of the assembly, the polarities of all of the carrier grains Cr are directed in the same direction under the action of the intense magnetic field of the magnet and therefore repulse each other. For these reasons, the developer layer suddenly splits with the result that the carrier grains Cr rise in the form of a brush chain. Consequently, the toner grains T, confined in the assembly of the carrier grains, are made free. This, coupled with the strong centrifugal force acting on the toner grains T deposited on the carrier grains Cr, releases the toner grains T from the carrier grains Cr as free toner grains T.

Further, the free toner grains T thus parted from the carrier grains Cr can easily move under the action of, e.g., an electric field because an electrostatic or a physical adhesion force does not act between the free toner grains T and the carrier grains Cr.

Figure 21A:
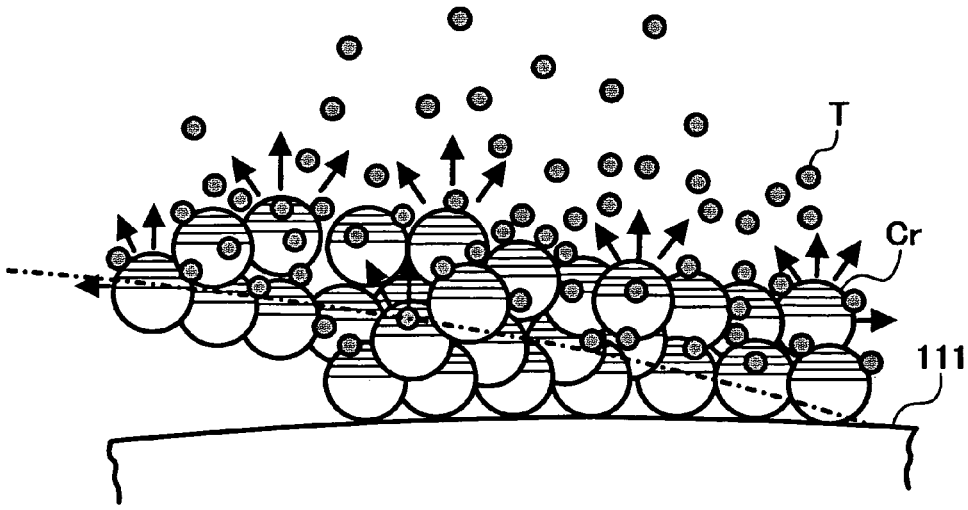
FIGS. 21A through 21B each show a particular condition wherein toner grains part from carrier grains.
Figure 21B:
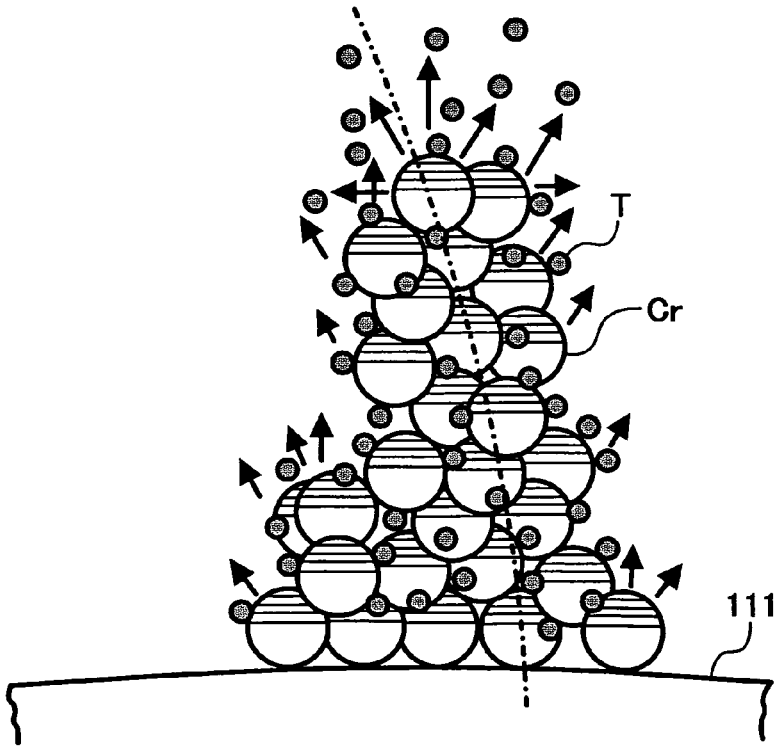

FIG. 21A shows a condition where the toner grains part from the carrier grains Cr when the carrier grains Cr rise in the form of a brush chain. FIG. 21B shows a condition wherein the toner grains part from the carrier grains Cr when the carrier grains, fully risen in the form a brush chain, are positioned closest to the drum 100. In FIGS. 21A and 21B, hatching indicates the portions of the carrier grains from which the toner grains T can part while arrows indicate the directions of electric fields; the length of each arrow is representative of field strength.

The field strength on the individual carrier grain Cr is, of course, susceptible to the bias for development and the electric resistance and grain size of the carrier grain Cr. As soon as the carrier grains Cr enter the developing zone, they are substantially regularized to the potential of the sleeve 111. Therefore, the field strength becomes greater as the carrier grains Cr move closer to the drum 100 or as the tips of the brush chains become sharper.

For the above reason, in FIG. 21*b*, the toner grains T part only from several toner grains positioned on the tip and close to the drum 100. However, as shown in FIG. 21A, a substantial number of carrier grains Cr face the drum 100 (upward), so that the toner grains T can easily part from the carrier grains Cr. Further, when the carrier grains Cr stacked together, they behave as a single conductive mass in the aspect of potential, and allow even the toner grains T held on the carrier grains Cr close to the sleeve 111 to easily part.

The free toner grains T can be produced if the force to act on the toner grains T deposited on the carrier grains Cr is controlled on the basis of the grain size and other powder characteristics and the intensity of saturation magnetization and other magnetic characteristics of the carrier grains Cr and the intensity of saturation magnetization and other magnetic characteristics and width, shape and other configuration characteristics of the magnet.

Further, by forming a magnet brush having the free toner grains T, it is possible to increase the amount of toner grains T to deposit on a latent image formed on the drum 100 for thereby realizing efficient development. The illustrative embodiment causes the free toner grains T to appear even in a weak electric field in the upstream portion, thereby implementing efficient image transfer.

Figure 22:
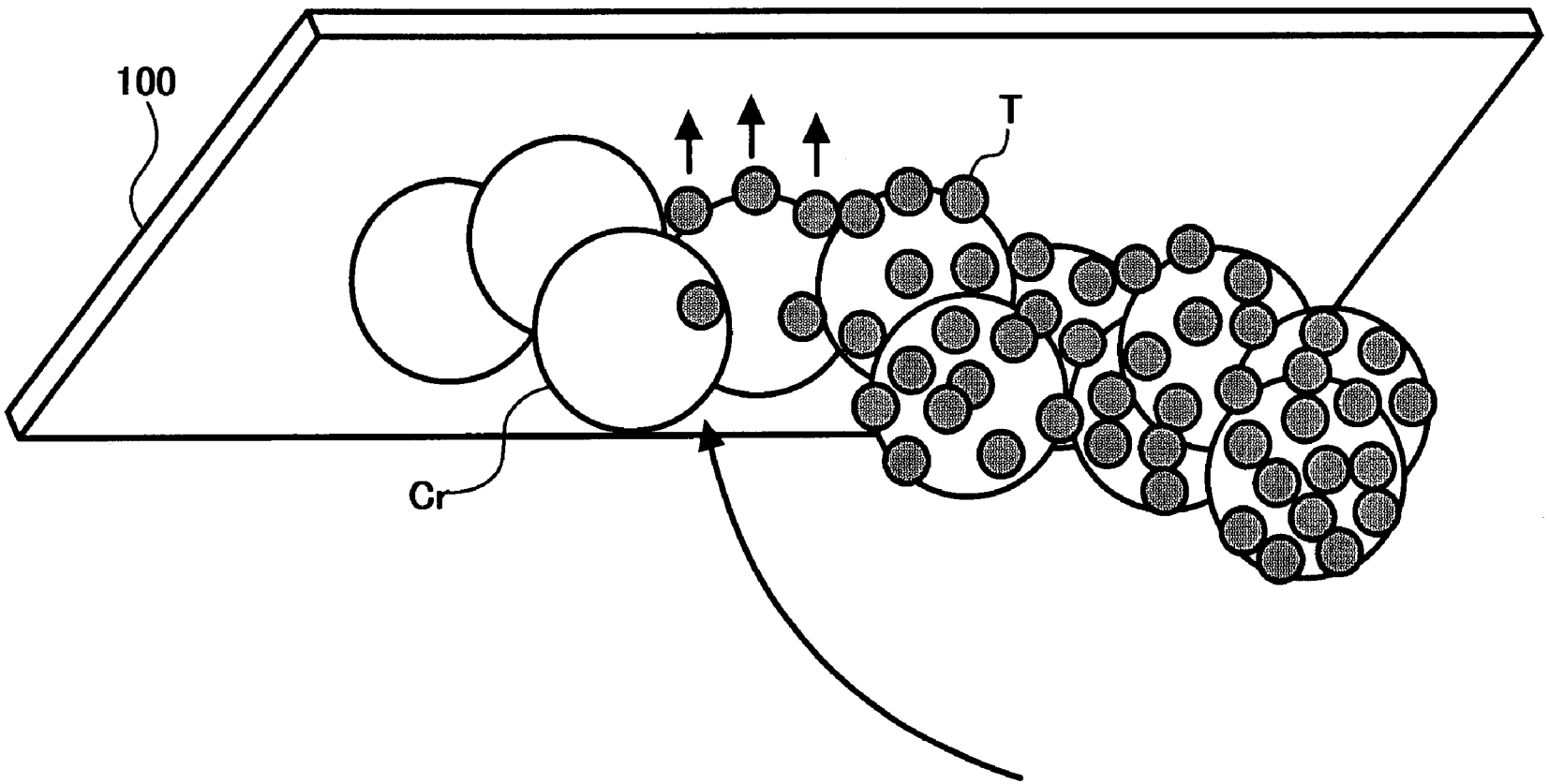
FIG. 22 shows how a brush chain strongly contacts the drum in an intermediate portion included in the developing zone.

In the intermediate portion B, FIG. 17, development is effected by the toner grains T splashed from the surfaces of the carrier grains Cr. FIG. 22 demonstrates how the brush chain of the carrier grains Cr strongly contact the drum 100 in the intermediate portion B. In FIG. 22, the size and height of the brush chain, constituted by the carrier grains Cr, are dependent on the powder characteristics and magnetic characteristics of the carrier grains Cr and the magnetic characteristics and configuration characteristics of the magnet, as stated earlier. Therefore, in the portion B, the brush chains on the sleeve 111 move at the same velocity as the sleeve 111 except when they slip on the sleeve 111. As a result, when the height of the brush chains is greater than the distance between the sleeve 111 and the drum 100, the tips of the brush chains strongly contact the drum 100 at velocity which is the combination of the velocity at which the tips of the brush chains rise along the magnetic lines of force of the magnet main magnetic field distribution P1 and the peripheral speed of the sleeve 111.

Even if the brush chains fully rise before strongly contacting the drum 100, the brush chains strongly contact the drum 100 if their height is greater than the distance between the sleeve 111 and the drum 100 at the closest position. More specifically, such brush chains move toward the closest position in accordance with the distance with the above distance that decreases little by little and therefore strongly contact the drum 100 at speed produced by subtracting the peripheral speed of the drum 100 from that of the sleeve 111. At this instant, the toner grains T part from the carrier grains Cr due to an impact resulting from the contact as if they were splashed from the carrier grains.

In the downstream portion C, FIG. 17, the brush chains rub the drum 100 with the result that the toner grains T are transferred from the carrier grains Cr to the latent image formed on the drum 100. In the downstream portion C, the brush chains are conveyed on the sleeve 111 while continuously rubbing the drum 100.

Figure 23:
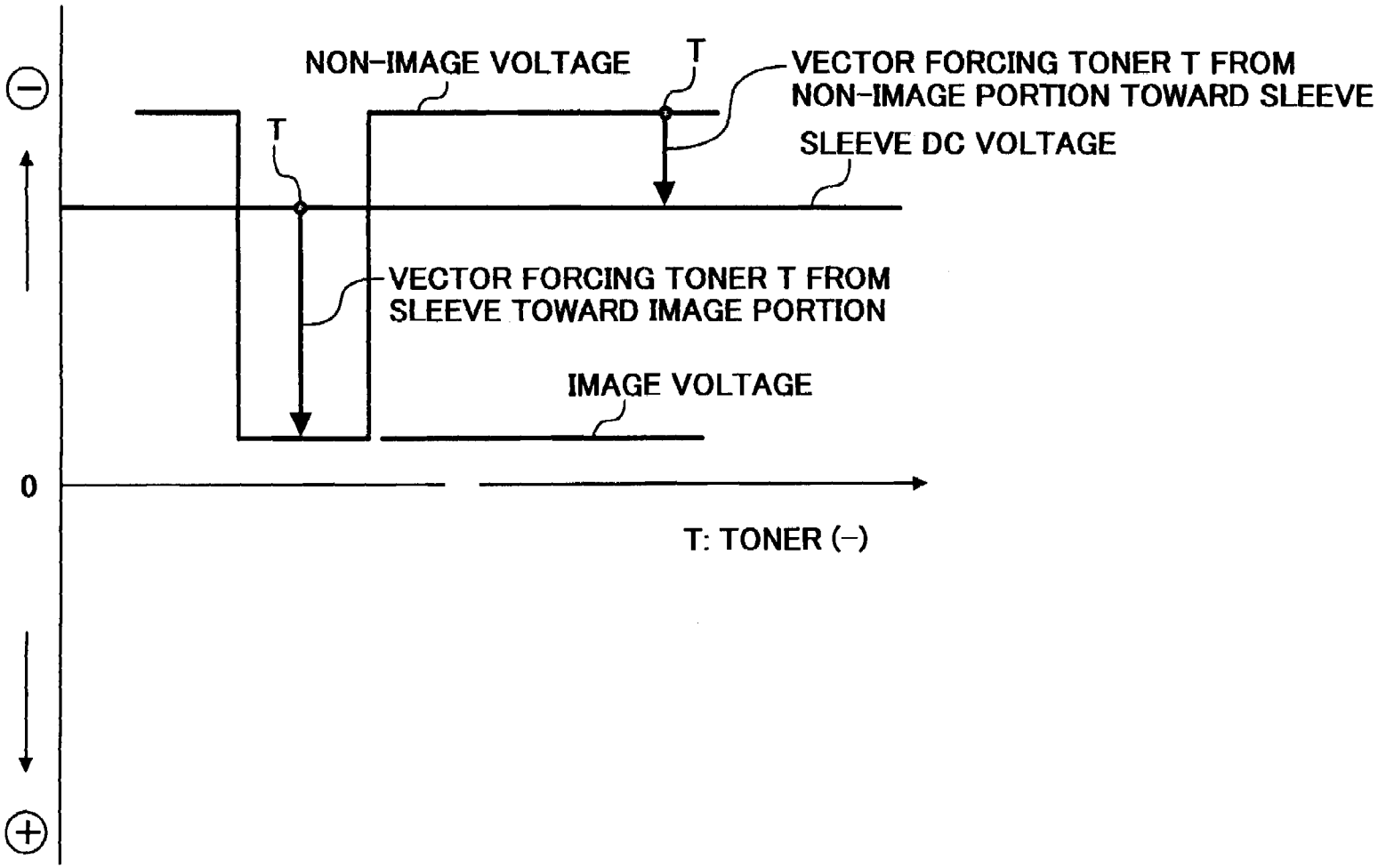
FIG. 23 shows a condition wherein a DC electric field is applied in a negative-to-positive developing system.
Figure 24A:
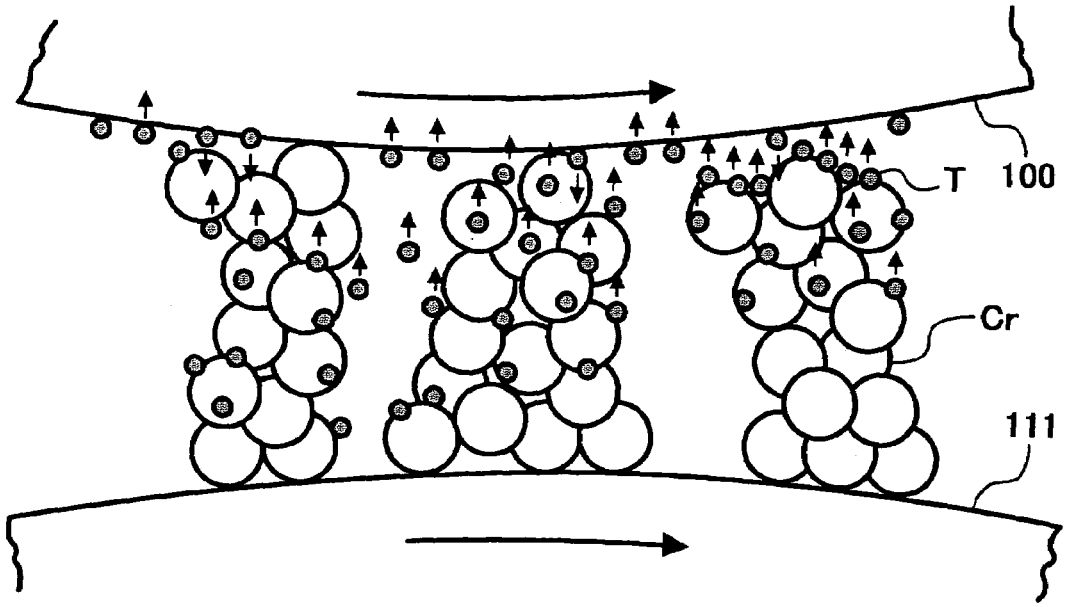
FIG. 24A shows toner gains are subject to a force directed toward the drum in an image portion in a downstream portion included in the developing zone.
Figure 24B:
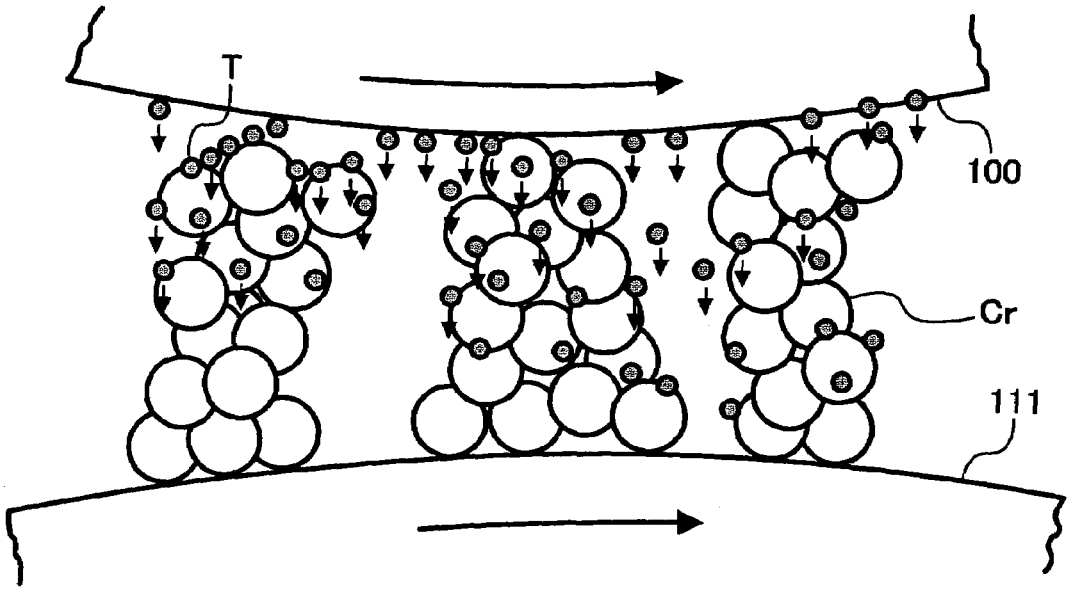
FIG. 24B shows toner gains are subject to a force directed away from drum in a non-mage portion.

FIG. 23 shows a specific condition wherein a power supply VP, see FIG. 19, applies a DC electric field for development as a bias in the negative-to-positive developing system. FIGS. 24A and 24B show how the toner grains T deposit on the drum 100 in the portion C. More specifically, FIG. 24A shows the toner grains T moving on the carrier grains Cr for developing the image portion or latent image L while FIG. 24B show the toner grains T moving in the non-image portion. In FIG. 24A, arrows indicate how the toner grains on the drum 100 are subject to a force that forces them toward the image portion. In FIG. 24B, arrows indicate how the toner grains in the non-image portion are subject to a force that forces them away from the drum 100.

Usually, a DC bias for depositing the toner grains T on the drum 100 is applied between the sleeve 111 and the drum 100. The drum 100, using an organic pigment as a carrier generating material, is generally charged to negative polarity and has a latent image formed thereon by toner of negative polarity. The polarity of charge to deposit on the drum 100 is not questionable.

When a laser beam is used for writing an image, it exposes character portions in order to reduce the amount of writing. In this case, the charge in the exposed portions are neutralized by holes generated by the carrier generating material, so that the potential of the image portions or character portions is lowered, as shown in FIG. 23. The power supply VP, connected to the sleeve 111, applies a DC voltage biased to the negative size to the above image portions. As a result, a vector, extending toward the sleeve 111 or the image portions, acts on the free toner grains of negative polarity and the toner grains deposited on the carrier grains Cr. Even if toner grains are present in the non-image portions of the drum 100, the vector, directed from the non-image portions toward the sleeve 111, causes such toner grains to surely part from the non-image portions, thereby obviating background contamination.

In the downstream portion C, the toner grains T on the carrier grains Cr, having spaces open toward the drum 100, deposit on the latent image L under the action of the electric field between the drum 100 and the sleeve 111 and the electric field between the drum 100 and the carrier grains Cr. On the other hand, the carrier grains Cr, released much toner grains T in the upstream portion A or the intermediate portion B and therefore excessively charged, move while rubbing the drum 100 and therefore overtake and strongly contact the toner grains T present on the drum 100. The resulting impact, coupled with an electrostatic Coulomb's force derived from opposite polarities, causes the above toner grains T to deposit on the carrier grains Cr. Particularly, in the non-image portion of the drum 100 where the static charge deposited by a charger is low, much toner grains T can be removed for thereby obviating background contamination.

In the illustrative embodiment, in the upstream portion A, the sleeve 111 causes brush chains, holding the toner grains T and forming brush chains, and brush chains formed by the carrier grains Cr to flow while forming a magnet brush. At this instant, a magnet brush, containing the free toner grains T to part from the carrier grains Cr, is formed. After the free toner grains T have deposited on the latent image L, a magnet brush formed in the developing zone later strongly contacts the drum 100 to thereby splash the toner grains T toward the drum 100 while causing the carrier grains Cr to rub or adjoin the drum 100.

In the above condition, assume that the potential of the drum 100 is $V_{PC}$ and that the DC component of the potential deposited on the sleeve 111 is $V_{DC}$. Then, when $V_{PC}$–

$P_{DC}$=400 V holds, the mean flight velocity of the free toner grains T is selected to be 1 m/s or below while the standard deviation of the flight velocity distribution is selected to be 0.51 or above. Further, when the $V_{PC}-V_{DC}$=200 V holds, the mean flight velocity of the free toner grains T is selected to be 0.65 m/s or below.

More specifically, in the upstream portion A, the carrier grains Cr gather to form brush chains and release the toner grains T when rising. These toner grains T directly fly toward the drum 100 under the application of the bias.

In the intermediate portion B, the brush chains of the carrier grains Cr contact the drum 100 and splash the toner grains T deposited thereon, thereby developing the latent image L. At the same time, toner grains T present on the drum 100 are again collected by and deposited on the carrier grains Cr.

As stated above, in the upstream and intermediate portions A and B, toner grains T deposited on the non-image portion of the low-potential portion of the drum 100 are returned to the carrier grains Cr, so that image quality is enhanced. Further, in the downstream portion C, the carrier grains Cr on the tips of the brush chains rub or adjoin the drum 100 and develop the latent image L under the application of the bias.

By observing the free toner grains T in the upstream portion A in detail, it was found that when $V_{PC}-V_{DC}$ was 400 V and when the distance of flight was small, i.e., around the intermediate portion B, two to ten toner grains T are liberated in a mass. These toner grains were loosened on hitting against other toner grains in the space. The standard deviation of the flight velocity distribution should preferably be 0.51 or above because as the flight velocity distribution becomes broader, the collision of fast toner grains with slow toner grains is more promoted.

Further, it was found that when the free toner grains T deposit on the drum 100, they sometimes sprung out toner grains T present on the drum 100. This phenomenon is dependent on the flight velocity of the free toner grains T and can be limited if the mean flight velocity when $V_{PC}-V_{DC}$ is 400 is 1 m/s or less.

When the flight velocity was high in a portion where $V_{PC}-V_{DC}$ was 200 V, corresponding to a halftone portion or an edge portion, the toner grains T deposited on a non-image portion around the above portion (background contamination) or undesirably enhanced the edges of an image. It follows that the mean flight velocity when $V_{PC}-V_{DC}$ is 200 V should preferably be 0.65 m/s or less. In addition, such a mean flight velocity implements a high quality image formed by dots regular in shape, free from thickening and uniform in size.

In the illustrative embodiment, brush chains formed by the carrier grains Cr flow while forming a magnet brush. At this instant, the free toner grains T separate from the carrier grains Cr in a zone corresponding to the entire surface of the sleeve 111 that faces the drum 100. This zone is the developing zone where the free toner grains T can move toward the latent image L, so that the free toner grains T can efficiently develop the latent image L for thereby producing a high quality image.

The developing zone can be controlled if the position of the magnetic field distribution, formed by the magnet or magnetic field forming means, is suitably selected.

The power supply VP may advantageously output an AC-biased DC voltage instead of the DC voltage in order to form an alternating electric field. While the free toner grains T in the upstream portion A are caused to fly by the centrifugal force and inertia of the magnet brush and Coulomb's force, the Coulomb's force becomes predominant when use is made of the alternating electric field. In this condition, the free toner grains T are oriented in the direction of the electric field, i.e., toward the latent image L, minimizing background contamination.

Figure 25:
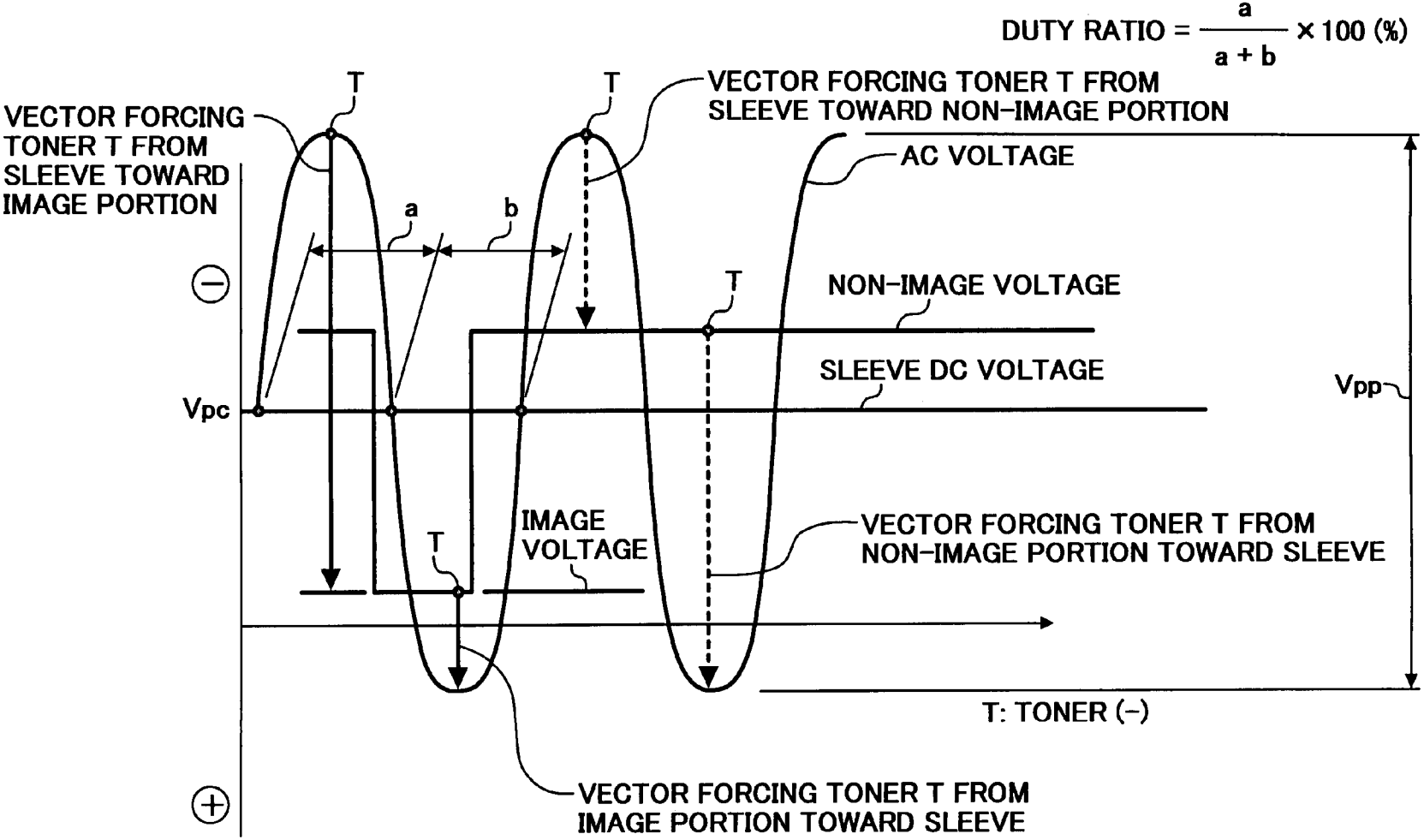
FIG. 25 shows a condition wherein an alternating electric field is applied in a negative-to-positive developing system.

FIG. 25 shows a specific developing condition in which the power supply VP, FIG. 19, outputs an AC-biased DC voltage for forming an alternating electric field in the negative-to-positive developing system. The alternating electric field, formed between the drum 100 and the sleeve 111*c*, is desirable for the development of the illustrative embodiment.

In FIG. 25, the electric field, formed between the sleeve 111 and the drum 100, causes the toner grains T of, e.g., negative polarity to deposit on the latent image L like the DC electric field stated previously. Again, because the carrier grains Cr on the sleeve 111 are dielectric, the electric field is further intensified on the drum 100 and brush chains and causes the toner grains T to part from the carrier grains Cr and deposit on the latent image L. Further, the alternating electric field causes the toner grains T on the drum 100 to oscillate and faithfully develop the latent image L. Also, when the tips of the brush chains adjoin the drum 100, the electric field is intensified by the carrier grains Cr and causes the toner grains T to oscillated more actively, thereby further enhancing faithful development.

More specifically, in the image portion, the alternating electric field biased to negative polarity allows the free toner grains T to surely deposit on the image portion under the action of the great and small vectors directed toward the image portion. Also, toner grains, if present on the non-image portion, are surely removed from the non-image portion under the action of vectors directed toward the sleeve 111*c*, so that background contamination is surely obviated.

Figure 26A:
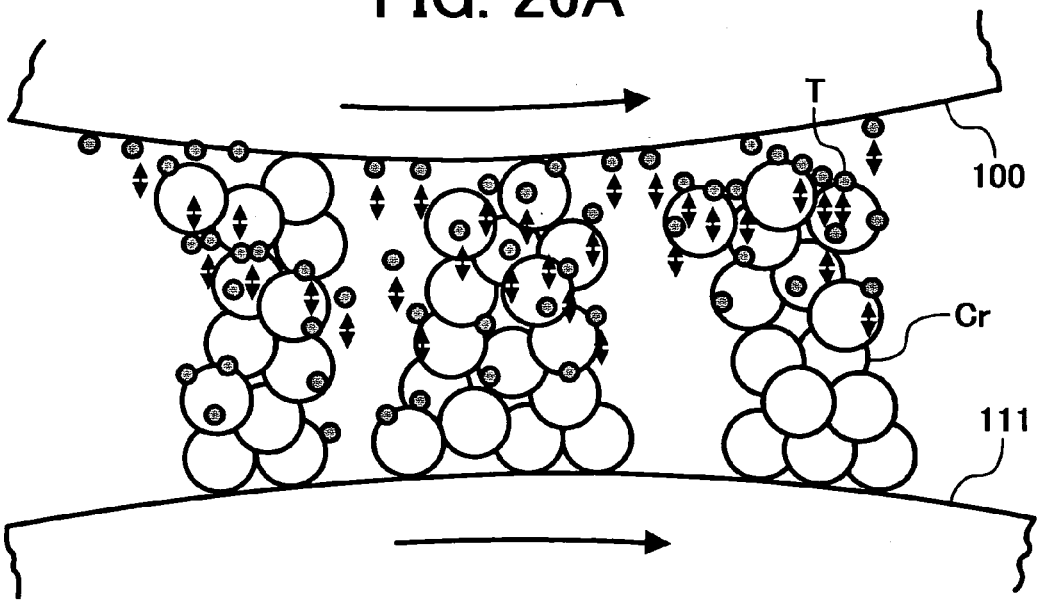
FIG. 26A shows a condition wherein toner grains move on carrier grains in the downstream portion when a latent image is developed under the application of the alternating electric field.
Figure 26B:
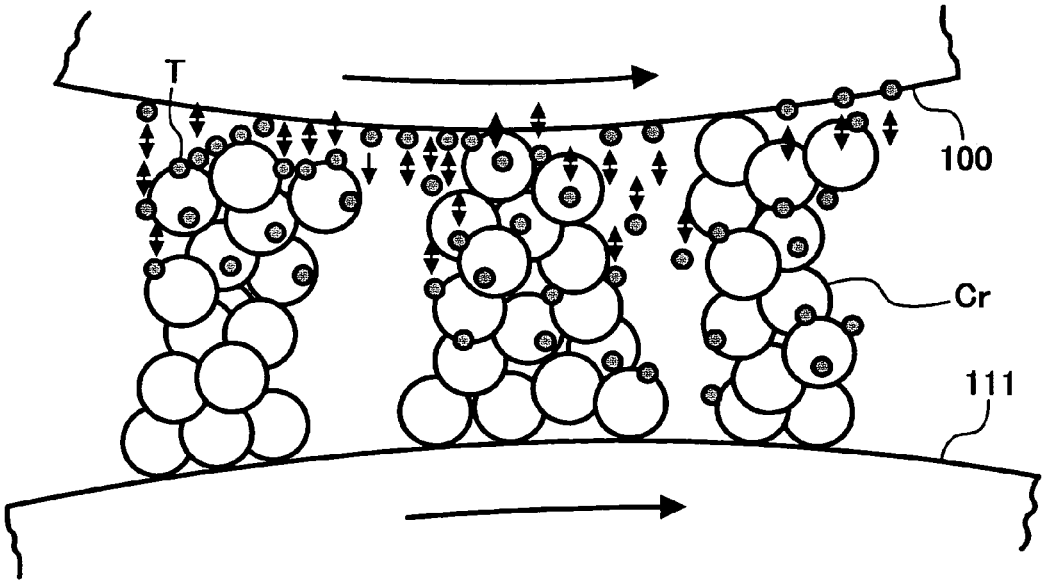
FIG. 26B shows how toner grains move in a non-image portion under the application of the alternating electric field.

FIGS. 26A and 26B demonstrate how the toner grains deposit on the latent image L in the portion C under the action of the alternating electric field. More specifically, FIG. 26A shows the movement of the toner grains T on the carrier grains Cr in an image portion while FIG. 26B shows the movement of the toner grains T in a non-image portion. Again, because the carrier grains Cr on the sleeve 111 are dielectric, the electric field is further intensified on the brush chain of carrier grains Cr and causes the toner grains T to part from the carrier grains Cr and deposit on the latent image L. Further, the alternating electric field causes the toner grains T on the drum 100 to oscillate and faithfully develop the latent image L. Also, when the tips of the brush chains adjoin the drum 100, the electric field is intensified by the carrier grains Cr and causes the toner grains T to oscillated more actively, thereby further enhancing faithful development. It is to be noted that even the toner grains not deposited on the latent image also oscillated on the carrier grains Cr. In FIGS. 26A and 26B, double-headed arrows indicate the oscillation of such toner grains T.

Further, in the illustrative embodiment, the range where the free toner grains T part from the carrier grains when the carrier grains rise in the form of brush chains is the range where the free toner grains T can move toward the latent image L.

Figure 27A:
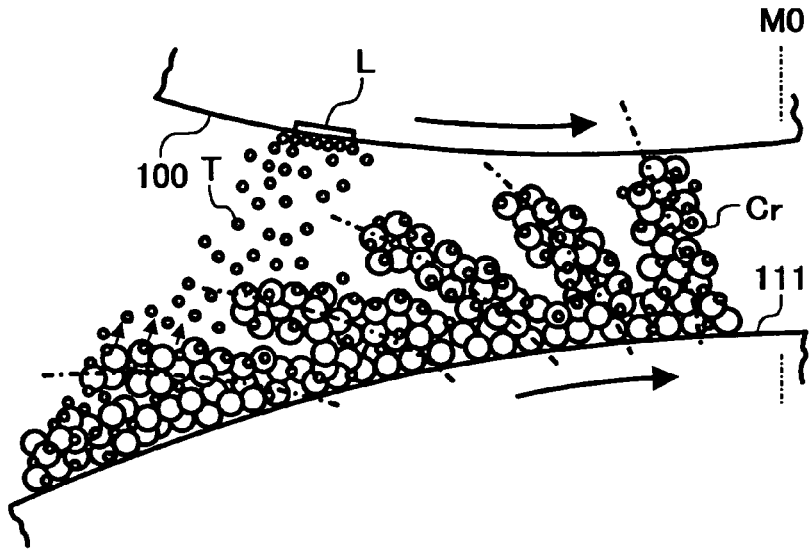
FIG. 27A shows a number of free toner grains parted from carrier grains in the form of cloud or smoke in the upstream portion A.

In the upstream portion A where the magnet brush is formed, the free toner grains T gather in the form of cloud or smoke and are mostly easily removable toward the latent image L. This will be described with reference to FIGS. 27A through 27C. As shown in FIG. 27A, a space that allows the toner grains T to move is formed by the impact, centrifugal force and so forth at the position where the magnet brush, pressed against the sleeve 111 rises. As a result, the toner grains on the carrier grains Cr and the toner grains T sandwiched between the brush chains are released. Consequently, a large number of free toner grains T gather in the form of cloud or smoke.

Figure 27B:
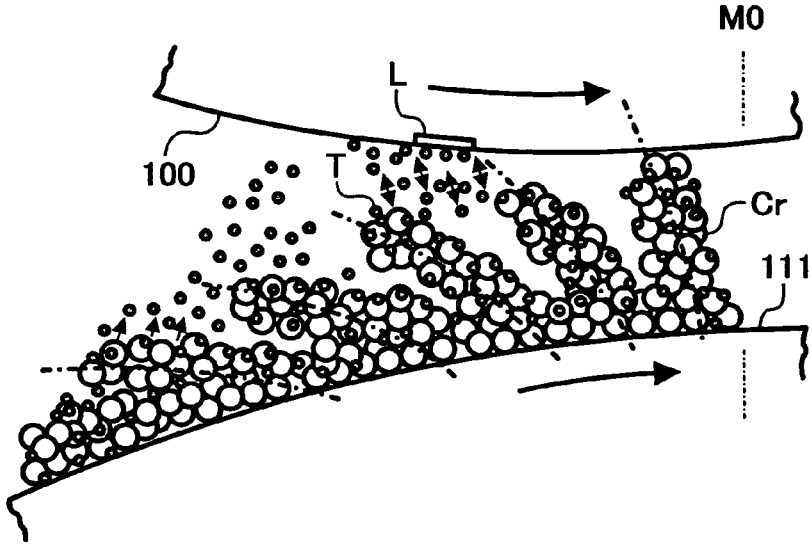
FIG. 27B shows how toner grains are electrostatically attracted by and deposited on a latent image.

As shown in FIG. 27B, the toner grains T thus gathered are attracted toward the latent image L by the electric field, developing the latent image L. In the non-image portion, the electric field is directed toward the sleeve 111, so that the free toner grains T return to the carrier grains Cr or move toward the sleeve 111. This successfully promotes efficient use of the toner grains T and protects the inside of the apparatus from smearing ascribable to the scatter of the toner grains T.

In the illustrative embodiment, the power supply VP, FIG. 19, forms, e.g., the alternating electric field at the portion where the drum 100 and sleeve 111 face each other. Further, in the illustrative embodiment, the magnet brush contacts the drum 100 in the intermediate and downstream portions B and C, an electrode effect acts between the carrier grains on the tips of the brush chains and the drum 100. This makes the toner layer in the image portion more uniform and efficiently scavenges the toner grains contaminating the non-image portion. This effect is available with the DC bias also. Another advantage of the above developing system over the conventional developing system using a toner and carrier mixture is that the duration of contact of the magnet brush with the drum 100 is short enough to obviate the thinning of horizontal lines, the omission of the trailing edge of an image and other defects dependent on direction.

As shown in FIG. 27B, in the magnet brush approaching the alternating electric field, the toner grains move back and forth, or oscillate, between the carrier grains Cr on the tips of the brush chains and the drum 100. This movement of the toner grains T render, in the image portion, the toner layer more uniform to thereby enhance dot reproducibility and scavenges, in the non-image portion, the toner grains T deposited thereon.

Figure 27C:
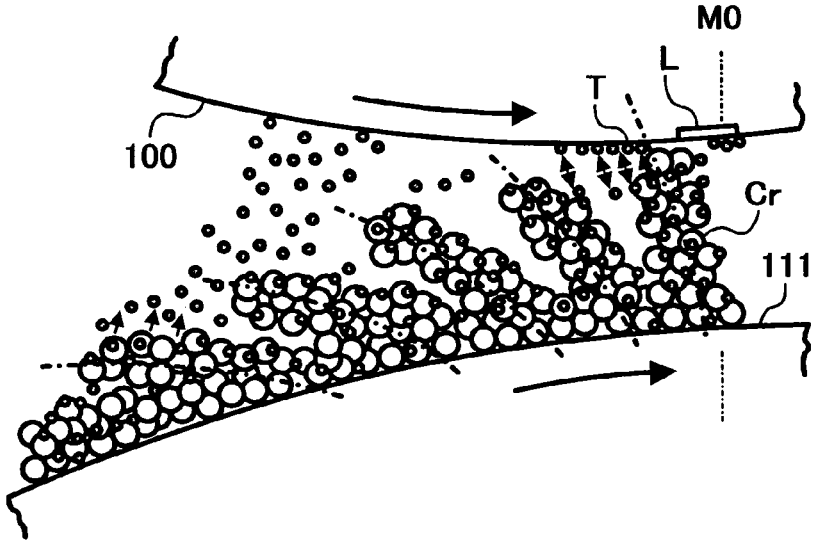
FIG. 27C shows toner grains moving back and force between carrier grains on the tips of a magnet brush and the drum.

As shown in FIG. 27C, the alternating electric field and contact type development described above cause the toner grains T to move back and forth, or oscillate, between the carrier grains Cr on the tips of the brush chains and the drum 100. Again, this movement of the toner grains T render, in the image portion, the toner layer more uniform to thereby enhance dot reproducibility and scavenges, in the non-image portion, the toner grains T deposited thereon.

In the illustrative embodiment, the magnet, disposed in the sleeve 111 and forming the main magnetic field distribution P1, should preferably be inclined toward the downstream side in the direction of developer conveyance in the developing zone. The magnet so inclined broadens the upstream portion A for thereby effectively increasing the number of free toner grains T.

In the illustrative embodiment, the range where the free toner grains T part from the carrier grains Cr rising in the developing zone is controlled by the magnetic field forming means. More specifically, the carriers Cr rise in the form of brush chains along the magnetic lines of force of the magnet or magnetic field forming means disposed in the sleeve 111. The above range can therefore be controlled if the rise of the carrier grains Cr is controlled.

Generally, the total amount of toner to deposit on a latent image is dependent on target image quality, so that adjusting means can be controlled in accordance with process conditions and developer conditions. It follows that the amount of free toner grains T to contribute to development is also determined under the above conditions. In this respect, the range where the free toner grains T are expected to appear may be positioned upstream or downstream of the closest position M0 in the direction of developer conveyance, as desired.

More specifically, when the range mentioned above is positioned upstream of the closest position in the direction of developer movement (direction of rotation of the sleeve 111), i.e., coincident with the upstream portion A, the free toner grains T can be produced before the closest position M0 and contribute to development. On the other hand, if the range concerned contains the closest position M0, then the free toner grains can perform development in the range where the bias is most intense.

In the illustrative embodiment, too, the linear velocity ratio Vs/Vp is selected to be greater than 0.9, but smaller than 4. Even if the linear velocity of he sleeve 111*c* is lower than the linear velocity of the drum 100, i.e., even if the ratio Vs/Vp is smaller than 1, much toner grains can deposit on the latent image Li because the toner grains T part from the carrier grains CC in a sufficient amount. By causing the sleeve 111 to rotate with the ratio Vs/Vp greater than 0.9, it is possible to increase the amount of toner grains T to deposit on the latent image Li for thereby increasing image density. The ratio Vs/Vp may be further reduced, depending on the amount of free toner grains T available.

If the linear velocity Vs/Vp is increased, the impact with which the brush chains contact the drum 100 in the intermediate portion B is intensified. As a result, although more toners are splashed and deposit on the drum 100, more toners part from the drum 100 due to the impact. Further, in the downstream portion C, when the magnet brush rubs the drum 100, the frequency of contact of the carrier grains Cr with the drum 100 and therefore the amount of toner to part from the drum 100 increases. Particularly, when the ratio Vs/Vp is greater than 4, it is likely that the trailing edge of a halftone portion is lost or that a horizontal, thin line image is blurred.

Referring to FIGS. 18 and 19, the developing device 110 will be described more specifically hereinafter. The developing device 110 is configured to implement any one of the developing methods described above. As shown, a charge roller or charger 101 for uniformly charging the surface of the drum 100. A writing unit, not shown, scans the charged surface of the drum 100 with a laser beam Lb in accordance with image data to thereby form a latent image L. The developing device 110 deposits charged toner grains T on the latent image to thereby produce a corresponding toner image. An image transferring device, not shown, transfers the toner image to a sheet or recording medium. A drum cleaner, not shown, removes the toner grains T left on the drum 100 after the image transfer. A quenching lamp, not shown, discharges the cleaned surface of the drum 100 for thereby preparing it for the next image forming cycle.

Further, a peeler, not shown, peels off the sheet electrostatically adhering to the drum 100. The sheet, carrying the toner image thereon, is conveyed to a fixing unit, not shown, and has the toner image fixed thereby.

The sleeve 111 is disposed in the developing device 110 in the vicinity of the drum 100, so that the developing zone is formed between the sleeve 111 and the drum 100. The sleeve 111 is formed of aluminum, brass, stainless steel, conductive resin or similar nonmagnetic material and rotated clockwise, as viewed in FIG. 18, by a drive mechanism not shown.

In the illustrative embodiment, the drum 100 is provided with an outside diameter of 90 mm and driven at a linear velocity of 156 mm/sec while the sleeve 111 is provided with a diameter of 18 mm and driven at a linear velocity of 214 mm/sec. The linear velocity ratio Vs/Vp stated earlier is therefore 1.4. In the illustrative embodiment, required image density is available even if the ratio Vs/Vp is as small as 0.9.

The gap for development between the drum 100 and the sleeve 111 is selected to be 0.6 mm. More specifically, if the carrier grain size is 50 μm, then the gap should preferably be 65 mm or below, i.e., thirteen times as large as the carrier grain size or below. If the gap is extremely small, then a magnet brush contacts the drum 100 over a broad range and is apt to bring about direction-dependent image defects mentioned earlier. Conversely, if the gap is excessively large, then sufficient field strength is not attainable, resulting in solitary dots, irregularity in a solid image and other defects. While voltage may be raised to preserve field strength, this scheme is apt to cause a solid image to be locally lost in the form of spots.

A doctor blade or metering member 114 is positioned upstream of the developing zone in the direction of developer conveyance (clockwise in FIGS. 18 and 19) in order to regulate the thickness of the developer layer formed on the sleeve 111. A doctor gap between the doctor blade 114 and the sleeve 111 is selected to be 0.65 mm. While a conventional doctor blade is implemented as a plate formed only of a nonmagnetic material, the doctor blade 114 is made up of the conventional nonmagnetic plate and a magnetic plate adhered thereto. The magnetic plate serves to easily regulate the height of the brush chains.

Screws 112 and 113 are positioned at the opposite side to the drum 100 with respect to the sleeve 111 for scooping up the developer onto the sleeve 111 while agitating it. Fresh toner is suitably replenished from a toner bottle 115 to the screw portion. More specifically, the screws 112 and 113 each are driven at a rotation speed of 152 rpm (revolutions per minute) by drive means, not shown, agitating the developer to thereby frictionally charge the toner grains T contained in the developer.

The magnet roller 111A is held stationary inside the sleeve 111. The carrier grains Cr rise in the form of brush chains along the magnetic lines of force issuing from the magnet roller 111A in the normal direction. The toner grains T deposit on such brush chains, forming a magnet brush. When the sleeve 111 is rotated, the magnet brush is conveyed in the same direction as the sleeve 111. The magnets affixed to the magnet roller 111A forms the magnetic force distributions P1 through P5 stated earlier.

The magnet, forming the main magnetic field distribution P1, is provided with a small cross-sectional area, although not shown specifically. This magnet may be formed of a samarium alloy, particularly a samarium-cobalt alloy. A magnet formed of an iron-neodium-boron alloy, which is a typical rare earth metal alloy, has the maximum energy product of 358 kJ/m$^3$ while a magnet formed of an iron-neodium-boron ally bond has the maximum energy product of 80 kJ/m$^3$ or so. Such a magnet can implement a necessary magnetic force on the sleeve 111 even when noticeably reduced in size. The maximum energy products available with a conventional ferrite magnet and a ferrite bond magnet are about 36 kJ/m$^3$ and about 20 kJ/m$^3$, respectively. If the diameter of the sleeve 111 is allowed to have a relatively large diameter, then the conventional ferrite magnet or ferrite bond magnet may be used, in which case the end of the magnet, facing the sleeve 111*c*, will be thinned in order to reduce the half width of the magnetic force.

In the illustrative embodiment, the magnetic force distributions P3, P5 and P2 form N poles while the magnetic force distributions P1 and P4 form S poles. The distribution P2, contributing to the formation of the main distribution P1, would bring about carrier deposition if too small.

The developing device 110 should preferably be configured to produce the free toner grains T in consideration of, among others, the powder characteristics and magnetic characteristics of the carrier grains Cr and the magnetic characteristics and configuration characteristics of the magnet that forms the main magnetic force distribution P1. Particularly, the developing device 110 should preferably be configured such that the main distribution P1 cause the tips of a magnet brush to part from the developer layer. For this purpose, the diameter of the sleeve 111 should preferably be between 18 mm and 30 mm while the magnet, forming the main distribution P1, should preferably be provided with a width of 6 mm and 8 mm in terms of the half width of a peak flux density and a flux density of 100 mT to 130 mT.

The developer should preferably have a toner content of 4 wt % to 10 wt % and an amount of charge q/m of −5 μC/g to −60 μC/g, preferably −10 μC/g to −35 μC/g. The magnetic carrier grains Cr should preferably be implemented as spherical ferrite grains coated with resin and should preferably have saturation magnetization of between 35 emu/g and 85 emu/g, i.e., 4.4 to 10.7×10$^{-5}$ Wb.m/kg. Saturation magnetization below 35 emu/g degrades conveyance due to short magnetization while saturation magnetization above 85 emu/g tightens the magnet brush due to excessive magnetization and therefore intensifies the scavenging effect, resulting in scavenging marks in a halftone image portion. The volumetric mean grain size of the carrier grains Cr should preferably be between 25 μm and 100 μm, preferably between 30 μm and 60 μm. In addition, the ratio of the carrier grains Cr having a grain size of 74 μm or above to the total carrier grains should preferably be at least 10% because an increase in grain size translates into a decrease in the amount of toner grains T.

Further, the specific volume resistance of the carrier grains Cr should preferably be between 6 LogΩ·cm and 12 LogΩ·cm because the potential of the carrier grains Cr should preferably become equal to the potential of the sleeve 111 at an early stage.

The volumetric mean grain size of the toner grains T should preferably be between 4 μm and 10 μm. The content of fine powder whose grain size is below 4 μm should preferably be 20% by number. While the toner grains T may contain silica, alumina titania or similar additive, bulk density should preferably be 0.25 g/cm$^3$ or below; the higher the bulk density, the more easily the toner grains T part from the carrier grains Cr.

The carrier grains Cr may be implemented as ferromagnetic grains of iron, nickel, cobalt or similar metal or an alloy thereof with another metal, magnetite, γ-hematite, chromium dioxide, copper-zinc ferrite, manganese-zinc ferrite or similar oxide or manganese-copper-aluminum or similar Heusler's alloy. If desired, the ferromagnetic grains may be coated with styrene-acrylic resin, silicone resin, fluorocarbon resin or similar resin in accordance with the chageability of the toner grains T. A charge control agent, a conductive substance and so forth may be added to the above resin, if desired.

The toner grains T consist of at least thermoplastic resin and carbon black or copper phthalocyanine-based, quinacrydone-based, bisazo-based or similar pigment. As for resin, use should preferably be made of styrene-acryl resin or polyester resin. Polypropylene or similar wax, which promotes fixation, and an alloy-containing dye, which controls the amount of charge to deposit on the toner grains T may be added, if desired. Further, an oxide, a nitride or carbonate, e.g., silica, alumina or titanium oxide, as well as a fatty acid metal salt or a fine resin grains, may be added.

In the illustrative embodiment, the carrier grains Cr are implemented as copper-zinc spherical ferrite grains coated with silicone resin and provided with a volumetric mean grain size of 58 μm, magnetization strength of 65 emu/g, and specific volumetric resistance of 8.5 LogΩ·cm. The toner grains T consist of polyol resin and a pigment and a charge control agent added thereto. 0.7 wt % of hydrophobic silica and 0.85 wt % of hydrophobic titanium are added to the surfaces of such toner grains. The toner grains are provided with a volumetric mean grain size of 7 μm and bulk density of 0.33 g/cm$^3$ or above. Pigments applied to black toner, yellow toner, magenta toner and cyan toner are respectively carbon black, bisazo pigment, quinacrydone pigment, and copper-phthalocyanine pigment. The developer, containing any of the above toner grains, is provided with the initial toner content of 5 wt %. The toner grains all are initially chargeable to −20 μC/g to −35 μC/g. These specific conditions were used in a specific example of the illustrative embodiment to be described later.

In the illustrative embodiment, the configuration characteristics and electric characteristics of the sleeve 111 and those of the drum 100 are so selected as to form an electric field that causes the toner grains T parted from the carrier grains Cr to move toward the drum 100. To allow the toner grains T to deposit on the drum 10 as rapidly as possible, the developing device 110 should preferably form an electric field based on a rectangular wave.

Figure 28:
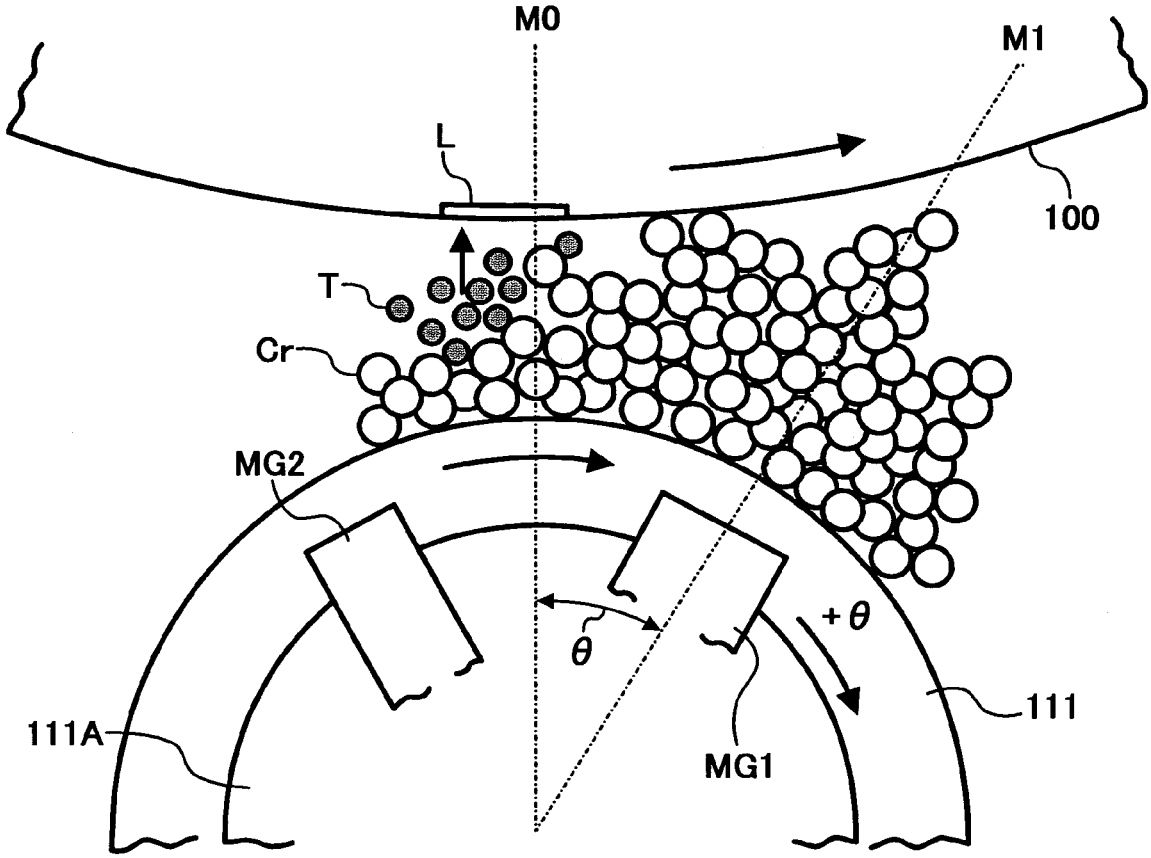
FIG. 28 shows a specific arrangement of magnets disposed in the sleeve.

As shown in FIG. 28, a plurality of magnets MG are arranged on the circumference of the magnet roller 111A at preselected intervals. The sleeve 111 rotates clockwise around the magnets MG. The carrier grains Cr gather and rise in the form of brush chains along magnetic lines of force issuing from the magnets MG.

As shown in FIG. 19, the power supply VP, which is connected to ground, is connected to a stationary shaft 111*a*. As shown in FIG. 2, voltage output from the power supply VP is applied to the sleeve 111 via the conductive bearing 111*e* and conductive rotary member 111*d*. The lowermost conductive base 31 of the drum 100, FIG. 19, is connected to ground.

In the configuration described above, the electric field that causes the toner grains T parted from the carrier grains Cr to move toward the drum 100 is formed between the drum 100 and the sleeve 111.

As shown in FIG. 28, in the illustrative embodiment, the magnet, labeled MG1, that forms the main magnetic field distribution P1 is positioned on the magnet roller 111A such that its magnetic force on the sleeve 111 in the normal direction has a peak M1 is positioned downstream of the closest position M0 in the direction of rotation of the drum 100 (counterclockwise). More specifically, the peak M1 is shifted from the closest position M0 by an angle θ of 0° to 30°. This allows, in the initial stage of formation of a magnet brush, as large a number of free toner grains T to appear in the range where the free toner grains T can move ward the latent image L. It follows that the position where the free toner grains T appear in the upstream portion A preferably coincides with the closest position M0.

In FIG. 28, assume that a magnet MG2 adjoins the magnet MG1 at the upstream side. Then, the angle between the polarity of the magnet MG2 and that of the magnet MG1 is 60°, so that the magnetic force is zero at an angle of 30° between the magnets MG2 and MG1. In this condition, a magnet brush rises at or in the vicinity of the closest point M0 or the skit portion of the magnetic lines of force, issuing from the magnet MG1, are positioned at or in the vicinity of the closest point M0.

The illustrative embodiment, like the previous embodiment, is applicable to the image forming apparatus described with reference to FIG. 16.

A specific example of the illustrative embodiment will be described hereinafter. Experiments were conducted with the developers stated earlier specifically and with a magnet brush and drum contacting each other in order to estimate uniformly of density and dots and background contamination. For the estimation, the duty ratio of the power supply was varied to control the flight velocity of free toner grains. While the estimation was made only with yellow toner T, the other toners are as desirable as yellow toner.

Use was made of the yellow toner whose TC and q/m were 7 wt % and −18 μC/g was used. As for the bias, an AC component having a peak-to-peak voltage Vpp of 1 kV and a frequency f of 2.5 kH and having a rectangular wave (duty=50%) was superposed on a DC component $V_{DC}$ of −500 V. The drum was charged to −100 V or −300 V. Under these conditions, the flight velocity of the toner grains T was measured in the upstream portion A. Every time the duty ratio was varied, the DC component $V_{DC}$ was also varied to have the effective value of −500 V at all times. More specifically, the effective DC value and AC component Vpp both were not varied, but the duty ratio wave varied to vary the flight velocity of toner grains.

As for the duty ratio, in FIG. 25, assume that a bias that causes the toner grains to move toward the drum 100 is applied for a period of time of a, and that a bias that causes the toner grains to move toward the sleeve 111 away from the drum 100 is applied for a period of time of b. Then, the duty ratio is represented by a/(a+b)×100 (%). FIG. 25 shows a specific DC component $V_{DC}$ and a specific AC component Vpp. The duty ratio can be easily varied in a device constituting a bias power supply.

First, the behavior of the toner grains T in the upstream portion A was observed by use of the microscope and high-speed camera mentioned earlier at a shooting speed of 9,000 to 40,500 frames per second. It is possible to see, by watching the resulting picture on a screen, that carrier grains Cr flow in a space where the drum 100 and sleeve 111 face each other, while free toner grains move toward the drum 100 in the manner described previously. For easy observation, toner grains distinguishable from one another were marked in red in order and traced.

Figure 29:
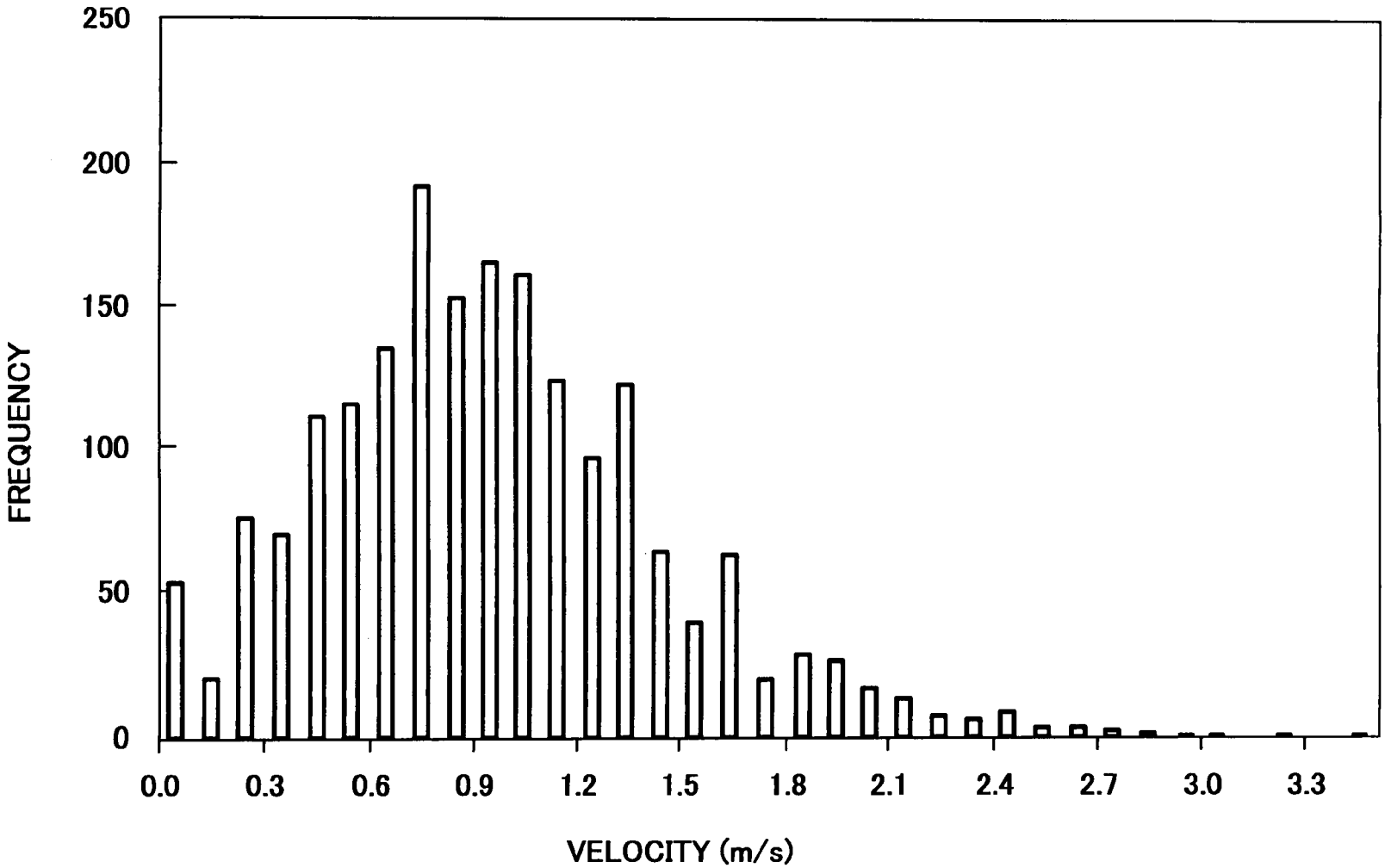
FIG. 29 is a histogram showing the flight velocity of toner grains as determined by a PTV (Particle Tracer Velocimetry)

Although the distance over which the toner grains move the moving time are known beforehand and give a flight velocity, the velocity of the free toner grains T marked in red on the screen was measured by a PTV. FIG. 29 shows a specific velocity distribution measured in a histogram. Because the potential of the drum 100 was −100 V or −300 V and because the effective DC value $V_{DC}$ was −500, as stated earlier, observation was made with a case of $V_{PC}-V_{DC}=400$ V and a case of $V_{PC}-V_{DC}=200$ V. On the suffice of the drum 100, the potential difference $V_{PC}-V_{DC}=400$ occurs in a so-called solid image portion while the potential difference of $V_{PC}-V_{DC}=200$ V occurs in a so-called halftone image portion.

The duty ratio (%) was varied to 20, 40, 50, 60 and 65 in each of the two cases stated above to thereby vary the flight velocity of toner grains. A developing ability was estimated on the basis of the resulting mean flight velocity and standard velocity deviation. The developing ability estimated includes uniformity of solid density, background contamination, and uniformly of a lby dot image. The results of estimation are listed in FIG. 30; estimation rank sequentially falls from a double circle to a cross by way of a circle and a triangle.

As FIG. 30 indicates, as for the uniformity of dots in a solid image portion when $V_{PC}-V_{DC}=400$ V holds, the result of estimation is a circle when the mean velocity (m/s) is 1.0, a double circle when the mean velocity is 0.95, 0.80 or 0.87, and a cross when the mean velocity is 1.1. In this respect, Examples (Ex.) 1 through 3 and Comparative Example (Com. Ex.) 1 are acceptable and indicate that high image quality is attainable if the mean flight velocity is 1 m/s or below for $V_{PC}-V_{DC}=400$ V. It is to be noted that a mean flight velocity is produced by determining the flight velocities of a plurality of randomly sampled free toner grains at consecutive times and then averaging all of the flight velocities.

As for the uniformity of density in a solid image portion when $V_{PC}-V_{DC}=400$ holds, the result of estimation is a double circle when irregularity in the moving speed of toner grains at each duty ratio, e.g., when a standard deviation derived from the data shown in FIG. 29 is 0.15, 0.57, 0.66 or 0.75. The result of estimation is a triangle when the standard deviation is 0.42. In this respect, Examples 1 through 3 and Comparative Example 2 are acceptable and indicate that high image quality is attainable if the standard deviation of the flight velocity distribution of free toners is 0.51 or above for $V_{PC}-V_{DC}=400$ V. It is to be noted that a mean flight velocity is produced by determining the flight velocities of a plurality of randomly sampled free toner grains at consecutive times and then averaging all of the flight velocities.

As for background contamination in a halftone image portion when $V_{PC}-V_{DC}=200$ V holds, the result of estimation is a double circle when the mean velocity is 0.65, 0.58, 0.50 or 0.45, and a circle when it is 0.68. In this respect, Examples 1 through 3 and Comparative Example 1 are acceptable and indicate that high image quality is attainable if the mean flight velocity is 0.65 m/s or below for $V_{PC}-V_{DC}=200$ V.

Why the developing conditions and the results of estimation stated above hold will be examined hereinafter. As for a solid image, generally from the viewpoint of developing efficiency relating to high-speed development, the amount of toner deposition for a unit time advantageously increases with an increase in the flight speed of toner grains. In practice, however, if all the toner grains hit against a latent image at extremely high velocity, then the toner grains, which are elastic, rebound upon the drum and fail to deposit on expected positions and, in addition, remove toner grains present on the drum. This is presumably the cause of low uniformity of dots or low reproducibility of dots. It follows that a bias of the kind increasing the flight speed is not desirable for a solid image.

If the toner grains sprung back due to elasticity and the toner grains removed from the expected positions deposit around an image, then they contaminate the background of the image. Moreover, background contamination is more conspicuous in a halftone image portion than in a solid image portion, as will be described hereinafter. In conclusion, it may be said that if the flight speed is high, it degrades the uniformity of dots and induces background contamination. This is the case with the duty ratio (%) of 60 or below shown in FIG. 30.

As for a halftone image when $V_{PC}-V_{DC}=200$ holds, after toner grains have deposited on the image portion of the preselected polarity in a sufficient amount and electrostatically saturated, other toner grains flying toward the image portion have no place to deposit. The bias, containing the AC voltage, causes such toner grains to oscillate, or hop, on the drum surface and hit against a non-image portion more often. In the case of a solid image, most of toner grains in flight deposit on and fill up the solid image, contaminating the background little. By contrast, in a halftone image portion, much toner grains, hopping on the drum surface, deposit around the image portion to thereby intensify the edge effect. Further, such toner grains deposited on the portion around the image portion do not spring back, but deform and adhere, if the flight speed is excessively high, aggravating the probability of background contamination. In this sense, providing the flight velocity with an upper limit is significant.

As for the uniformity of density, in FIG. 3, the standard deviation, relating to irregularity in toner velocity, is applied to the estimation of uniformity of density for the following reason. Toner grains sometimes fly in the form of masses. If the velocity distribution differs from one mass to another mass to some degree, i.e., if the standard deviation is 0.51 or above, then fast toners and slow toners interfere with each other during flight, so that the velocities tend to be lowered or averaged. Consequently, the number of toner grains that hit against and rebound tends to decrease, improving the uniformity of density. On the other hand, it will be seen that when the standard deviation of velocity distribution when $V_{PC}-V_{DC}=400$ holds is less than 0.51, the uniformly of solid density tends to decrease. This is presumably because the masses of toner grains fly and deposit on the drum surface. This is also true with a halftone image.

As described with reference to FIG. 25, a duty ratio is a ratio between power causing toner grains to fly from the sleeve toward the drum or latent image and power causing them to fly in the reverse direction. Increasing the duty ratio means increasing the power causing toner grains to fly toward the drum and therefore increasing the flight velocity. While the flight velocity has been shown and described as being varied on the basis of the duty ratio, any one of toner grain size, sleeve linear velocity, Vpp of the bias or the frequency f of the AC component on which the flight velocity is also dependent may be varied.

Various modifications will become possible for those skilled in the art after receiving the teachings of the present disclosure without departing from the scope thereof.

What is claimed is:

1. In a method of developing a latent image formed on a surface of an image carrier with toner grains, which constitute a developer together with magnetic carrier grains for supporting said toner grains, by depositing said developer on a developer carrier, which faces said image carrier and accommodates magnetic field forming means therein, causing said developer carrier to convey said developer to a developing zone formed between said image carrier and said developer carrier, and forming, in said developing zone, a magnet brush consisting of said magnetic carrier grains, which hold said toner grains thereon and gather in a form of brush chains, and free toner grains to be released from said carrier grains, said brush chains of said magnetic carrier grains flow in said developing zone while forming said magnet brush, and, assuming that a potential of said image carrier is $V_{PC}$ and that a DC component of a potential of said developer carrier is $V_{DC}$, said free toner grains, parted from said magnetic carrier grains flowing, fly at a mean flight velocity of 1 m/s or below when $V_{PC}-V_{DC}=400$ V holds.

2. The method as claimed in claim 1, wherein the free toner grains are caused to move toward said image carrier, and subsequently the free toner grains are moved from said carrier grains toward said image carrier and toner grains are moved from said image carrier toward said carrier grains to thereby develop the latent image.

3. The method as claimed in claim 1, wherein the free toner grains part from the carrier grains in the developing zone where said free toner grains are capable of moving toward the latent image.

4. The method as claimed in claim 1, wherein a zone where the free toner grains part from the carrier grains is controlled by said magnetic field forming means.

5. The method as claimed in claim 4, wherein the zone where the free toner grains part is positioned upstream of a closest position where said image carrier and said developer carrier are closest to each other in a direction of movement of the developer.

6. The method as claimed in claim 4, wherein the zone where the free toner grains part from the carrier grains is at a position where said image carrier and said developer carrier are closest to each other in a direction of movement of the developer.

7. The method as claimed in claim 1, wherein the magnet brush rubs said image carrier.

8. The method as claimed in claim 1, wherein the electric field comprises an alternating electric field.

9. In a method of developing a latent image formed on a surface of an image carrier with toner grains, which constitute a developer together with magnetic carrier grains for supporting said toner grains, by depositing said developer on a developer carrier, which faces said image carrier and accommodates magnetic field forming means therein, causing said developer carrier to convey said developer to a developing zone formed between said image carrier and said developer carrier, and forming, in said developing zone, a magnet brush consisting of said magnetic carrier grains, which hold said toner grains thereon and gather in a form of brush chains, and free toner grains to be released from said carrier grains, said brush chains of said magnetic carrier grains flow in said developing zone while forming said magnet brush, and, assuming that a potential of said image carrier is $V_{PC}$ and that a DC component of a potential of said developer carrier is $V_{DC}$, said free toner grains, parted from said magnetic carrier grains flowing, fly with a standard deviation of a flight velocity distribution of 0.51 or above when $V_{PC}-V_{DC}=400$ V holds.

10. The method as claimed in claim 9, wherein the free toner grains are caused to move toward said image carrier, and subsequently the free toner grains are moved from said carrier grains toward said image carrier and toner grains are moved from said image carrier toward said carrier grains to thereby develop the latent image.

11. The method as claimed in claim 9, wherein the free toner grains part from the carrier grains in the developing zone where said free toner grains are capable of moving toward the latent image.

12. The method as claimed in claim 9, wherein a zone where the free toner grains part from the carrier grains is controlled by said magnetic field forming means.

13. The method as claimed in claim 12, wherein the zone where the free toner grains part is positioned upstream of a closest position where said image carrier and said developer carrier are closest to each other in a direction of movement of the developer.

14. The method as claimed in claim 12, wherein the zone where the free toner grains part from the carrier grains is at a position where said image carrier and said developer carrier are closest to each other in a direction of movement of the developer.

15. The method as claimed in claim 9, wherein the magnet brush rubs said image carrier.

16. The method as claimed in claim 9, wherein the electric field comprises an alternating electric field.

17. In a method of developing a latent image formed on a surface of an image carrier with toner grains, which constitute a developer together with magnetic carrier grains for supporting said toner grains, by depositing said developer on a developer carrier, which faces said image carrier and accommodates magnetic field forming means therein, causing said developer carrier to convey said developer to a developing zone formed between said image carrier and said developer carrier, and forming, in said developing zone, a magnet brush consisting of said magnetic carrier grains, which hold said toner grains thereon and gather in a form of brush chains, and free toner grains to be released from said carrier grains, said brush chains of said magnetic carrier grains flow in said developing zone while forming said magnet brush, and, assuming that a potential of said image carrier is $V_{PC}$ and that a DC component of a potential of said developer carrier is $V_{DC}$, said free toner grains, parted from said magnetic carrier grains flowing, fly with a mean flight velocity of 0.65 m/s or below when $V_{PC}-V_{DC}=200$ V holds.

18. The method as claimed in claim 17, wherein the free toner grains are caused to move toward said image carrier, and subsequently the free toner grains are moved from said carrier grains toward said image carrier and toner grains are moved from said image carrier toward said carrier grains to thereby develop the latent image.

19. The method as claimed in claim 17, wherein the free toner grains part from the carrier grains in the developing zone where said free toner grains are capable of moving toward the latent image.

20. The method as claimed in claim 17, wherein a zone where the free toner grains part from the carrier grains is controlled by said magnetic field forming means.

21. The method as claimed in claim 20, wherein the zone where the free toner grains part is positioned upstream of a closest position where said image carrier and said developer carrier are closest to each other in a direction of movement of the developer.

22. The method as claimed in claim 20, wherein the zone where the free toner grains part from the carrier grains is at a position where said image carrier and said developer carrier are closest to each other in a direction of movement of the developer.

23. The method as claimed in claim 17, wherein the magnet brush rubs said image carrier.

24. The method as claimed in claim 17, wherein the electric field comprises an alternating electric field.

25. In a device for developing a latent image formed on a surface of an image carrier with toner grains, which constitute a developer together with magnetic carrier grains for supporting said toner grains, by depositing said developer on a developer carrier, which faces said image carrier and accommodates magnetic field forming means therein, causing said developer carrier to convey said developer to a developing zone formed between said image carrier and said developer carrier, and forming, in said developing zone, a magnet brush consisting of said magnetic carrier grains, which hold said toner grains thereon and gather in a form of brush chains, and free toner grains to be released from said carrier grains, said brush chains of said magnetic carrier grains flow in said developing zone while forming said magnet brush, and, assuming that a potential of said image carrier is $V_{PC}$ and that a DC component of a potential of said developer carrier is $V_{DC}$, said free toner grains, parted from said magnetic carrier grains flowing, fly at a mean flight velocity of 1 m/s or below when $V_{PC}-V_{DC}=400$ V holds.

26. The device as claimed in claim 25, wherein the free toner grains are caused to move toward said image carrier, and subsequently the free toner grains are moved from said carrier grains toward said image carrier and toner grains are moved from said image carrier toward said carrier grains to thereby develop the latent image.

27. In a device for developing a latent image formed on a surface of an image carrier with toner grains, which constitute a developer together with magnetic carrier grains for supporting said toner grains, by depositing said developer on a developer carrier, which faces said image carrier and accommodates magnetic field forming means therein, causing said developer carrier to convey said developer to a developing zone formed between said image carrier and said developer carrier, and forming, in said developing zone, a magnet brush consisting of said magnetic carrier grains, which hold said toner grains thereon and gather in a form of brush chains, and free toner grains to be released from said carrier grains, said brush chains of said magnetic carrier grains flow in said developing zone while forming said magnet brush, and, assuming that a potential of said image carrier is $V_{PC}$ and that a DC component of a potential of said developer carrier is $V_{DC}$, said free toner grains, parted from said magnetic carrier grains flowing, fly with a standard deviation of a flight velocity distribution of 0.51 or above when $V_{PC}-V_{DC}=400$ V holds.

28. The device as claimed in claim 27, wherein the free toner grains are caused to move toward said image carrier, and subsequently the free toner grains are moved from said carrier grains toward said image carrier and toner grains are moved from said image carrier toward said carrier grains to thereby develop the latent image.

29. In a device for developing a latent image formed on a surface of an image carrier with toner grains, which constitute a developer together with magnetic carrier grains for supporting said toner grains, by depositing said developer on a developer carrier, which faces said image carrier and accommodates magnetic field forming means therein, causing said developer carrier to convey said developer to a developing zone formed between said image carrier and said developer carrier, and forming, in said developing zone, a magnet brush consisting of said magnetic carrier grains, which hold said toner grains thereon and gather in a form of brush chains, and free toner grains to be released from said carrier grains, said brush chains of said magnetic carrier grains flow in said developing zone while forming said magnet brush, and, assuming that a potential of said image carrier is $V_{PC}$ and that a DC component of a potential of said developer carrier is $V_{DC}$, said free toner grains, parted from said magnetic carrier grains flowing, fly with a mean flight velocity of 0.65 m/s or below when $V_{PC}-V_{DC}=200$ V holds.

30. The device as claimed in claim 29, wherein the free toner grains are caused to move toward said image carrier, and subsequently the free toner grains are moved from said carrier grains toward said image carrier and toner grains are moved from said image carrier toward said carrier grains to thereby develop the latent image.

31. An image forming apparatus comprising:

an image carrier configured to form a latent image thereon; and a developing device facing said image carrier and accommodating magnetic field forming means therein;

wherein said developing device comprises a developer carrier configured to convey a two-component type developer, consisting of toner grains and magnetic carrier grains for supporting said toner grains, deposited thereon to a developing zone where said developer carrier faces said image carrier to thereby form a magnet brush, which include free toner grains parted from said magnetic carrier grains, and develops the latent image with said magnet brush, in the event of development, brush chains formed by said magnetic carrier grains flow while releasing said free toner grains, assuming that a potential of said image carrier is $V_{PC}$ and that a DC component of a potential of said developer carrier is $V_{DC}$, said free toner grains, parted from said magnetic carrier grains flowing, fly at a mean flight velocity of 1 m/s or below when $V_{PC}-V_{DC}=400$ V holds.

32. The device as claimed in claim 31, wherein the free toner grains are caused to move toward said image carrier, and subsequently the free toner grains are moved from said carrier grains toward said image carrier and toner grains are moved from said image carrier toward said carrier grains to thereby develop the latent image.

33. An image forming apparatus comprising:

an image carrier configured to form a latent image thereon; and a developing device facing said image carrier and accommodating magnetic field forming means therein;

wherein said developing device comprises a developer carrier configured to convey a two-component type developer, consisting of toner grains and magnetic carrier grains for supporting said toner grains, deposited thereon to a developing zone where said developer carrier faces said image carrier to thereby form a magnet brush, which include free toner grains parted from said magnetic carrier grains, and develops the latent image with said magnet brush, in the event of development, brush chains formed by said magnetic carrier grains flow while releasing said free toner grains, assuming that a potential of said image carrier is $V_{PC}$ and that a DC component of a potential of said developer carrier is $V_{DC}$, said free toner grains, parted from said magnetic carrier grains flowing, fly with a standard deviation of a flight velocity distribution of 0.51 or above when $V_{PC}-V_{DC}=400$ V holds.

34. The device as claimed in claim 33, wherein the free toner grains are caused to move toward said image carrier, and subsequently the free toner grains are moved from said carrier grains toward said image carrier and toner grains are moved from said image carrier toward said carrier grains to thereby develop the latent image.

35. An image forming apparatus comprising:

an image carrier configured to form a latent image thereon; and a developing device facing said image carrier and accommodating magnetic field forming means therein;

wherein said developing device comprises a developer carrier configured to convey a two-component type developer, consisting of toner grains and magnetic carrier grains for supporting said toner grains, deposited thereon to a developing zone where said developer carrier faces said image carrier to thereby form a magnet brush, which include free toner grains parted from said magnetic carrier grains, and develops the latent image with said magnet brush, in the event of development, brush chains formed by said magnetic carrier grains flow while releasing said free toner grains, assuming that a potential of said image carrier is $V_{PC}$ and that a DC component of a potential of said developer carrier is $V_{DC}$, said free toner grains, parted from said magnetic carrier grains flowing, fly with a mean flight velocity of 0.65 m/s or below when $V_{PC}-V_{DC}=200$ V holds.

36. The device as claimed in claim 35, wherein the free toner grains are caused to move toward said image carrier, and subsequently the free toner grains are moved from said carrier grains toward said image carrier and toner grains are moved from said image carrier toward said carrier grains to thereby develop the latent image.

* * * * *